US009616558B2

(12) United States Patent
Nishikawa et al.

(10) Patent No.: US 9,616,558 B2
(45) Date of Patent: Apr. 11, 2017

(54) IMPACT TOOL

(75) Inventors: Tomomasa Nishikawa, Ibaraki (JP); Nobuhiro Takano, Ibaraki (JP); Hideyuki Tanimoto, Ibaraki (JP); Kazutaka Iwata, Ibaraki (JP); Hironori Mashiko, Ibaraki (JP); Hayato Yamaguchi, Ibaraki (JP); Atsushi Nakagawa, Ibaraki (JP); Katsuhiro Oomori, Ibaraki (JP); Mizuho Nakamura, Ibaraki (JP); Hiroki Uchida, Ibaraki (JP); Saroma Nakano, Ibaraki (JP); Chikai Yoshimizu, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 1391 days.

(21) Appl. No.: 13/387,743

(22) PCT Filed: Jul. 29, 2010

(86) PCT No.: PCT/JP2010/063236
§ 371 (c)(1),
(2), (4) Date: Apr. 23, 2012

(87) PCT Pub. No.: WO2011/013854
PCT Pub. Date: Feb. 3, 2011

(65) Prior Publication Data

US 2012/0199372 A1 Aug. 9, 2012

(30) Foreign Application Priority Data

Jul. 29, 2009 (JP) ..... 2009-177114
Sep. 16, 2009 (JP) ..... 2009-215086
Nov. 12, 2009 (JP) ..... 2009-259354

(51) Int. Cl.
*B25B 19/00* (2006.01)
*B25B 21/02* (2006.01)
*B25B 23/147* (2006.01)

(52) U.S. Cl.
CPC ..... *B25B 23/1475* (2013.01); *B25B 21/02* (2013.01)

(58) Field of Classification Search
CPC ..... B25D 9/145; B25B 19/00; B25B 21/02
(Continued)

(56) References Cited

U.S. PATENT DOCUMENTS 3,672,185 A * 6/1972 Schoeps ..... B06B 1/186 173/93
4,920,836 A * 5/1990 Sugimoto ..... B25B 21/02 173/93.5
(Continued)

FOREIGN PATENT DOCUMENTS

CN 1695900 A 11/2005
CN 101171101 A 4/2008
(Continued)

OTHER PUBLICATIONS

Notification of Reasons for Refusal for Japanese Patent App. No. 2009-177114 (Aug. 28, 2013) with English language translation thereof.
(Continued)

*Primary Examiner* — Gloria R Weeks
(74) *Attorney, Agent, or Firm* — Kenealy Vaidya LLP

(57) ABSTRACT

According to an aspect of the present invention, there is provided an impact tool including: a motor; a hammer connected to an output portion of the motor; and an anvil to be struck by the hammer in a rotation direction and having a rotary shaft, the hammer striking the anvil in the rotation direction by driving the motor in pulses, wherein the anvil
(Continued)

is provided in front of the hammer, wherein the hammer is driven in pulses by the motor, and wherein a rotation angle of the hammer is substantially proportional to a rotation angle of the motor.

7 Claims, 36 Drawing Sheets

(58) Field of Classification Search
USPC ..... 173/128, 132, 200
See application file for complete search history.

(56) References Cited

U.S. PATENT DOCUMENTS

| | | | | |
|---|---|---|---|---|
| 5,181,575 | A * | 1/1993 | Maruyama | B25B 23/1453 173/180 |
| 5,217,079 | A * | 6/1993 | Kettner | B25B 23/1453 173/177 |
| 5,366,026 | A * | 11/1994 | Maruyama | B23P 19/066 173/180 |
| 6,836,614 | B2 * | 12/2004 | Gilmore | B23P 19/066 173/176 |
| 7,048,075 | B2 * | 5/2006 | Saito | B25B 21/02 173/178 |
| 7,334,648 | B2 * | 2/2008 | Arimura | B25B 21/02 173/176 |
| 7,455,121 | B2 * | 11/2008 | Saito | B25B 21/02 173/162.2 |
| 8,678,106 | B2 * | 3/2014 | Matsunaga | B25B 21/02 173/176 |
| 2005/0205274 | A1 * | 9/2005 | Bogue | B25B 21/00 173/2 |
| 2005/0263303 | A1 | 12/2005 | Shimizu et al. | |
| 2009/0014192 | A1 | 1/2009 | Ito et al. | |
| 2009/0173194 | A1 * | 7/2009 | Chen | B25B 23/1475 81/469 |
| 2010/0096155 | A1 * | 4/2010 | Iwata | B25B 23/1475 173/176 |
| 2012/0199372 | A1 * | 8/2012 | Nishikawa | B25B 23/1475 173/132 |
| 2013/0075121 | A1 * | 3/2013 | Nakamura | B25B 21/02 173/94 |

FOREIGN PATENT DOCUMENTS

| | | | |
|---|---|---|---|
| CN | 201092022 | Y | 7/2008 |
| EP | 1595651 | A1 | 12/2005 |
| EP | 1930124 | A1 | 6/2008 |
| GB | 2441670 | A | 10/2006 |
| JP | 07-040258 | A | 2/1995 |
| JP | 2002-001676 | A | 1/2002 |
| JP | 2008-055580 | A | 3/2008 |
| JP | 2008-57747 | A | 3/2008 |
| JP | 2008-168360 | A | 7/2008 |
| JP | 2008-187766 | A | 8/2008 |
| JP | 2009-072888 | A | 4/2009 |
| SU | 806394 | A1 | 2/1981 |
| SU | 1134359 | A | 1/1985 |

OTHER PUBLICATIONS

The Russian Office Action for the related Russian Patent Application No. 2012 107 227 dated Aug. 5, 2013.

Office Action from Chinese Patent App. No. 201080033577.2 (Nov. 4, 2013) with English language translation thereof.

Russian Office Action for the related Russian Patent App. No. 2012 107 227 dated Feb. 5, 2014 with English language translation thereof.

Japanese Office Action for the related Japanese Patent App. No. 2009-259354 dated Nov. 5, 2013 with English language translation thereof.

* cited by examiner (1)

(2)

(3)

(4)

(1)

(2)

(3)

(4)

IMPACT TOOL

TECHNICAL FIELD

An aspect of the present invention relates to an impact tool which is driven by a motor and realizes a new striking mechanism.

BACKGROUND ART

In an impact tool, a rotation striking mechanism is driven by a motor as a driving source to provide rotation and striking to an anvil, thereby intermittently transmitting rotation striking power to a tip tool for performing operation, such as screwing. As a motor, a brushless DC motor is widely used. The brushless DC motor is, for example, a DC (direct current) motor with no brush (brush for commutation). Coils (windings) are used on the stator side, magnets (permanent magnets) are used on the rotor side, and a rotor is rotated as the electric power driven by an inverter circuit is sequentially applied to predetermined coils. The inverter circuit is constructed using an FET (field effect transistor), and a high-capacity output transistor such as an IGBT (insulated gate bipolar transistor), and is driven by a large current. The brushless DC motor has excellent torque characteristics as compared with a DC motor with a brush, and is able to fasten a screw, a bolt, etc. to a base member with a stronger force.

JP-2009-072888-A discloses an impact tool using the brushless DC motor. In JP-2009-072888-A, the impact tool has a continuous rotation type impact mechanism. When torque is given to a spindle via a power transmission mechanism (speed-reduction mechanism), a hammer which movably engages in the direction of a rotary shaft of the spindle rotates, and an anvil which abuts on the hammer is rotated. The hammer and the anvil have two hammer convex portions (striking portions) which are respectively arranged symmetrically to each other at two places on a rotation plane, these convex portions are at positions where the gears mesh with each other in a rotation direction, and rotation striking power is transmitted by meshing between the convex portions. The hammer is made axially slidable with respect to the spindle in a ring region surrounding the spindle, and an inner peripheral surface of the hammer includes an inverted V-shaped (substantially triangular) cam groove. A V-shaped cam groove is axially provided in an outer peripheral surface of the spindle, and the hammer rotates via balls (steel balls) inserted between the cam groove and the inner peripheral cam groove of the hammer.

In the conventional power transmission mechanism, the spindle and the hammer are held via the balls arranged in the cam groove, and the hammer is constructed so as to be able to retreat axially rearward with respect to the spindle by the spring arranged at the rear end thereof. As a result, the number of parts of the spindle and the hammer increases, high attaching accuracy between the spindle and the hammer is required, thereby increasing the manufacturing cost.

Meanwhile, in the impact tool of the conventional technique, in order to perform a control so as not to operate the impact mechanism (that is, in order that striking does not occur), for example, a mechanism for controlling a retreat operation of the hammer is required. The impact tool of JP-2009-072888-A cannot be used in a so-called drill mode. Further, even if a drill mode is realized (even if a retreat operation of the hammer is controlled), in order to realize even the clutch operation of interrupting power transmission when a given fastening torque is achieved, it is necessary to provide a clutch mechanism separately, and realizing the drill mode and the drill mode with a clutch in the impact tool leads to cost increase.

Further, in JP-2009-072888-A, the driving electric power to be supplied to the motor is constant irrespective of the load state of a tip tool during the striking by the hammer. Accordingly, striking is performed with a high fastening torque even in the state of light load. Asa result, excessive electric power is supplied to the motor, and useless power consumption occurs. And, a so-called coming-out phenomenon occurs where a screw advances excessively during screwing as striking is performed with a high fastening torque, and the tip tool is separated from a screw head.

SUMMARY OF INVENTION

One object of the invention is to provide an impact tool in which an impact mechanism is realized by a hammer and an anvil with a simple mechanism.

Another object of the invention is to provide an impact tool which can drive a hammer and an anvil between which the relative rotation angle is less than 360 degrees, thereby performing a fastening operation, by devising a driving method of a motor.

Still another object of the invention is to provide a multi-use impact tool which can switch and be used in a drill mode and impact mode.

According to Item 1 of the present invention, there is provided an impact tool including: a motor; a speed-reduction mechanism which reduces a rotation of the motor; a hammer connected to an output portion of the speed-reduction mechanism; and an anvil which receives a torque or a striking power from the hammer to rotate a tip tool, the output portion of the speed-reduction mechanism, the hammer and the anvil being coaxially arranged, wherein the hammer has one or more sets of protruding portions which protrude circumferentially or axially from a main body portion, and a fitting portion arranged on an axis thereof, wherein the anvil has one or more sets of protruding portions which protrude circumferentially or axially from the main body portion, and a fitting portion which fits to the fitting portion of the hammer, wherein the protruding portions of at least one of the anvil and the hammer have striking-side surfaces which collide with each other, and wherein the anvil and the hammer are formed so that the protruding portions of the anvil and the hammer can rotate relatively at a maximum rotation angle of 60 degrees or more, and less than 360 degrees.

According to Item 2 of the present invention, there is provided the impact tool, wherein the speed-reduction mechanism is a planetary gear mechanism, wherein an output shaft of the motor is connected to a sun gear of the planetary gear mechanism, and wherein the hammer is fixed so as to connect rotary shafts of plural planetary gears of the planetary gear mechanism.

According to Item 3 of the present invention, there is provided the impact tool, wherein the hammer and a spindle are manufactured with a metallic integral construction, respectively.

According to Item 4 of the present invention, there is provided the impact tool, wherein the hammer is intermittently struck on the anvil by rotating the motor in the normal direction and in the reverse direction.

According to Item 5 of the present invention, there is provided the impact tool, wherein the hammer and the anvil are provided with two blade portions which extend radially outward from the main body portion, and wherein the protruding portions are formed in the blade portions.

According to Item 6 of the present invention, there is provided the impact tool, wherein each of the blade portions is formed with two protruding portions having striking-side surfaces, and wherein plural striking-side surfaces formed in the protruding portions of the hammer is constructed so as to simultaneously collide with plural striking-side surfaces formed in the protruding portions of the anvil.

According to Item 7 of the present invention, there is provided the impact tool, wherein striking portions of the anvil and the hammer rotate relatively at a maximum rotation angle of 180 degrees or more, and less than 360 degrees.

According to Item 8 of the present invention, there is provided an impact tool including: a motor; and a two-parts striking mechanism connected to the motor and journalled to the motor so as to be rotatable to each other, thereby striking a tip tool, wherein the striking mechanism allows only relative rotation of less than 360 degrees, and wherein striking power is provided to the tip tool by intermittently driving the motor normally and reversely.

According to Item 9 of the present invention, there is provided the impact tool, wherein the striking mechanism includes a hammer having a striking-side surface and an anvil having a struck-side surface, and wherein the anvil is manufactured with a metallic integral construction, and has a holding hole which holds a tip tool.

According to Item 10 of the present invention, there is provided the impact tool, wherein the motor and the hammer are connected together via a planetary gear speed-reduction mechanism, and wherein the hammer functions as a planetary carrier which holds plural planetary gears of the planetary gear speed-reduction mechanism.

According to Item 11 of the present invention, there is provided an impact tool including: a motor; a hammer connected to an output portion of the motor; and an anvil to be struck by the hammer in a rotation direction, wherein the hammer is rotatable at 180 degrees or more, as run-up rotation before the hammer strikes the anvil.

According to Item 12 of the present invention, there is provided the impact tool, wherein the hammer is almost immovable axially with respect to the anvil.

According to Item 13 of the present invention, there is provided an impact tool including: a motor; a hammer connected to an output portion of the motor; and an anvil to be struck by the hammer in a rotation direction, wherein the hammer provides a first solitary protrusion at a first radial concentric position, wherein the anvil provides a second solitary protrusion at a second radial concentric position, and wherein the second solitary protrusion is capable of being struck by the first solitary protrusion.

According to Item 14 of the present invention, there is provided the impact tool, wherein the hammer provides a third solitary protrusion at a third radial concentric position, wherein the anvil provides a fourth solitary protrusion at a fourth radial concentric position, and wherein the fourth solitary protrusion is capable of being struck by the third solitary protrusion.

According to Item 15 (Point 1) of the present invention, there is provided an impact tool including: a motor; a hammer connected to an output portion of the motor; and an anvil to be struck by the hammer in a rotation direction and having a rotary shaft, the hammer striking the anvil in the rotation direction by driving the motor in pulses, wherein the anvil is provided in front of the hammer, wherein the hammer is driven in pulses by the motor, and wherein a rotation angle of the hammer is substantially proportional to a rotation angle of the motor.

According to Item 16 of the present invention, there is provided the impact tool, wherein the hammer is provided with a first protruding portion which protrudes forward from the hammer, and wherein the anvil is provided with a second protruding portion which extends radially further than the rotary shaft.

According to Item 17 (Point 2) of the present invention, there is provided the impact tool, wherein the motor rotates a pinion, wherein plural planetary gears which mesh with the pinion are provided, and wherein rotary shafts of the plural planetary gears are fixed to the hammer.

According to Item 18 of the present invention, there is provided the impact tool, wherein the hammer is driven in pulses by the motor.

According to Item 19 (Point 3) of the present invention, there is provided the impact tool, wherein a tip tool holding portion is fixed to the anvil.

According to Item 20 (Point 4) of the present invention, there is provided the impact tool, further including a housing which accommodates the motor, wherein the hammer has a cylindrical portion smaller than the external diameter of the hammer at a rear portion of the hammer, and wherein the hammer is rotatably held in the housing by a bearing held at the cylindrical portion.

According to Item 21 (Point 5) of the present invention, there is provided the impact tool, wherein the hammer and the cylindrical portion are integrally formed.

According to Item 22 of the present invention, there is provided an impact tool including: a motor; a hammer driven in pulses by the motor; an anvil to be struck by the hammer in a rotation direction; and a tip tool holding portion provided at the anvil.

According to Item 23 of the present invention, there is provided the impact tool, wherein a speed-reduction mechanism is provided between the motor and the hammer.

According to Item 24 (Point 6) of the present invention, there is provided an impact tool including: a motor; a hammer driven in pulses by the motor; and an anvil provided coaxially with the hammer to be struck by the hammer in a rotation direction.

According to Item 25 (Point 7) of the present invention, there is provided the impact tool, wherein a fitting groove is provided at a rear portion of the anvil, and wherein a fitting shaft which fits into the fitting groove is provided at a front portion of the hammer.

According to Item 26 (Point 8) of the present invention, there is provided an impact tool including: a motor; a hammer connected to the motor; and an anvil rotated by the hammer, the anvil being rotated in a normal direction by rotating the hammer in the normal direction and in a reverse direction, wherein the hammer is rotated in the normal direction after the hammer is rotated in the reverse direction and is made to collide with the anvil.

According to Item 27 (Point 9) of the present invention, there is provided the impact tool, wherein the hammer is connected to the motor via a speed-reduction mechanism which reduces a rotation of the motor, wherein the output portion of the speed-reduction mechanism, the hammer and the anvil are coaxially arranged, wherein the hammer has one or more sets of protruding portions which protrude radially outward or axially from a main body portion, and a fitting portion formed on the axis, wherein the anvil has one or more sets of protruding portions which protrude radially outward or axially from the main body portion, and a fitting portion which fits to the fitting portion of the hammer portion, and wherein the protruding portions of at least one of the anvil and the hammer have striking-side surfaces which collide with each other, and wherein the hammer is rotated in the normal direction while striking the hammer and the anvil alternately in both directions by rotating the motor in the normal direction and in the reverse direction.

According to Item 28 (Point 10) of the present invention, there is provided the impact tool, wherein striking portions of the anvil and the hammer turn relatively at a rotation angle of 180 degrees or more, and less than 360 degrees.

According to Item 29 (Point 11) of the present invention, there is provided the impact tool, wherein, as for the rotation number of the motor when the hammer strikes the anvil, the rotation number during reverse rotation striking is lower than that during normal rotation striking.

According to Item 30 (Point 12) of the present invention, there is provided the impact tool, wherein the rotation number of the motor during normal rotation striking is twice or more the rotation number during reverse rotation striking.

According to Item 31 (Point 13) of the present invention, there is provided the impact tool, wherein, as for the striking torque when the hammer strikes the anvil, the striking torque during reverse rotation striking is smaller than that during normal rotation striking.

According to Item 32 (Point 14) of the present invention, there is provided the impact tool, wherein, as for the lead angle of the anvil when the hammer strikes the anvil, the lead angle during reverse rotation striking is lower than that during normal rotation striking.

According to Item 33 (Point 15) of the present invention, there is provided the impact tool, wherein a control unit is provided to control rotation of the motor, and wherein the control unit performs control so as to supply a normal rotation current to accelerate the motor in the normal rotation direction, supply a reverse rotation current to the motor, reversely rotating the hammer after rotation of the motor is reduced to a first given rotation number if the hammer has collided with the anvil, turn off a current to be supplied to the motor if the reverse rotation of the motor has reached a second given rotation number, make the hammer and the anvil collide with each other in a reverse rotation direction, and supply the normal rotation current again after the collision to accelerate the motor in the normal rotation direction.

According to Item 34 (Point 16) of the present invention, there is provided the impact tool, wherein the motor is a brushless DC motor driven using a rotational position detecting element, and wherein the rotation number of the motor is calculated using an output signal of the rotational position detecting element.

According to Item 35 of the present invention, there is provided an impact tool including: a motor; a speed-reduction mechanism which reduces a rotation of the motor; a hammer connected to an output portion of the speed-reduction mechanism; an anvil which receives a torque or a striking power from the hammer to rotate a tip tool, the output portion of the speed-reduction mechanism, the hammer and the anvil being coaxially arranged, and the tip tool being rotated by rotating the motor in the normal direction and in the reverse direction to strike the anvil with the hammer; and a brake mechanism provided to stop the rotation of the hammer.

According to Item 36 of the present invention, there is provided the impact tool, wherein striking portions of the anvil and the hammer rock relatively at a rotation angle of less than 360 degrees.

According to Item 37 of the present invention, there is provided the impact tool, wherein the brake mechanism is axially arranged between the hammer and the speed-reduction mechanism.

According to Item 38 of the present invention, there is provided the impact tool, wherein the brake mechanism includes a gear mechanism capable of rotating by given rotation of less than one rotation relative to the hammer, and a pawl which limits movement of the gear mechanism in a given direction.

According to Item 39 of the present invention, there is provided the impact tool, wherein the pawl has a first pawl which limits rotation of the gear mechanism in a normal rotation direction, and a second pawl which limits rotation of the gear mechanism in a reverse rotation direction, and wherein the brake mechanism has a switch to operate either the first pawl or the second pawl.

According to Item 40 of the present invention, there is provided the impact tool, wherein the switch operates in conjunction with a normal/reverse switching lever which switches the rotation direction of the motor.

According to Item 41 of the present invention, there is provided the impact tool, wherein the gear mechanism is a sprocket formed with a gear portion and an intermittent ring.

According to Item 42 of the present invention, there is provided the impact tool, wherein a control unit is provided to control rotation of the motor, and wherein the control unit performs control so as to supply a normal rotation current to accelerate the motor in the normal rotation direction, supply a reverse rotation current to the motor, reversely rotating the hammer after rotation of the motor is reduced to a first given rotation number if the hammer has collided with the anvil, turn off a current to be supplied to the motor if the reverse rotation of the motor has reached a second given rotation number, and supply the normal rotation current again to accelerate the motor in the normal rotation direction if the rotation of the hammer has been stopped by the brake mechanism.

According to Item 43 of the present invention, there is provided an impact tool including: a motor; a hammer rotationally driven by the motor; an anvil which receives a torque or a striking power from the hammer, thereby striking the anvil with the hammer by rotating the motor; and a brake portion provided to stop or inhibit reverse rotation of the hammer.

According to Item 44 of the present invention, there is provided the impact tool, wherein the motor is covered with the housing, and wherein the brake portion is held by the housing.

According to Item 1, the anvil and the hammer are formed so that the protruding portions of the anvil and the hammer can rotate relatively at a maximum rotation angle of 60 degrees or more, and less than 360 degrees, and the hammer is adapted so as not to continuously rotate relative to the anvil. Thus, there is no need for providing a cam mechanism a mechanism which retreats axially, a spring, etc, which have conventionally been used in the impact tool, and a compact striking mechanism in which an axial front-rear length is made short can be realized. Since the hammer and the anvil are not continuously rotated relative to each other, continuous driving can be performed by the drill mode, and an impact tool operable in both of the drill mode and the impact mode can be realized.

According to Item 2, since the speed-reduction mechanism is a planetary gear mechanism, an output shaft of the motor is connected to a sun gear of the planetary gear mechanism, and the hammer is fixed so as to connect rotary shafts of plural planetary gears of the planetary gear mechanism, the number of parts can be reduced, and the axial front-rear length required by the hammer portion can be shortened.

Since the output shaft of the speed-reduction mechanism and the hammer are integrally formed, the striking mechanism can be compactly constructed.

According to Item 3, since the hammer and the spindle are manufactured with a metallic integral construction, respectively, a sturdy striking mechanism can be realized. Since the hammer and the spindle have comparatively simple shapes, the manufacturing cost can be reduced.

According to Item 4, since the hammer is intermittently struck on the anvil by rotating the motor in the normal direction and in the reverse direction, an impact tool can be realized simply by devising a motor driving method.

According to Item 5, since the hammer and the anvil are provided with two blade portions which extend radially outward from the main body portion, and the protruding portions are formed in the blade portions, the protruding portions can be easily formed by integral molding. Since the diameter of the main body portion can be made small by providing the blade portions, the weight of the hammer and the anvil can be reduced.

According to Item 6, each of the blade portions is formed with two protruding portions having striking-side surfaces, plural striking-side surfaces formed in the protruding portions of the hammer simultaneously collide with plural striking-side surfaces formed in the protruding portions of the anvil. Thus, if the plural striking-side surfaces are arranged at axisymmetrical positions, the variation of striking torque decreases, the vibration or reaction to be transmitted to the impact tool during striking decreases, and an easily-usable impact tool can be realized.

According to Item 7, since the striking portions of the anvil and the hammer turn relatively at a maximum rotation angle of 180 degrees or more, and less than 360 degrees, a sufficient reversal angle of the motor can be secured together with the reduction ratio in the speed-reduction mechanism, and striking can be performed with strong torque.

According to Item 8, since the impact mechanism is realized by the two striking mechanisms, and intermittent driving of the normal rotation and reverse rotation of the motor, a simple and low-cost impact tool can be realized.

According to Item 9, since the striking mechanism includes a hammer having a striking-side surface and an anvil having a struck-side surface, and the anvil is manufactured with a metallic integral construction, an impact tool with excellent strength and high durability can be realized.

According to Item 10, since the motor and the hammer are connected together via a planetary gear speed-reduction mechanism, and the hammer also functions as a planetary carrier which holds plural planetary gears of the planetary gear speed-reduction mechanism, the number of parts can be reduced.

According to Item 11, since the hammer has relative rotation of 180 degrees or more, as run-up rotation (acceleration section) before the hammer strikes the anvil, the anvil can be more efficiently struck by the hammer.

According to Item 12, since the hammer is almost immovable axially with respect to the anvil, axial striking power is not given to the tip tool, and even if a wood screw, etc. may be fastened into timber, the head of the screw can be prevented from being damaged. Further, a gutter is hardly generated in the anvil.

According to Item 13, since the acceleration period of the hammer is sufficiently secured to about 360 degrees as run-up rotation (acceleration section) before the hammer strikes the anvil, the anvil can be more efficiently struck by the hammer.

According to Item 14, since two protrusions of the anvil are struck by two protrusions of the hammer, striking power can be efficiently transmitted to the anvil from the hammer in a well-balanced manner.

According to Item 15 (Point 1), since the anvil is provided in front of the hammer, a compact impact tool can be realized. Further, since the hammer can be rotated so that a rotation angle of the hammer is substantially proportional to a rotation angle of the motor, the rotation angle of the hammer can be arbitrarily controlled by controlling the rotation angle of the motor.

According to Item 16, since the hammer is provided with a first protruding portion which protrudes forward from the hammer, and the anvil is provided with a second protruding portion which extends radially further than the rotary shaft, the size (or external diameter) of the hammer and the anvil can be made small, and a compact impact tool can be realized.

According to Item 17 (Point 2), since the rotary shafts of the plural planetary gears are fixed by the hammer, one component of the speed-reduction mechanism and the hammer can be manufactured integrally, and the number of parts and the manufacturing cost can be reduced. Since a spring, a spindle which has a cam groove, and balls inserted into the cam groove are not used unlike the conventional impact mechanism, manufacture and assembly become easy.

According to Item 18, since the hammer is driven in pulses by the motor, the striking effect can be realized on the anvil utilizing the torque fluctuation of motor output.

According to Item 19 (Point 3), since an impact tool includes the hammer driven in pulses by the motor, and the anvil struck by the hammer in a rotation direction, the striking power struck by the hammer is transmitted to the tip tool holding portion without loss.

According to Item 20 (Point 4), since the cylindrical portion which is smaller than the external diameter of the hammer is provided at a rear portion of the hammer, and the bearing which rotatably holds the hammer is provided at the cylindrical portion which is smaller than the external diameter of the hammer, the external diameter of the housing can be made small. Supposing the external diameter of the hammer is held by the housing, the hammer inclines inside the housing, and consequently, the loss of energy by the hammer becomes large. However, according to Item 20, incline of the hammer inside the housing can be reduced, and the energy loss of the hammer can be made small.

According to Item 21 (Point 5), since the hammer and the cylindrical portion are integrally formed, the torque can be directly transmitted from the cylindrical portion directly to the hammer, without loss caused by a spring, balls, etc.

According to Item 22, since an impact tool includes the hammer driven in pulses by the motor, the anvil struck by the hammer in a rotation direction, and the tip tool holding portion provided at the anvil, striking can be transmitted to the tip tool holding portion without loss after the anvil is struck by the hammer which is driven in pulses.

According to Item 23, since the speed-reduction mechanism is provided between the motor and the hammer, the great torque for rotating the hammer can be obtained by the speed-reduction mechanism.

According to Item 24 (Point 6), an impact tool includes the hammer driven in pulses by the motor and the anvil provided coaxially with the hammer and struck by the hammer in a rotation direction. Since the hammer and the anvil are coaxially provided, an impact tool having the compact radial size can be realized.

According to Item 25 (Point 7), since the fitting groove is provided at a rear portion of the anvil, and the fitting shaft which fits into the fitting groove is provided at a front portion of the hammer, the anvil is rotatably supported from rear by the hammer. Therefore, the anvil is prevented from inclining, and energy loss can be made small.

According to Item 26 (Point 8), in the impact tool which rotates the hammer in the normal direction and in the reverse direction to rotate the anvil in the normal direction, the hammer is rotated in the normal direction after the hammer is rotated in the reverse direction and is made to collide with the anvil. An impact tool with a simple construction can be realized. Since the hammer is rotated in the normal direction after colliding with the anvil (reverse rotation striking) when the hammer is reversely rotated, switching to the normal rotation from the reverse rotation can be reliably performed. Since this braking operation in the reverse rotation direction is realized by making the hammer collide with the anvil, supply of a current of the motor for the braking operation is eliminated or significantly reduced. Thus, the power consumption of the motor can be reduced.

According to Item 27 (Point 9), since the protruding portions of at least one of the anvil and the hammer have striking-side surfaces which collide with each other, and the hammer is rotated in the normal direction while striking the hammer and the anvil alternately in both directions by rotating the motor in the normal direction and in the reverse direction, an impact tool can be simply realized by devising a motor driving method.

According to Item 28 (Point 10), since striking portions of the anvil and the hammer turn relatively at a rotation angle of 180 degrees or more, and less than 360 degrees, there is no need for constructing the hammer so as to be axially movable, an impact mechanism can be manufactured at low cost, and a cheap impact tool can be realized.

According to Item 29 (Point 11), as for the rotation number of the motor when the hammer strikes the anvil, the rotation number during reverse rotation striking is lower than that during normal rotation striking. Thus, a fastening-subject member is prevented from being loosened due to reverse rotation striking.

According to Item 30 (Point 12), since the rotation number of the motor during normal rotation striking is twice or more the rotation number during reverse rotation striking, the impact operation can be efficiently performed, without loosening of a fastening-subject member.

According to Item 31 (Point 13), as for the striking torque of the motor when the hammer strikes the anvil, the striking torque during reverse rotation striking is lower than that during normal rotation striking. Thus, the impact operation can be efficiently performed, without loosening of a fastening-subject member.

According to Item 32 (Point 14), as for the lead angle of the anvil when the hammer strikes the anvil, the lead angle during reverse rotation striking is lower than that during normal rotation striking. Thus, the impact operation can be efficiently performed, without loosening of a fastening-subject member.

According to Item 33 (Point 15), since a control unit is provided to control rotation of the motor, the rotation direction and rotating speed of the motor are finely controlled, and the hammer strikes the anvil not only in the normal rotation direction but in the reverse rotation direction, the desired impact operation can be performed by using the control unit.

According to Item 34 (Point 16), since the motor is a brushless DC motor driven using a rotational position detecting element, and the rotation number of the motor is calculated using an output signal of the rotational position detecting element, the rotating speed of the motor can be easily measured by using the existing elements, and it is not necessary to measure the rotating speed of the hammer separately. For this reason, increase of components can be prevented, and cost for the impact tool can be reduced.

According to Item 35, in the impact tool which rotates the hammer in the normal direction and in the reverse direction, a brake mechanism which stops the rotation of the hammer is provided. Thus, when the hammer is reversely rotated, switching to the normal rotation from the reverse rotation can be rapidly and reliably performed. Since the position where reverse rotation stops can be set so as to become the same each time, an accurate impact operation can be executed. Further, since electricity is not consumed in the case of the braking operation, consumption of the battery and generation of heat by the motor can be suppressed.

According to Item 36, since striking portions of the anvil and the hammer rock relatively at a rotation angle of less than 360 degrees, there is no need for constructing the hammer so as to be axially movable, an impact mechanism can be manufactured at low cost, and an impact tool can be provided cheaply.

According to Item 37, since the brake mechanism is axially arranged between the hammer and the speed-reduction mechanism, mechanical loss is small, and a compact impact tool can be realized.

According to Item 38, since the brake mechanism includes a gear mechanism capable of rotating by given rotation of less than one rotation relative to the hammer, and a pawl which limits movement of the gear mechanism in a given direction, a user-friendly impact tool which limits only rotation in a specific direction and does not limit rotation in the opposite direction can be realized.

According to Item 39, since the pawl has a first pawl which limits rotation of the gear mechanism in a normal rotation direction, and a second pawl which limits rotation of the gear mechanism in a reverse rotation direction, and the brake mechanism has a switch for operating either the first pawl or the second pawl, a braking direction can be switched, and a brake mechanism acting only during reverse rotation can be realized.

According to Item 40, since the switch operates in conjunction with a normal/reverse switching lever which switches the rotation direction of the motor, the malfunction of the brake mechanism can be prevented and a reliable impact tool can be realized. Therefore, the number of parts of the impact tool can be reduced, and the manufacturing cost can be suppressed.

According to Item 41, since the gear mechanism is a sprocket formed with a gear portion and an intermittent ring, the brake mechanism can be realized by the simple mechanical elements.

According to Item 42, since a control unit is provided to control rotation of the motor, the rotation direction and rotating speed of the motor are finely controlled, and the hammer strikes the anvil not only in the normal rotation direction but in the reverse rotation direction, the desired impact operation can be realized by using the control unit.

According to Item 43, since a brake portion which stops or inhibits reverse rotation of the hammer is provided in the impact tool, when the hammer is reversely rotated, switching to the normal rotation from the reverse rotation can be rapidly and reliably performed. Since electricity is not consumed in the case of the braking operation, consumption of the battery can be suppressed.

According to Item 44, since the brake portion is held by the housing, the force to be given to the brake portion by the hammer can be received by the housing. For this reason, since the force during braking is not applied to the motor side, the load to the motor can be made small.

The above and other objects and new features of the invention will be apparent from the following description of the specification and the drawings.

DESCRIPTION OF EMBODIMENTS

[First Embodiment]

Hereinafter, embodiments will be described with reference to the drawings. In the following description, the directions of up and down, front and rear, and right and left correspond to the directions shown in FIGS. 1 and 2.

Figure 1:
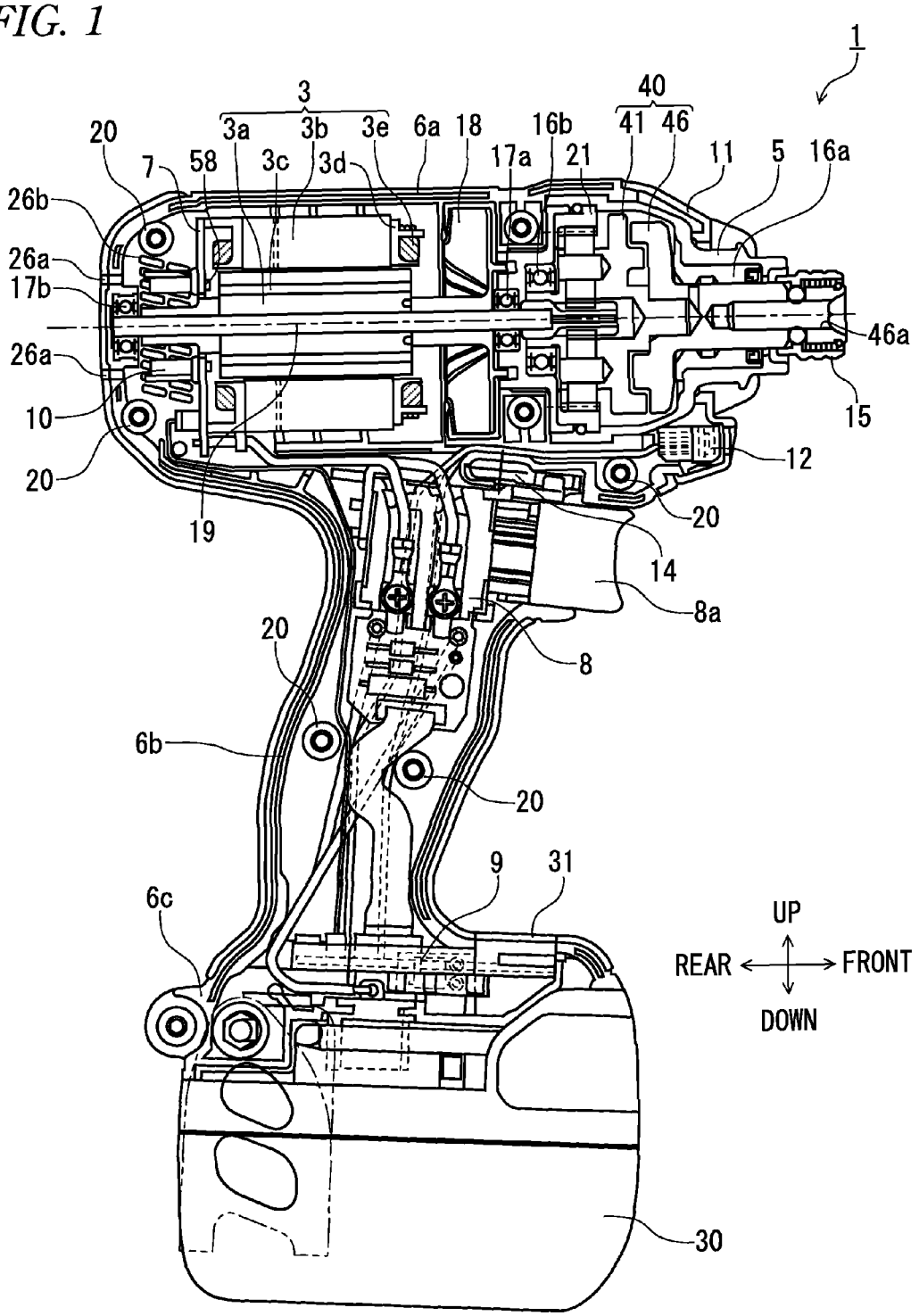
FIG. 1 cross-sectionally illustrates an impact tool 1 according to a first embodiment.

FIG. 1 illustrates an impact tool 1 according to a first embodiment. The impact tool 1 drives the striking mechanism 40 with a chargeable battery pack 30 as a power source and a motor 3 as a driving source, and gives rotation and striking to the anvil 46 as an output shaft to transmit continuous torque or intermittent striking power to a tip tool (not shown), such as a driver bit, thereby performing an operation, such as screwing or bolting.

The motor 3 is a brushless DC motor, and is accommodated in a tubular trunk portion 6*a* of a housing 6 which has a substantial T-shape as seen from the side. The housing 6 is splittable into two substantially-symmetrical right and left members, and the right and left members are fixed by plural screws. For example, one (the left member in the embodiment) of the right and left members of the housing 6 is formed with plural screw bosses 20 for reinforcing the screws, and the other (the right member in the embodiment) is formed with plural screw holes (not shown). In the trunk portion 6*a*, the rotary shaft 19 of the motor 3 is rotatably held by bearings 17*b* at the rear end, and bearings 17*a* provided around the central portion. A board on which six switching elements 10 are loaded is provided at the rear of the motor 3, and the motor 3 is rotated by inverter-controlling these switching elements 10. A rotational position detecting element 58, such as a Hall element or a Hall IC, are loaded at the front of the board 7 to detect the position of the rotor 3*a*.

In the housing 6, a grip portion 6*b* extends almost perpendicularly and integrally from the trunk portion 6*a*. A trigger switch 8 and a normal/reverse switching lever 14 are provided at an upper portion in the grip portion 6*b*. A trigger operating portion 8*a* of the trigger switch 8 is urged by a spring (not shown) to protrude from the grip portion 6*b*. A control circuit board 9 for controlling the speed of the motor 3 through the trigger operating portion 8*a* is accommodated in a lower portion in the grip portion 6*b*. A battery holding portion 6*c* is formed in the lower portion of the grip portion 6*b*, and a battery pack 30 including plural nickel hydrogen or lithium ion battery cells is detachably mounted on the battery holding portion 6*c*.

A cooling fan 18 is attached to the rotary shaft 19 at the front of the motor 3 to synchronizedly rotate therewith. The cooling fan 18 sucks air through air inlets 26*a* and 26*b* provided at the rear of the trunk portion 6*a*. The sucked air is discharged outside the housing 6 from plural slits 26*c* (refer to FIG. 2) formed around the radial outer peripheral side of the cooling fan 18 in the trunk portion 6*a*.

The striking mechanism 40 according to the first embodiment includes the anvil 46 and the hammer 41. The hammer 41 is fixed so as to connect rotary shafts of plural planetary gears of the planetary gear speed-reduction mechanism 21. Unlike a conventional impact mechanism which is now widely used, the hammer 41 does not have a cam mechanism which has a spindle, a spring, a cam groove, balls, etc. The anvil 46 and the hammer 41 are connected with each other by a fitting shaft 41*a* and a fitting groove 46*f* formed around rotation centers thereof so that only less than one relative rotation can be performed therebetween. At a front end of the anvil 46, an output shaft portion to mount a tip tool (not shown) and a mounting hole 46*a* having a hexagonal cross-sectional shape in an axial direction are integrally formed. The rear side of the anvil 46 is connected to the fitting shaft 41*a* of the hammer 41, and is held around the axial center by a metal bearing 16*a* so as to be rotatable with respect to a case 5. The detailed shape of the anvil 46 and the hammer 41 will be described later.

The case 5 is integrally formed from metal for accommodating the striking mechanism 40 and the planetary gear speed-reduction mechanism 21, and is mounted on the front side of the housing 6. The outer peripheral side of the case 5 is covered with a cover 11 made of resin in order to prevent a heat transfer, and an impact absorption, etc. The tip of the anvil 46 includes a sleeve 15 and balls 24 for detachably attaching the tip tool. The sleeve 15 includes a spring 15*a*, a washer 15*b* and a retaining ring 15*c*.

When the trigger operating portion 8*a* is pulled and the motor 3 is started, the rotational speed of the motor 3 is reduced by the planetary gear speed-reduction mechanism 21, and the hammer 41 rotates at a rotation number with a given reduction ratio with respect to the rotation number of the motor 3. When the hammer 41 rotates, the torque thereof is transmitted to the anvil 46, and the anvil 46 starts rotation at the same speed as the hammer 41. When the force applied to the anvil 46 becomes large by a reaction force received from the tip tool side, a control unit detects an increase in fastening reaction force, and drives the hammer 41 continuously or intermittently while changing the driving mode of the hammer 41 before the rotation of the motor 3 is stopped (the motor 3 is locked).

Figure 2:
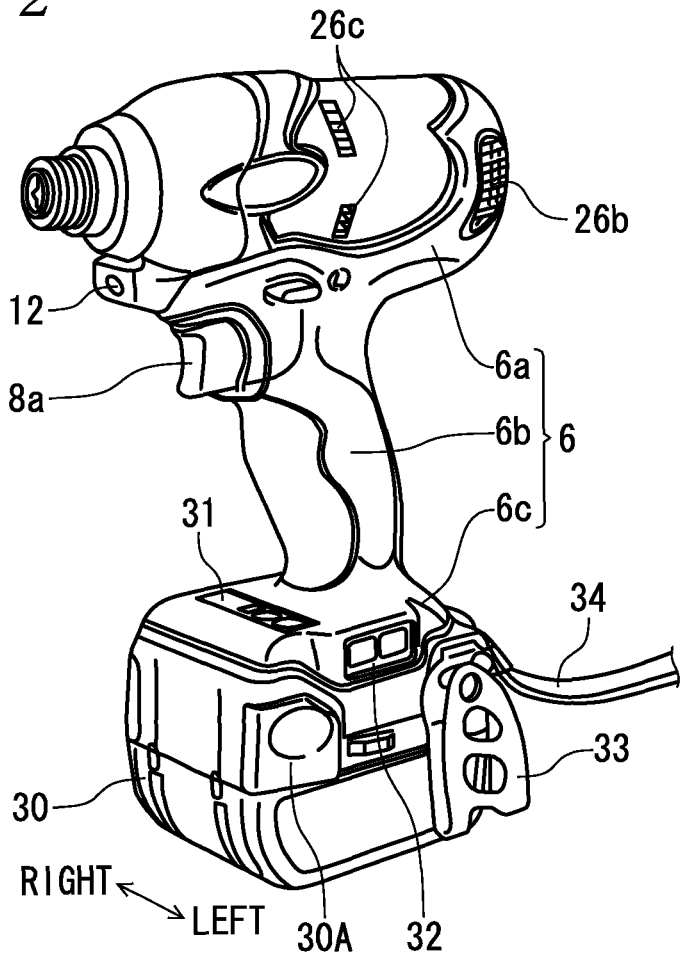
FIG. 2 illustrates an appearance of the impact tool 1 according to the first embodiment.

FIG. 2 illustrates the appearance of the impact tool 1 of FIG. 1. The housing 6 includes three portions 6*a*, 6*b*, and 6*c*, and slits 26*c* for discharge of cooling air is formed around the radial outer peripheral side of the cooling fan 18 in the trunk portion 6*a*. A control panel 31 is provided on the upper face of the battery holding portion 6*c*. Various operation buttons, indicating lamps, etc. are arranged at the control panel 31, for example, a switch for turning on/off an LED light 12, and a button for confirming the residual amount of the battery pack are arranged on the control panel 31. A toggle switch 32 for switching the driving mode (the drill mode and the impact mode) of the motor 3 is provided on a side face of the battery holding portion 6*c*, for example. Whenever the toggle switch 32 is depressed, the drill mode and the impact mode are alternately switched.

The battery pack 30 includes release buttons 30A located on both right and left sides thereof, and the battery pack 30 can be detached from the battery holding portion 6*c* by moving the battery pack 30 forward while pushing the release buttons 30A. A metallic belt hook 33 is detachably attached to one of the right and left sides of the battery holding portion 6*c*. Although the belt hook 33 is attached at the left side of the impact tool 1 in FIG. 2, the belt hook 33 can be detached therefrom and attached to the right side. A strap 34 is attached around a rear end of the battery holding portion 6*c*.

Figure 3:
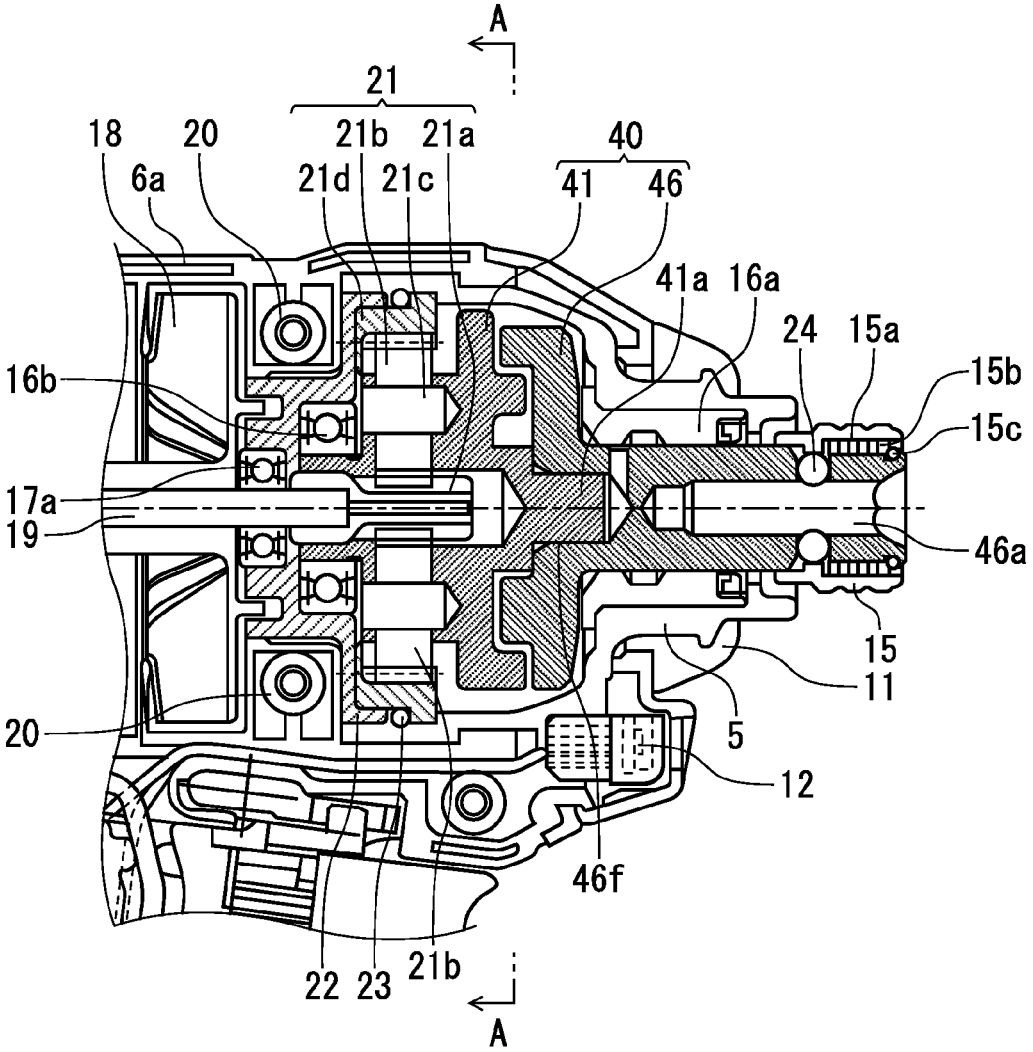
FIG. 3 enlargedly illustrates around a striking mechanism 40 of FIG. 1.

FIG. 3 enlargedly illustrates around a striking mechanism 40 of FIG. 1. The planetary gear speed-reduction mechanism 21 is a planetary type. A sun gear 21*a* connected to the tip of the rotary shaft 19 of the motor 3 functions as a driving shaft (input shaft), and plural planetary gears 21*b* rotate within an outer gear 21*d* fixed to the trunk portion 6*a*. Plural rotary shafts 21*c* of the planetary gears 21*b* is held by the hammer 41 as a planetary carrier. The hammer 41 rotates at a given reduction ratio in the same direction as the motor 3, as a driven shaft (output shaft) of the planetary gear speed-reduction mechanism 21. This reduction ratio is set based on factors, such as a fastening-subject member (a screw or a bolt) and the output of the motor 3 and the required fastening torque. In the embodiment, the reduction ratio is set so that the rotation number of the hammer 41 becomes about 1/8 to 1/15 of the rotation number of the motor 3.

An inner cover 22 is provided on the inner peripheral side of two screw bosses 20 inside the trunk portion 6*a*. The inner cover 22 is manufactured by integral molding of synthetic resin, such as plastic. A cylindrical portion is formed on the rear side of the inner cover, and bearings 17*a* which rotatably fix the rotary shaft 19 of the motor 3 are held by a cylindrical portion of the inner cover. A cylindrical stepped portion which has two different diameters is provided on the front side of the inner cover 22. Ball-type bearings 16*b* are provided at the stepped portion with a smaller diameter, and a portion of an outer gear 21*d* is inserted from the front side at the cylindrical stepped portion with a larger diameter. Since the outer gear 21*d* is non-rotatably attached to the inner cover 22, and the inner cover 22 is non-rotatably attached to the trunk portion 6*a* of the housing 6, the outer gear 21*d* is fixed in a non-rotating state. An outer peripheral portion of the outer gear 21*d* includes a flange portion with a largely formed external diameter, and an O ring 23 is provided between the flange portion and the inner cover 22. Grease (not shown) is applied to rotating portions of the hammer 41 and the anvil 46, and the O ring 23 performs sealing so that the grease does not leak into the inner cover 22 side.

In the first embodiment, a hammer 41 functions as a planetary carrier which holds the plural rotary shafts 21*c* of the planetary gear 21*b*. Therefore, the rear end of the hammer 41 extends to the inner peripheral side of the bearings 16*b*. The rear inner peripheral portion of the hammer 41 is arranged in a cylindrical inner space which accommodates the sun gear 21*a* attached to the rotary shaft 19 of the motor 3. A fitting shaft 41*a* which protrudes axially forward is formed around the front central axis of the hammer 41, and the fitting shaft 41*a* fits to a cylindrical fitting groove 46*f* formed around the rear central axis of the anvil 46. The fitting shaft 41*a* and the fitting groove 46*f* are journalled so that both are rotatable relative to each other.

Figure 4:
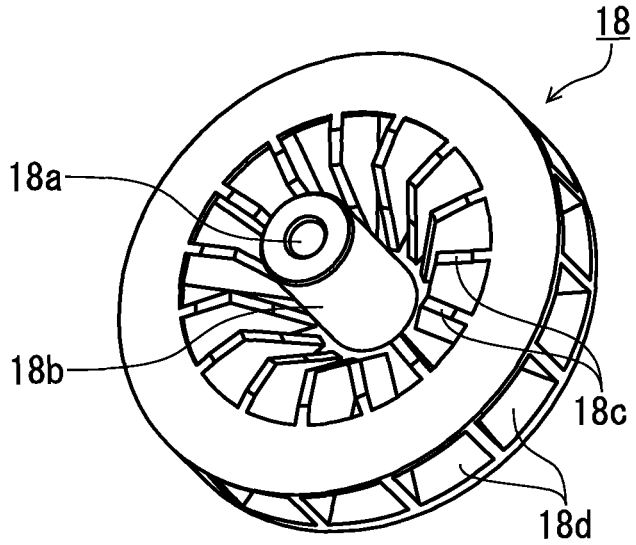
FIG. 4 illustrates a cooling fan 18 of FIG. 1.

FIG. 4 illustrates the cooling fan 18. The cooling fan 18 is manufactured by integral molding of synthetic resin, such as plastic. The rotation center of the cooling fan is formed with a through hole 18*a* which the rotary shaft 19 passes through, a cylindrical portion 18*b* which secures a given distance from a rotor 3*a* which covers the rotary shaft 19 by a given distance in the axial direction is formed, and plural fins 18*c* is formed on an outer peripheral side from the cylindrical portion 18*b*. The inner peripheral side of the fins 18*c* retreats to the rear side as it goes to the inner peripheral side, and is connected to a front wall, without coming into contact with the cylindrical portion 18*b*. An annular portion is provided on the front and rear sides of each fin 18*c*, and the air sucked from the axial rear side (not only the rotation direction of the cooling fan 18) is discharged outward in the circumferential direction from plural openings 18*d* formed around the outer periphery of the cooling fan. Since the cooling fan 18 exhibits the function of a so-called centrifugal fan, and is directly connected to the rotary shaft 19 of the motor 3 without going through the planetary gear speed-reduction mechanism 21, and rotates with a sufficiently larger rotation number than the hammer 41, sufficient air volume can be secured.

By using such a cooling fan 18, the air in the housing 6 can be effectively exhausted while utilizing the torque even if the motor 3 is rotated in both the normal/reverse directions as in the embodiment to perform impact operation. Thus, the switching element 10 and the motor 3 can be effectively cooled.

Figure 5:
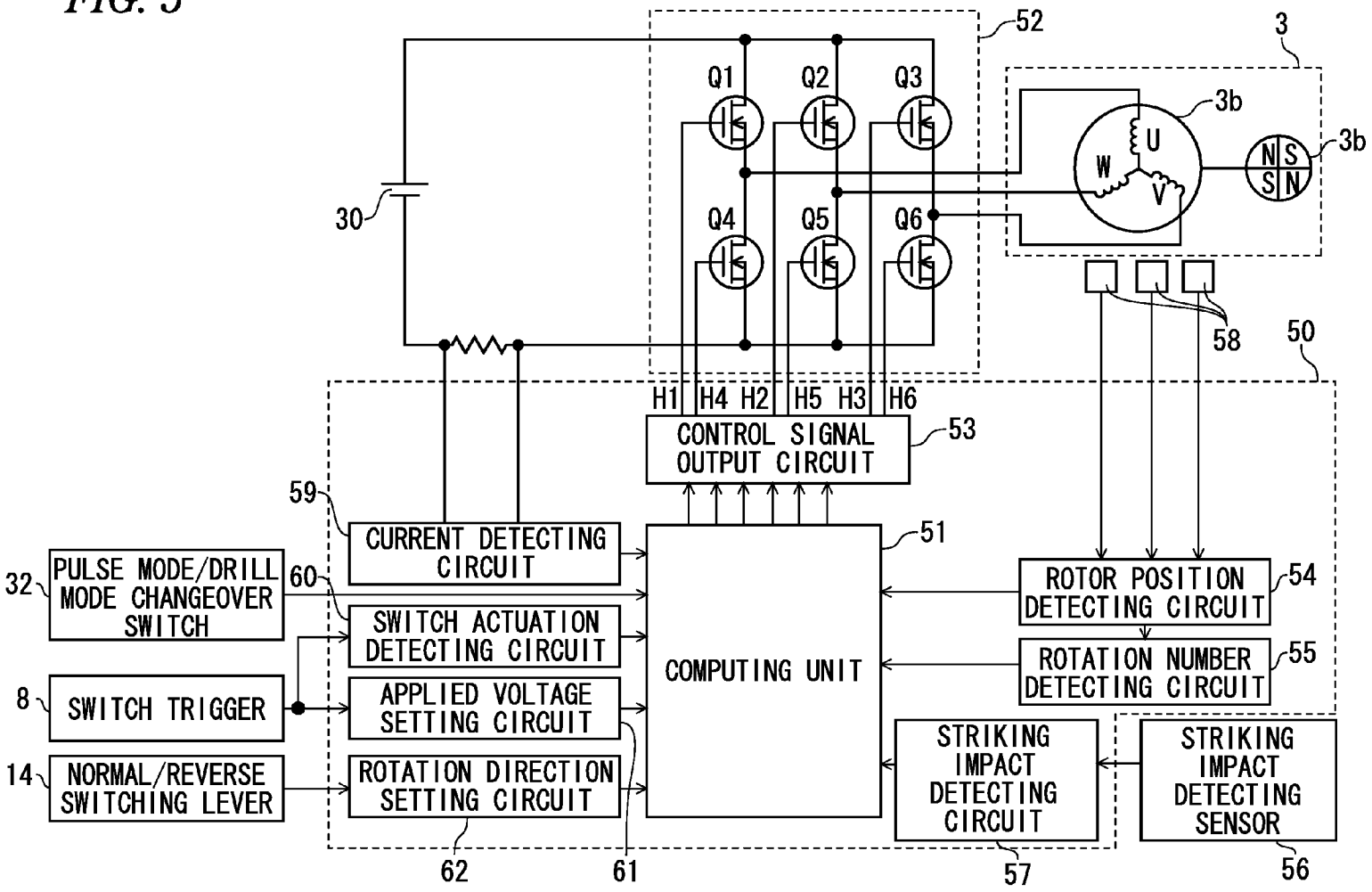
FIG. 5 illustrates a functional block diagram of a motor driving control system of the impact tool according to the first embodiment.

Next, the construction and operation of the motor driving control system will be described with reference to FIG. 5. FIG. 5 illustrates the motor driving control system. In the embodiment, the motor 3 includes a three-phase brushless DC motor. This brushless DC motor is a so-called inner rotor type, and has a rotor 3*a* including permanent magnets (magnets) including plural (two, in the embodiment) N-S poles sets, a stator 3*b* composed of three-phase stator windings U, V, and W which are wired as a stator, and three rotational position detecting elements (Hall elements) 58 arranged at given intervals, for example, at 60 degrees in the peripheral direction in order to detect the rotational position of the rotor 3*a*. Based on position detection signals from the rotational position detecting elements 58, the energizing direction and time to the stator windings U, V, and W are controlled, thereby rotating the motor 3. The rotational position detecting elements 58 are provided at positions which face the permanent magnets 3*c* of the rotor 3*a* on the board 7.

Electronic elements to be loaded on the board 7 include six switching elements Q1 to Q6, such as FET, which are connected as a three-phase bridge. Respective gates of the bridge-connected six switching elements Q1 to Q6 are connected to a control signal output circuit 53 loaded on the control circuit board 9, and respective drains/sources of the six switching elements Q1 to Q6 are connected to the stator windings U, V, and W which are wired as a stator. Thereby, the six switching elements Q1 to Q6 perform switching operations by switching element driving signals (driving signals, such as H4, H5, and H6) input from the control signal output circuit 53, and supplies electric power to the stator windings U, V, and W with the direct current voltage of the battery pack 30 to be applied to the inverter circuit 52 as three-phase voltages (U phase, V phase, and W phase) Vu, Vv, and Vw.

Among switching elements driving signals (three-phase signals which drive the respective signals of the six switching elements Q1 to Q6, driving signals for the three negative power supply side switching element Q4, Q5, and Q6 are supplied as pulse width modulation signals (PWM signals) H4, H5, and H6, and the pulse width (duty ratio) of the PWM signals is changed by the computing unit 51 loaded on the control circuit board 9 based on a detection signal of the operation amount (stroke) of the trigger operating portion 8*a* of the trigger switch 8, whereby the power supply amount to the motor 3 is adjusted, and the start/stop and rotating speed of the motor 3 are controlled.

PWM signals are supplied to either the positive power supply side switching elements Q1 to Q3 or the negative power supply side switching elements Q4 to Q6 of the inverter circuit 52, and the electric power to be supplied to stator windings U, V, and W from the direct current voltage of the battery pack 30 is controlled by switching the switching elements Q1 to Q3 or the switching elements Q4 to Q6 at high speed. In the embodiment, PWM signals are supplied to the negative power supply side switching elements Q4 to Q6. Therefore, the rotating speed of the motor 3 can be controlled by controlling the pulse width of the PWM signals, thereby adjusting the electric power to be supplied to each of the stator windings U, V, and W.

The impact tool 1 includes the normal/reverse switching lever 14 for switching the rotation direction of the motor 3. Whenever a rotation direction setting circuit 62 detects the change of the normal/reverse switching lever 14, the control signal to switch the rotation direction of the motor is transmitted to a computing unit 51. The computing unit 51 includes a central processing unit (CPU) for outputting a driving signal based on a processing program and data, a ROM for storing a processing program or control data, and a RAM for temporarily storing data, a timer, etc., although not shown.

The control signal output circuit 53 forms a driving signal for alternately switching predetermined switching elements Q1 to Q6 based on output signals of the rotation direction setting circuit 62 and a rotor position detecting circuit 54, and outputs the driving signal to the control signal output circuit 53. This alternately energizes a predetermined winding wire of the stator windings U, V, and W, and rotates the rotor 3*a* in a set rotation direction. In this case, driving signals to be applied to the negative power supply side switching elements Q4 to Q6 are output as PWM modulating signals based on an output control signal of an applied voltage setting circuit 61. The value of a current to be supplied to the motor 3 is measured by the current detecting circuit 59, and is adjusted into a set driving electric power as the value of the current is fed back to the computing unit 51. The PWM signals may be applied to the positive power supply side switching elements Q1 to Q3.

A striking impact sensor 56 which detects the magnitude of the impact generated in the anvil 46 is connected to the control unit 50 loaded on the control circuit board 9, and the output thereof is input to the computing unit 51 via the striking impact detecting circuit 57. The striking impact sensor 56 can be realized by a strain gauge, etc. attached to the anvil 46, and when fastening is completed with normal torque by using the output of the striking impact sensor 56, the motor 3 may be automatically stopped.

Figure 6:
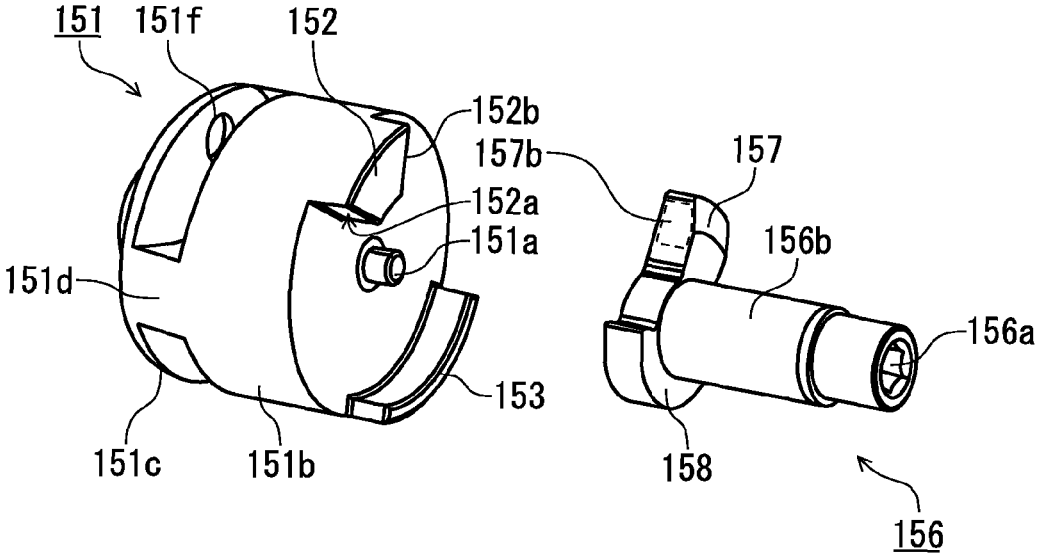
FIG. 6 illustrates a hammer 151 and an anvil 156 according to a basic construction.

Next, before the striking operation of the hammer 41 and the anvil 46 according to the first embodiment is described, the basic construction of the hammer and the anvil and the striking operation principle thereof will be described with reference to FIGS. 6 and 7. FIG. 6 illustrates the hammer 151 and the anvil 156 according to a basic construction. The hammer 151 is formed with a set of protruding portions, i.e., a protruding portion 152 and a protruding portion 153 which protrude axially from the cylindrical main body portion 151*b*. The front center of the main body portion 151*b* is formed with a fitting shaft 151*a* which fits to a fitting groove (not shown) formed at the rear of the anvil 156, and the hammer 151 and the anvil 156 are connected together so as to be rotatable relative to each other by a given angle of less than one rotation (less than 360 degrees). The protruding portion 152 acts as a striking pawl, and has planar striking-side surfaces 152*a* and 152*b* formed on both sides in a circumferential direction. The hammer 151 further includes a protruding portion 153 for maintaining rotation balance with the protruding portion 152. Since the protruding portion 153 functions as a weight portion for taking rotation balance, no striking-side surface is formed.

A disc portion 151*c* is formed on the rear side of the main body portion 151*b* via a connecting portion 151*d*. The space between the main body portion 151*b* and the disc portion 151*d* is provided to arrange the planetary gear 21*b* of the planetary gear mechanism 21, and the disc portion 151*d* is formed with a through hole 151*f* for holding the rotary shafts 21*c* of the planetary gear 21*b*. Although not shown, a holding hole for holding the rotary shafts 21*c* of the planetary gear 21*b* is formed also on the side of the main body portion 151*b* which faces disc portion 151*d*.

The anvil 156 is formed with a mounting hole 156*a* for mounting the tip tool on the front end side of the cylindrical main body portion 156*b*, and two protruding portions 157 and 158 which protrude radially outward from the main body portion 156*b* are formed on the rear side of the main body portion 156*b*. The protruding portion 157 is a striking pawl which has struck-side surfaces 157*a* and 157*b*, and is a weight portion in which a protruding portion 158 does not have a struck-side surface. Since the protruding portion 157 is adapted to collide with the protruding portion 152, the external diameter thereof is made equal to the external diameter of the protruding portion 152. Both the protruding portions 153 and 158 only acting as a weight are formed to not interfere with each other and not to collide with any part. In order to take the rotation angle between the hammer 151 and the anvil 156 as much as possible (less than one rotation at the maximum), the radial thicknesses of the protruding portions 153 and 158 are made small to increase a circumferential length so that the rotation balance between the protruding portions 152 and 157 is maintained. By setting the relative rotation angle greatly, a large acceleration section (run-up section) of the hammer when the hammer is made to collide with the anvil can be taken, and striking can be performed with considerable energy.

Figure 7:
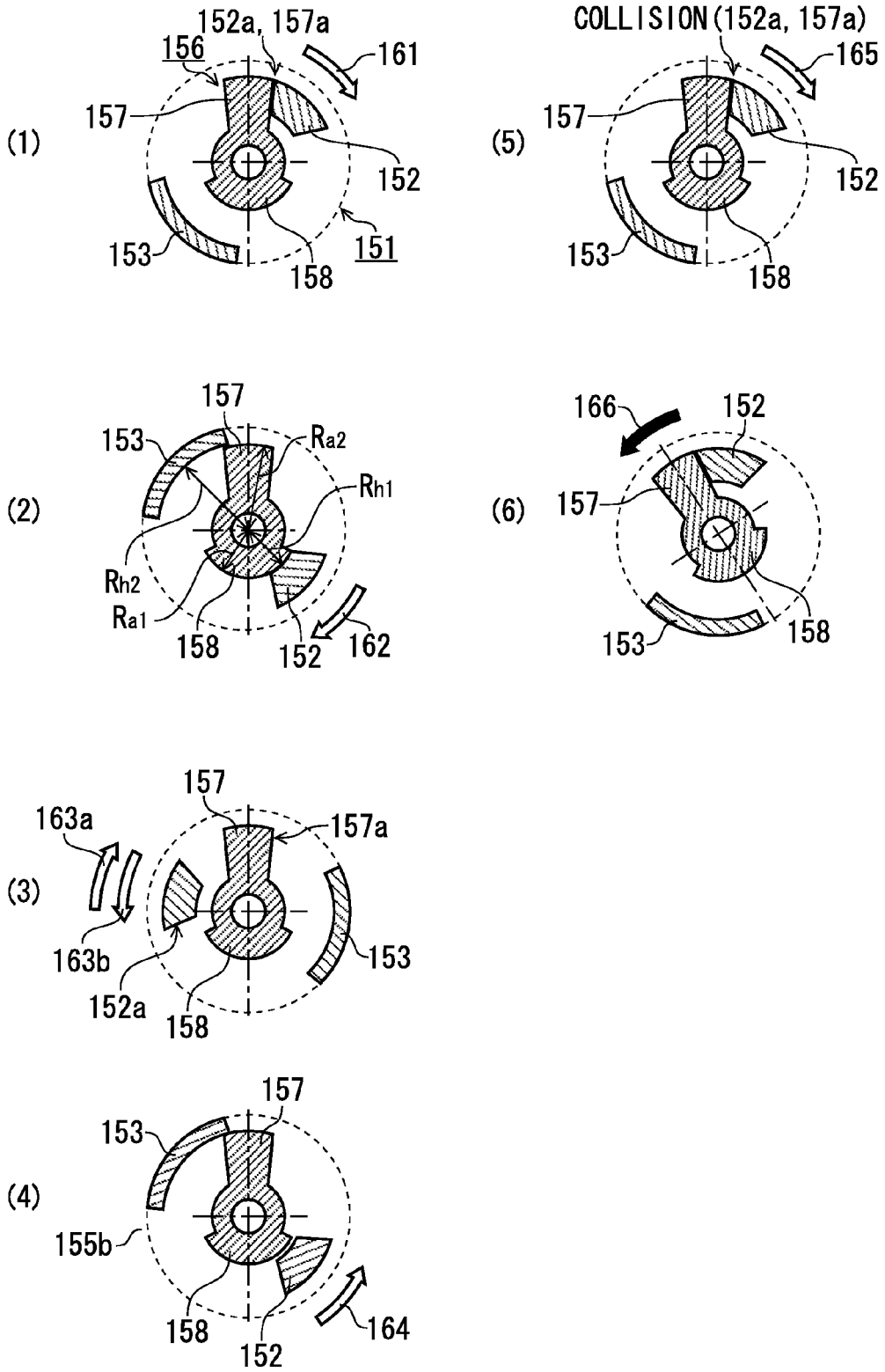
FIG. 7 illustrates the striking operation according to the first embodiment using the hammer 151 and the anvil 156 of FIG. 6, in six stages.

FIG. 7 illustrates one rotation movement in the usage state of the hammer 151 and the anvil 156 in six stages. The sectional plane of FIG. 7 is vertical to the axial direction, and includes a striking-side surface 152*a* (FIG. 6). In the state of FIG. 7(1), while fastening torque received from the tip tool is small, the anvil 156 rotates counterclockwise by being pushed from the hammer 151. However, when the fastening torque becomes large, and rotation becomes impossible only by the pushing force from the hammer 151, since the anvil 156 is struck by the hammer 151, the reverse rotation of the motor 3 is started in order to reversely rotate the hammer 151 in the direction of arrow 161. By starting the reverse rotation of the motor 3 in a state shown in (1), thereby rotating the protruding portion 152 of the hammer 151 in the direction of arrow 161, and further reversely rotate the motor 3, the protruding portion 152 rotates while being accelerated in the direction of arrow 162 through the outer peripheral side of the protruding portion 158 as shown in (2). Similarly, the external diameter $R_{a1}$ of the protruding portion 158 is made smaller than the internal diameter $R_{h1}$ of the protruding portion 152, and thus both the protruding portions do not collide with each other. The external diameter $R_{a2}$ of the protruding portion 157 is made smaller than the internal diameter $R_{h2}$ of the protruding portion 153, and thus both the protruding portions do not collide with each other. If the protruding portions are constructed in such positional relationship, the relative rotation angle of the hammer 151 and the anvil 156 can be made greater than 180 degrees, and the sufficient reverse rotation angle of the hammer 151 with respect to the anvil 156 can be secured.

When the hammer 151 further reversely rotates, and arrives at a position (stop position of the reverse rotation) of FIG. 7(3) as shown by arrow 163*a*, the rotation of the motor 3 is paused for a given time period, and then, the rotation of the motor 3 in the direction of arrow 163*b* (the normal rotation direction) is started. When the hammer 151 is reversely rotated, it is important to stop the hammer 151 reliably at a stop position so as not to collide with the anvil 156. Although the stop position of the hammer 151 before a position where the hammer collides with the anvil 156 is arbitrary set, it is desirable to make the stop position as large as possible according to the required fastening torque. It is not necessary to set the stop position to the same position each time, and the reverse rotation angle may be made small in an initial stage of fastening, and the reverse rotation angle may be set large as fastening proceeds. If the stop position is made variable in this way, since the time required for reverse rotation can be set to the minimum, striking operation can be rapidly performed in a short time.

Then, the hammer 151 is further accelerated while passing through the position of FIG. 7(4) in the direction of arrow 164, and the striking-side surface 152*a* of the protruding portion 152 collides with the struck-side surface 157*a* of the anvil 156 at a position shown in FIG. 7(5) in a state under acceleration. As a result of this collision, powerful rotation torque is transmitted to the anvil 156, and the anvil 156 rotates in the direction shown by arrow 166. The position of FIG. 7(6) is a state where both the hammer 151 and the anvil 156 have rotated at a given angle from the state of FIG. 7(1), and a fastening-subject member is fastened to a proper torque by repeating the operation from the state shown in FIG. 7(1) to FIG. 7(5) again.

As described above, an impact tool can be realized with the hammer 151 and the anvil 156 according to the basic construction serving as a striking mechanism by using a driving mode where the motor 3 is reversely rotated. In the striking mechanism of this construction, the motor can also be rotated in the drill mode by the setting of the driving mode of the motor 3. For example, in the drill mode, it is possible to rotate the hammer so as to follow the anvil 156 like FIG. 7(6) simply by rotating the motor 3 from the state of FIG. 7(5) to rotate the hammer 151 in a normal direction. Thus, by repeating this, fastening-subject members, such as screws or bolts, capable of making fastening torque small, can be fastened at high speed.

In the impact tool 1 according to the first embodiment, a brushless DC motor is used as the motor 3. Therefore, by calculating the value of a current which flows into the motor 3 from the current detecting circuit 59 (refer to FIG. 5), detecting a state where the value of the current has become larger than a given value, and making the computing unit 51 stop the motor 3, a so-called clutch mechanism in which power transmission is interrupted after fastening to a given torque can be electronically realized. Accordingly, in the impact tool 1 according to the first embodiment, the clutch mechanism during the drill mode can also be realized, and the multi-use fastening tool which has a drill mode with no clutch, a drill mode with a clutch, and an impact mode can be realized by the striking mechanism with a simple construction.

Figure 8:
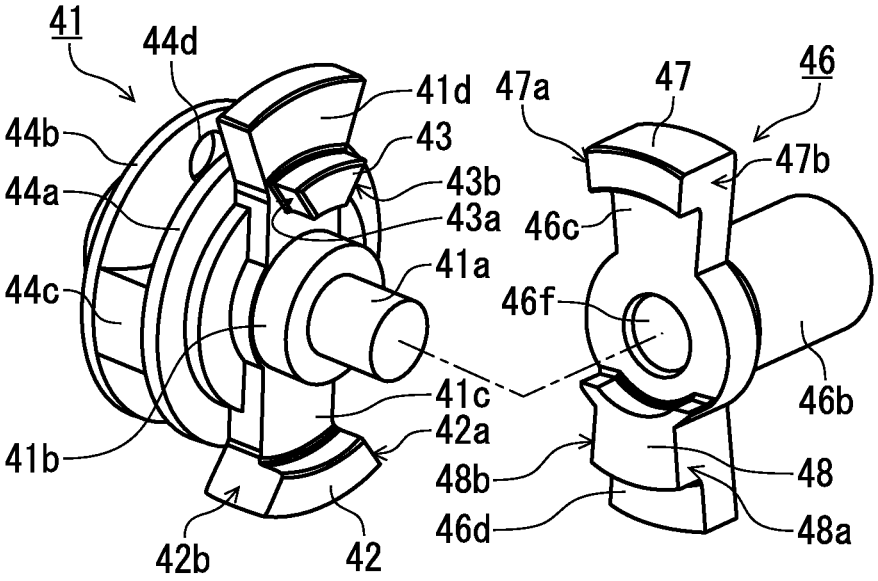
FIG. 8 illustrates the hammer 41 and the anvil 46 of FIG. 1.
Figure 9:
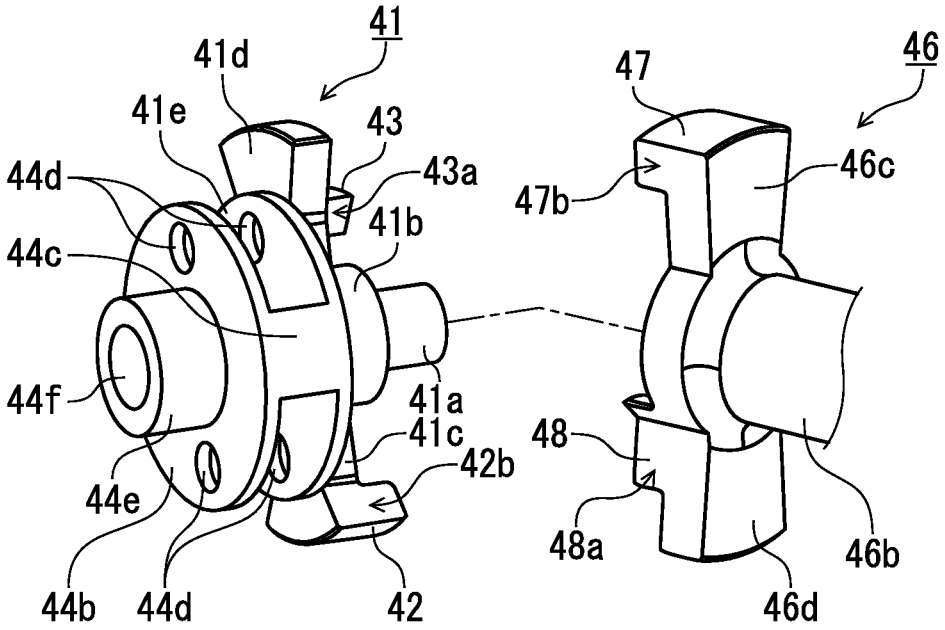
FIG. 9 illustrates a hammer 41 and an anvil 46 of FIG. 1 as viewed from a different angle.

Next, the detailed structure of the striking mechanism 40 shown in FIGS. 1 and 2 will be described with reference to FIGS. 8 and 9. FIG. 8 illustrates the hammer 41 and the anvil 46 according to the first embodiment, in which the hammer 41 is seen obliquely from the front, and the anvil 46 is seen obliquely from the rear. FIG. 9 illustrates the hammer 41 and the anvil 46, in which the hammer 41 is seen obliquely from the rear, and the anvil 46 is seen obliquely from the front. The hammer 41 is formed with two blade portions 41*c* and 41*d* which protrude radially from the cylindrical main body portion 41*b*. Although the blade portions 41*d* and 41*c* are respectively formed with the protruding portions which protrude axially, this construction is different from the basic construction shown in FIG. 6 in that a set of striking portions and a set of weight portions are formed in the blade portions 41*d* and 41*c*, respectively.

The outer peripheral portion of the blade portion 41*c* has the shape of a fan, and the protruding portion 42 protrudes axially forward from the outer peripheral portion. The fan-shaped portion and the protruding portion 42 function as both a striking portion (striking pawl) and a weight portion. The striking-side surfaces 42*a* and 42*b* are formed on both sides of the protruding portion 42 in a circumferential direction. Both the striking-side surfaces 42*a* and 42*b* are formed into flat surfaces, and a moderate angle is given so as to come into surface contact with a struck-side surface (which will be described later), of the anvil 46 well. Meanwhile, the blade portion 41*d* is formed to have a fan-shaped outer peripheral portion, and the mass of the fan-shaped portion increases due to the shape thereof. As a result, the blade portion acts well as a weight portion. Further, a protruding portion 43 which protrudes axially forward from around the radial center of the blade portion 41*d* is formed. The protruding portion 43 acts as a striking portion (striking pawl), and striking-side surfaces 43*a* and 43*b* are formed on both sides of the protruding portion in the circumferential direction. Both the striking-side surfaces 43*a* and 43*b* are formed into flat surfaces, and a moderate angle is given in the circumferential direction so as to come into surface contact with a struck-side surface (which will be described later), of the anvil 46 well.

The fitting shaft 41*a* to be fitted into the fitting groove 46*f* of the anvil 46 is formed on the front side around the axial center of the main body portion 41*b*. Connecting portions 44*c* which connect two disc portions 44*a* and 44*b* at two places in the circumferential direction so as to function as a planetary carrier are formed on the rear side of the main body portion 41*b*. Through holes 44*d* are respectively formed at two places of the disc portions 44*a* and 44*b* in the circumferential direction, two planetary gears 21*b* (refer to FIG. 3) are arranged between the disc portions 44*a* and 44*b*, and the rotary shafts 21*c* (refer to FIG. 3) of the planetary gear 21*b* are mounted on the through holes 44*d*. A cylindrical portion 44*e* which extends with a cylinder shape is formed on the rear side of the disc portion 44*b*. The outer peripheral side of the cylindrical portion 44*e* is held inside the bearings 16*b*. The sun gear 21*a* (refer to FIG. 3) is arranged in a space 44*f* inside the cylindrical portion 44*e*. It is preferable not only in strength but also in weight to manufacture the hammer 41 and the anvil 46 which are shown in FIGS. 8 and 9 as a metallic integral structure.

The anvil 46 is formed with two blade portions 46*c* and 46*d* which protrude radially from the cylindrical main body portion 46*b*. A protruding portion 47 which protrudes axially rearward is formed around the outer periphery of the blade portion 46*c*. Struck-side surfaces 47*a* and 47*b* are formed on both sides of the protruding portion 47 in the circumferential direction. Meanwhile, a protruding portion 48 which protrudes axially rearward is formed around the radial center of the blade portion 46*d*. Struck-side surfaces 48*a* and 48*b* are formed on both sides of the protruding portion 48 in the circumferential direction. When the hammer 41 normally rotates (a rotation direction in which a screw, etc. is fastened), the striking-side surface 42*a* abuts on the struck-side surface 47*a*, and simultaneously, the striking-side surface 43*a* abuts on the struck-side surface 48*a*. When the hammer 41 reversely rotates (a rotation direction in which a screw, etc. is loosened), the striking-side surface 42*b* abuts on the struck-side surface 47*b*, and simultaneously, the striking-side surface 43*b* abuts on the struck-side surface 48*b*. The protruding portions 42, 43, 47, and 48 are formed to simultaneously abut at two places.

As such, according to the hammer 41 and the anvil 46 which are shown in FIGS. 8 and 9, since striking is performed at two places which are symmetrical with respect to the rotating axial center, the balance during striking is good, and the impact tool 1 is hardly shaken during striking. Since striking-side surfaces are respectively provided on both sides of a protruding portion in the circumferential direction, impact operation becomes possible not only during normal rotation but also during reverse rotation, an impact tool which is easy to use can be realized. Since the hammer 41 strikes the anvil 46 only in the circumferential direction, and the hammer 41 does not strike the anvil 46 axially forward, the tip tool does not unnecessarily push a fastening-subject member, and there is an advantage when a wood screw, etc. is fastened into timber.

Figure 10:
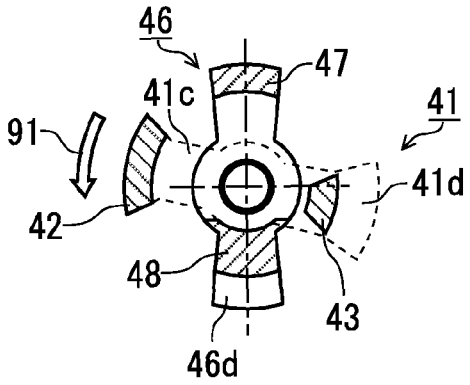
FIG. 10 illustrates the striking operation according to the first embodiment using the hammer 41 and the anvil 46 shown in FIGS. 8 and 9.
Figure 10:
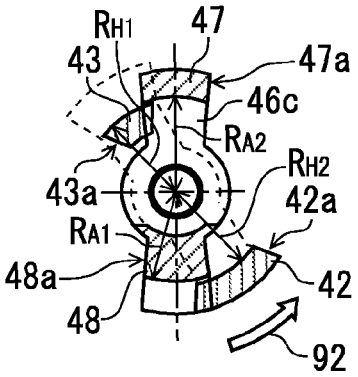
Figure 10:
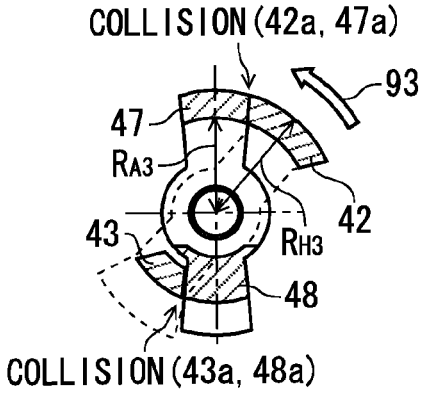
Figure 10:
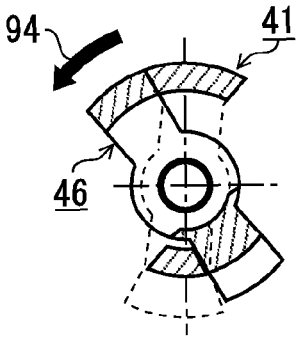

Next, the striking operation of the hammer 41 and the anvil 46 which are shown in FIGS. 8 and 9 will be described with reference to FIG. 10. The basic operation is the same as the operation described in FIG. 7, and the difference is that striking simultaneously performed in striking-side surfaces not at one place but at substantially-axisymmetric two places during striking. FIG. 10 illustrates a cross-section of a portion A-A of FIG. 3. FIG. 10 illustrates the positional relationship between the protruding portions 42 and 43 which protrude axially from the hammer 41, and the protruding portions 47 and 48 which protrude axially from the anvil 46. The rotation direction of the anvil 47 during the fastening operation (during normal rotation) is counter-clockwise.

FIG. 10(1) is in a state where the hammer 41 reversely rotates to the maximum reverse rotation position with respect to the anvil 46 (equivalent to the state of FIG. 7(3)). From this state, the hammer 41 is accelerated in the direction of arrow 91 (in the normal direction) to strike the anvil 46. Then, like FIG. 10(2), the protruding portion 42 passes through the outer peripheral side of the protruding portion 48, and simultaneously the protruding portion 43 passes through the inner peripheral side of the protruding portion 47. In order to allow passage of both the protruding portions, the internal diameter $R_{H2}$ of the protruding portion 42 is made greater than the external diameter $R_{A1}$ of the protruding portion 48, and thus the protruding portions do not collide with each other. Similarly, the external diameter $R_{H1}$ of the protruding portion 43 is made smaller than the internal diameter $R_{A2}$ of the protruding portion 47, and thus both the protruding portions do not collide with each other. According to such positional relationship, the relative rotation angle of the hammer 41 and the anvil 46 can be made larger more than 180 degrees, the sufficient reverse rotation angle of the hammer 41 to the anvil 46 can be secured, and this reverse rotation angle can be located in the accelerating section before the hammer 41 strikes the anvil 46.

Next, when the hammer 41 normally rotates to the state of FIG. 10(3), the striking-side surface 42*a* of the protruding portion 42 collides with the struck-side surface 47*a* of the protruding portion 47. Simultaneously, the striking-side surface 43*a* of the protruding portion 43 collides with the striking-side surface 48*a* of the protruding portion 48. By causing collision at two places opposite to a rotation axis in this way, the striking which is well-balanced with respect to the anvil 46 can be performed. As a result of this striking, as shown in FIG. 10(4), the anvil 46 rotates in the direction of arrow 94, and fastening of a fastening-subject member is performed by this rotation. The hammer 41 has the protruding portion 42 which is a solitary protrusion at a radial concentric position (a position above $R_{H2}$ and below $R_{H3}$), and has the protruding portion 43 which is a third solitary protrusion at a concentric position (position below $R_{H1}$). The anvil 46 has the protruding portion 47 which is a solitary protrusion at a radial concentric position (a position above $R_{A2}$ and below $R_{A3}$), and has the protruding portion 48 which is a solitary protrusion at a concentric position (position below $R_{A1}$).

Figure 11:
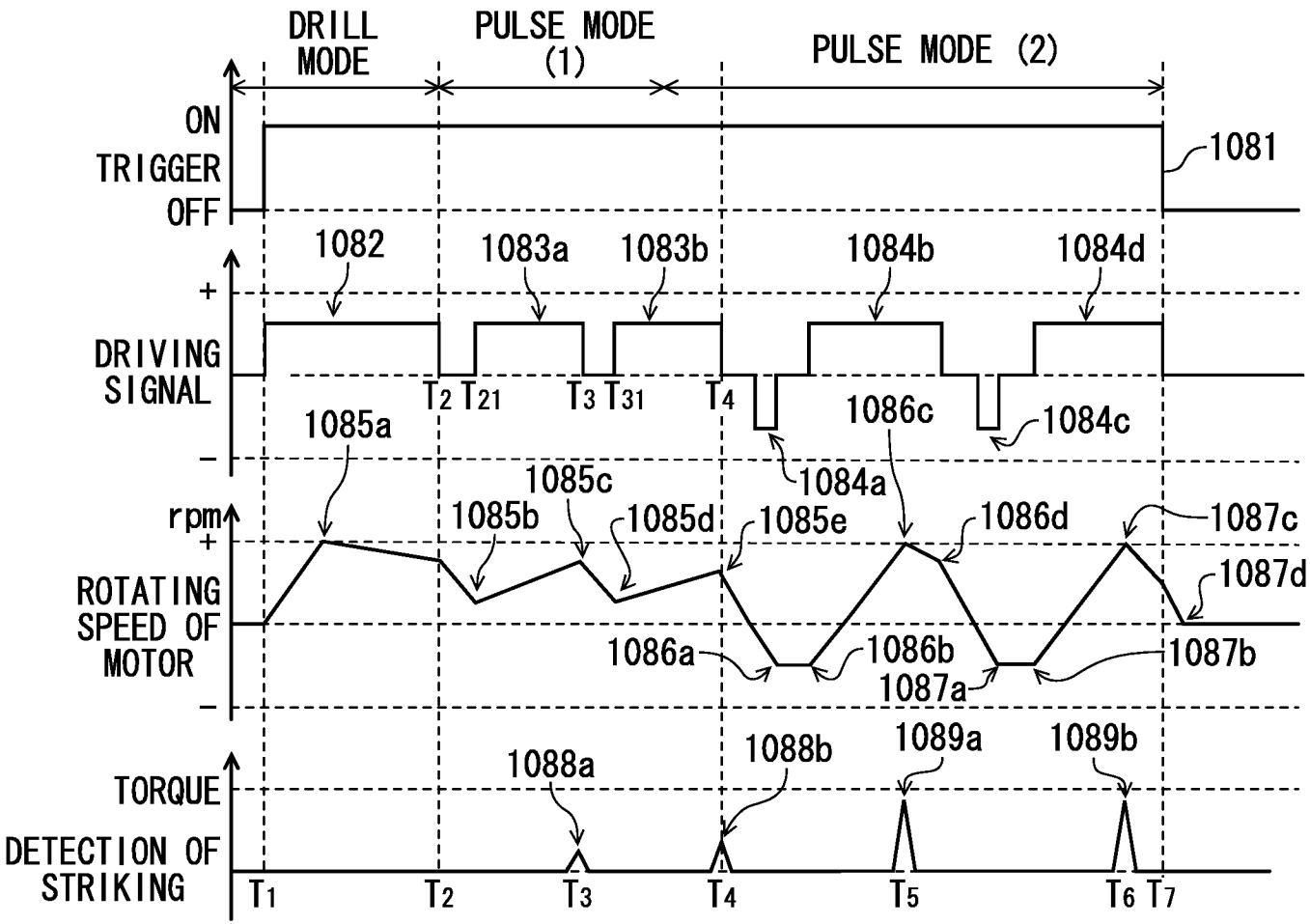
FIG. 11 illustrates a trigger signal during the operation of the impact tool 1, a driving signal of an inverter circuit, the rotating speed of the motor 3, and the striking state of the hammer 41 and the anvil 46.

Next, the driving method of the impact tool 1 according to the first embodiment will be described. In the impact tool 1 according to the first embodiment, the anvil 46 and the hammer 41 are formed so as to be relatively rotatable at a rotation angle of less than 360 degrees. Since the hammer 41 cannot perform rotation of more than one rotation relative to the anvil 46, the control of the rotation is also unique. FIG. 11 illustrates a trigger signal during the operation of the impact tool 1, a driving signal of an inverter circuit, the rotating speed of the motor 3, and the striking state of the hammer 41 and the anvil 46. The horizontal axis is time in the respective graphs (timings of the respective graphs are matched).

In the impact tool 1 according to the first embodiment, in the case of the fastening operation in the impact mode, fastening is first performed at high speed in the drill mode, fastening is performed by switching to the impact mode (1) if it is detected that the required fastening torque becomes large, and fastening is performed by switching to the impact mode (2) if the required fastening torque becomes still larger. In the drill mode from time $T_1$ to time $T_2$ of FIG. 11, the control unit 51 controls the motor 3 based on a target rotation number. For this reason, the motor is accelerated until the motor 3 reaches the target rotation number shown by arrow 1085*a*. Thereafter, the rotating speed of the motor 3 with a large fastening reaction force from the tip tool attached to the anvil 46 decreases gradually as shown by arrow 1085*b*. Thus, decrease of the rotation speed is detected by the value of a current to be supplied to the motor 3, and switching to the rotation driving mode by the pulse mode (1) is performed at time $T_2$.

The pulse mode (1) is a mode in which the motor 3 is not continuously driven but intermittently driven, and is driven in pulses so that "pause→normal rotation driving" is repeated multiple times. The expression "driven in pulses" means controlling driving so as to pulsate a gate signal to be applied to the inverter circuit 52, pulsate a driving current to be supplied to the motor 3, and thereby pulsate the rotation number or output torque of the motor 3. This pulsation is generated by repeating ON/OFF of a driving current with a large period (for example, about several tens of hertz to a hundred and several tens of hertz), such as ON (driving) of the driving current to be supplied to the motor from time $T_2$ to time $T_{21}$ (pause), ON (driving) of the driving current of the motor from time $T_{21}$ to time $T_3$, OFF (pause) of the driving current from time $T_3$ to time $T_{31}$, and ON of the driving current from time $T_{31}$ to time $T_4$. Although PWM control is performed for the control of the rotation number of the motor 3 in the ON state of the driving current, the period to be pulsated is sufficiently small compared with the period (usually several kilohertz) of duty ratio control.

In the example of FIG. 11, after supply of the driving current to the motor 3 for a given time period from $T_2$ is paused, and the rotating speed of the motor 3 decreases to arrow 1085*b*, the control unit 51 (refer to FIG. 5) sends a driving signal 1083*a* to the control signal output circuit 53, thereby supplying a pulsating driving current (driving pulse) to the motor 3 to accelerate the motor 3. This control during acceleration does not necessarily mean driving at a duty ratio of 100% but means control at a duty ratio of less than 100%. Next, striking power is given as shown by arrow 1088*a* as the hammer 41 collides with the anvil 46 strongly at arrow 1085*c*. When striking power is given, the supply of a driving current to the motor 3 for a given time period is paused, and the rotating speed of the motor decreases again as shown by arrow 1085*b*. Thereafter, the control unit 51 sends a driving signal 1083*b* to the control signal output circuit 53, thereby accelerating the motor 3. Then, striking power is given as shown by arrow 1088*b* as the hammer 41 collides with the anvil 46 strongly at arrow 1085*e*. In the pulse mode (1), the above-described intermittent driving of repeating "pause→normal rotation driving" of the motor 3 is repeated one time or multiple times. If it is detected that further higher fastening torque is required, switching to the rotation driving mode by the pulse mode (2) is performed. Whether or not further higher fastening torque is required can be determined using, for example, the rotation number (before or after arrow 1085*e*) of the motor 3 when the striking power shown by arrow 1088*b* is given.

Although the pulse mode (2) is a mode in which the motor 3 is intermittently driven, and is driven in pulses similarly to the pulse mode (1), the motor is driven so that "pause→reverse rotation driving→pause (stop)→normal rotation driving" is repeated plural times. That is, in the pulse mode (2), in order to add not only the normal rotation driving but also the reverse rotation driving of the motor 3, the hammer 41 is accelerated in the normal rotation direction so as to strongly collide with the anvil 46 after the hammer 41 is reversely rotated by a sufficient angular relation with respect to the anvil 46. By driving the hammer 41 in this way, strong fastening torque is generated in the anvil 46.

In the example of FIG. 11, when switching to the pulse mode (2) is performed at time $T_4$, driving of the motor 3 is temporarily paused, and then, the motor 3 is reversely rotated by sending a driving signal 1084*a* in a negative direction to the control signal output circuit 53. When normal rotation or reverse rotation is performed, this normal rotation or reverse rotation is realized by switching the signal pattern of each driving signal (ON/OFF signal) to be output to each of the switching elements Q1 to Q6 from the control signal output circuit 53. If the motor 3 is reversely rotated by a given rotation angle, driving of the motor 3 is temporarily paused to start normal rotation driving. For this reason, a driving signal 1084*b* in a positive direction is sent to the control signal output circuit 53. In the rotational driving using the inverter circuit 52, a driving signal is not switched to the plus side or minus side. However, a driving signal is classified into the + direction and – direction and is schematically expressed in FIG. 11 so that whether the motor is rotationally driven in any direction can be easily understood.

The hammer 41 collides with the anvil 46 at a time when the rotating speed of the motor 3 reaches a maximum speed (arrow 1086*c*). Due to this collision, significant large fastening torque 89*a* is generated compared to fastening torques (1088*a*, 1088*b*) to be generated in the pulse mode (1). When collision is performed in this way, the rotation number of the motor 3 decreases so as to reach arrow 1086*d* from arrow 1086*c*. In addition, the control of stopping a driving signal to the motor 3 at the moment when the collision shown by arrow 89*a* is detected may be performed. In that case, if a fastening-subject member is a bolt, a nut, etc., the recoil transmitted to the user's hand after striking is little. By applying a driving current to the motor 3 as in the first embodiment even after collision, the reaction force to the user is small as compared to the drill mode, and is suitable for the operation in a middle load state. Thus, the fastening speed can be increased, and power consumption can be reduced as compared to a strong pulse mode. Thereafter, similarly, fastening with strong fastening torque is performed by repeating "pause→reverse rotation driving→pause (stop)→normal rotation driving" by a given number of times, and the motor 3 is stopped to complete the fastening operation as the user releases a trigger operation at time $T_7$. In addition to the release of the trigger operation by the user, the motor 3 may be stopped when the computing unit 51 determines that fastening with set fastening torque is completed based on the output of the striking impact detecting sensor 56 (refer to FIG. 5).

As described above, in the first embodiment, rotational driving is performed in the drill mode in an initial stage of fastening where only small fastening torque is required, fastening is performed in the impact mode (1) by intermittent driving of only normal rotation as the fastening torque becomes large, and fastening is strongly performed in the impact mode (2) by intermittent driving by the normal rotation and reverse rotation of the motor 3, in the final stage of fastening. In addition, driving may be performed using the impact mode (1) and the impact mode (2). The control of proceeding directly to the impact mode (2) from the drill mode without providing the impact mode (1) is also possible. Since the normal rotation and reverse rotation of the motor are alternately performed in the impact mode (2), fastening speed becomes significantly slower than that in the drill mode or impact mode (1). When the fastening speed becomes abruptly slow in this way, the sense of discomfort when transiting to the striking operation becomes large compared to an impact tool which has a conventional rotation striking mechanism. Thus, in the shifting to the impact mode (2) from the drill mode, an operation feeling becomes a natural feeling by interposing the impact mode (1) therebetween. For example, by performing fastening in the drill mode or impact mode (1) as much as possible, fastening operation time can be shortened.

Figure 12:
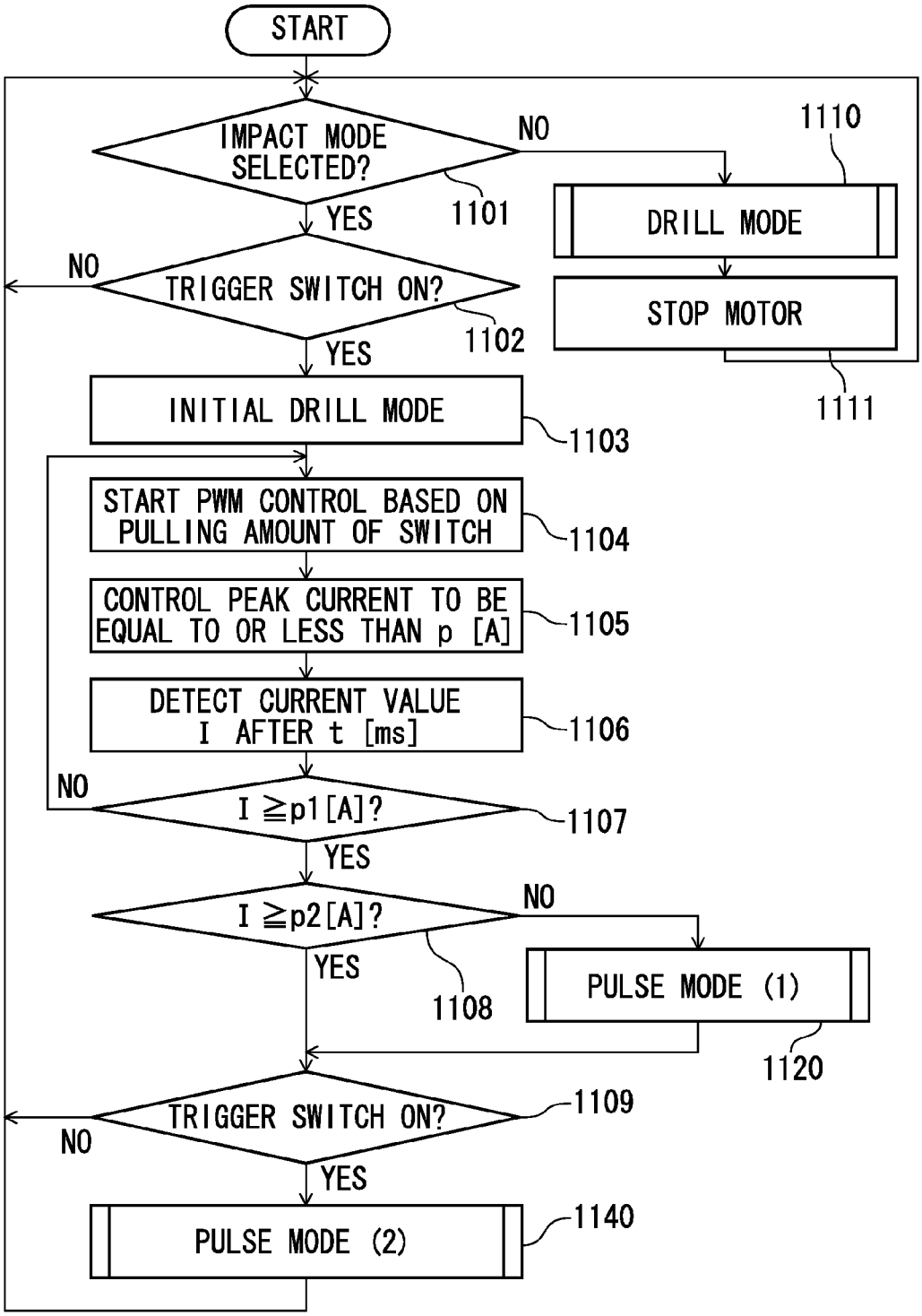
FIG. 12 illustrates a driving control procedure of the motor 3 according to the first embodiment.

Next, the control procedure of the impact tool 1 according to the first embodiment will be described with reference to FIG. 12 to FIG. 16. FIG. 12 illustrates the control procedure of the impact tool 1 according to the first embodiment. The impact tool 1 determines whether or not the impact mode is selected using the toggle switch 32 (refer to FIG. 2) prior to start of the operation by the user (Step 1101). If the impact mode is selected, the process proceeds to Step 1102, and if the impact mode is not selected, that is, in the case of a normal drill mode, the process proceeds to Step 1110.

In the impact mode, the computing unit 51 determines whether or not the trigger switch 8 is turned on. If the trigger switch is turned on (the trigger operating portion 8*a* is pulled), as shown in FIG. 11, the motor 3 is started by the drill mode (Step 1103), and the PWM control of the inverter circuit 52 is started according to the pulling amount of the trigger operating portion 8*a* (Step 1104). Then, the rotation of the motor 3 is accelerated while performing a control so that a peak current to be supplied to the motor 3 does not exceed an upper limit p. Next, the value I of a current to be supplied to the motor 3 after t milliseconds have elapsed after starting is detected using the output of the current detecting circuit 59 (refer to FIG. 5). If the detected current value I does not exceed p1 ampere, the process returns to Step 1104, and if the current value has exceeded p1 ampere, the process proceeds to Step 1108 (Step 1107). Next, it is determined whether or not the detected current value I exceeds p2 ampere (Step 1108).

Figure 14:
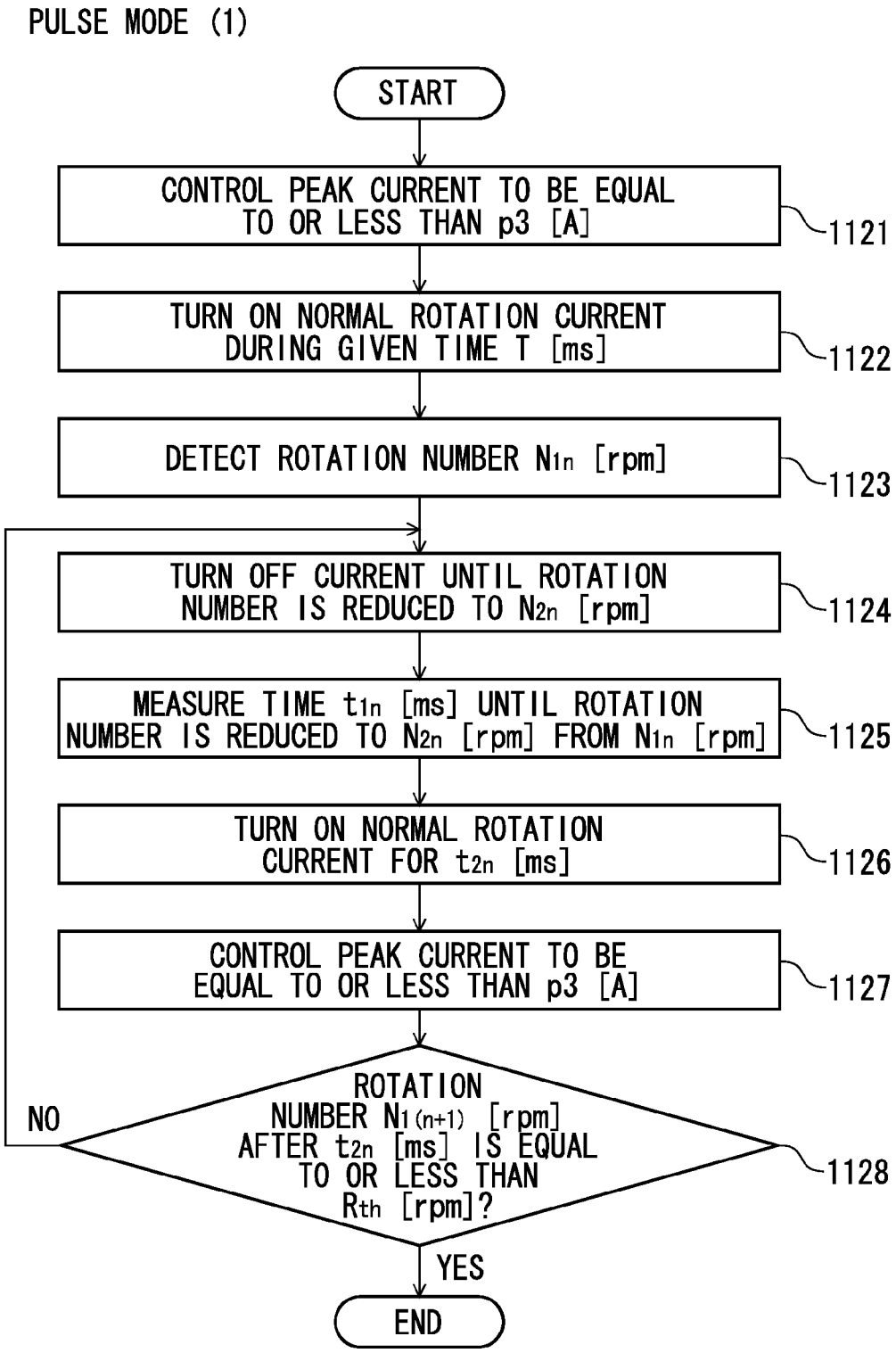
FIG. 14 illustrates the driving control procedure of the motor in a pulse mode (1) according to the first embodiment.
Figure 16:
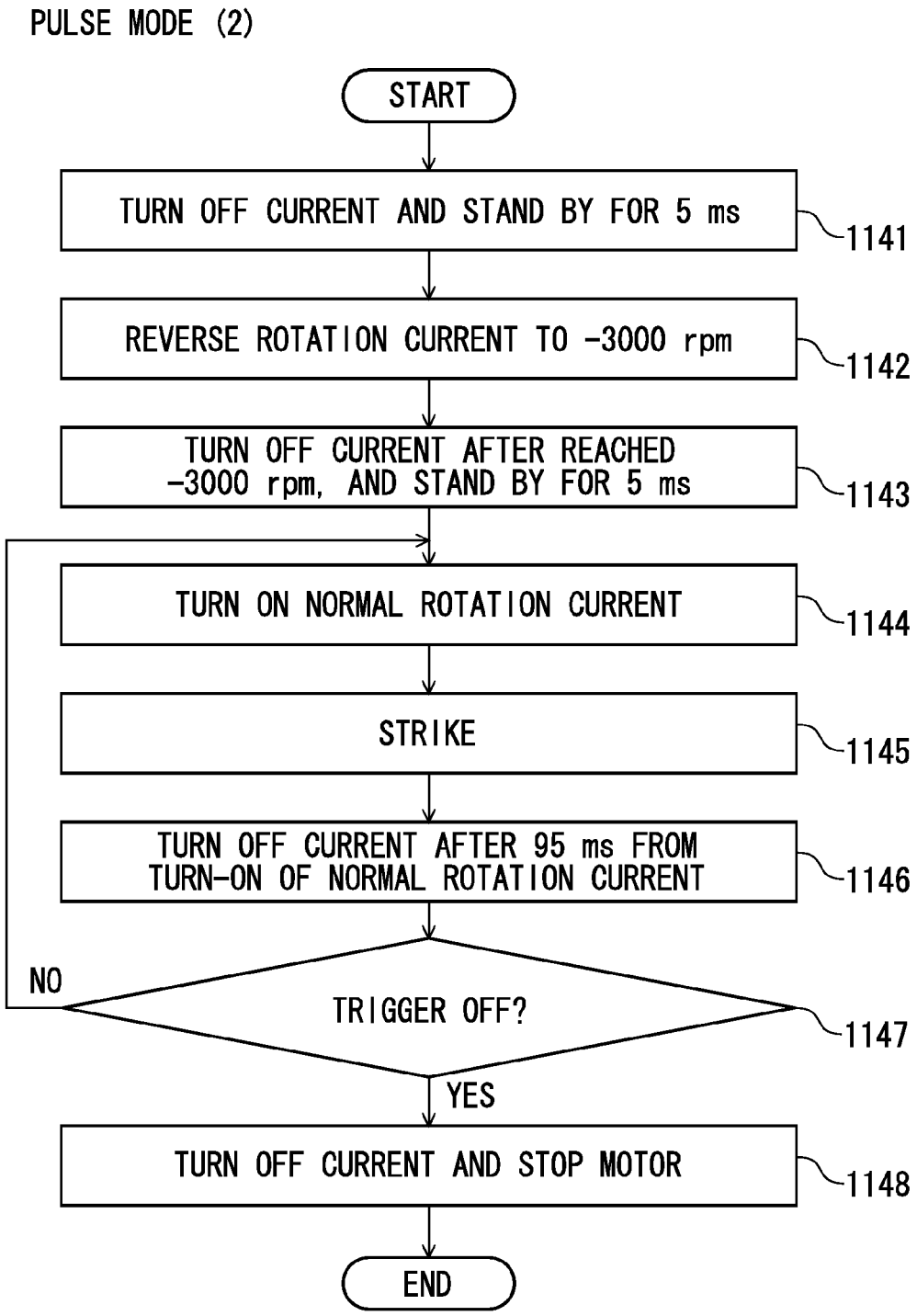
FIG. 16 illustrates the driving control procedure of the motor 3 in the pulse mode (2) according to the first embodiment.

If the detected current value I does not exceed p2 [A] in Step 1108, that is, if the relationship of p1<I<p2 is satisfied, the process proceeds to Step 1109 (Step 1120) after the procedure of the pulse mode (1) shown in FIG. 14 is executed. Then, if the detected current value I exceeds p2 [A], the process proceeds directly to Step 1109, without executing the procedure of the pulse mode (1). In Step 1109, it is determined whether or not the trigger switch 8 is set to ON. If the trigger switch is turned off, the processing returns to Step 1101. If the ON state is continued, the processing returns to Step 1101 after the procedure of the pulse mode (2) shown in FIG. 16 is executed.

If the drill mode is selected in Step 1101, the drill mode 1110 is executed, but the control of the drill mode is the same as the control of Steps 1102 to 1107. Then, by detecting a control current in an electronic clutch or an overcurrent state immediately before the motor 3 is locked as p1 of Step 1107, thereby stopping the motor 3 (Step 1111), the drill mode is ended, and the processing returns to Step 1101.

Figure 13:
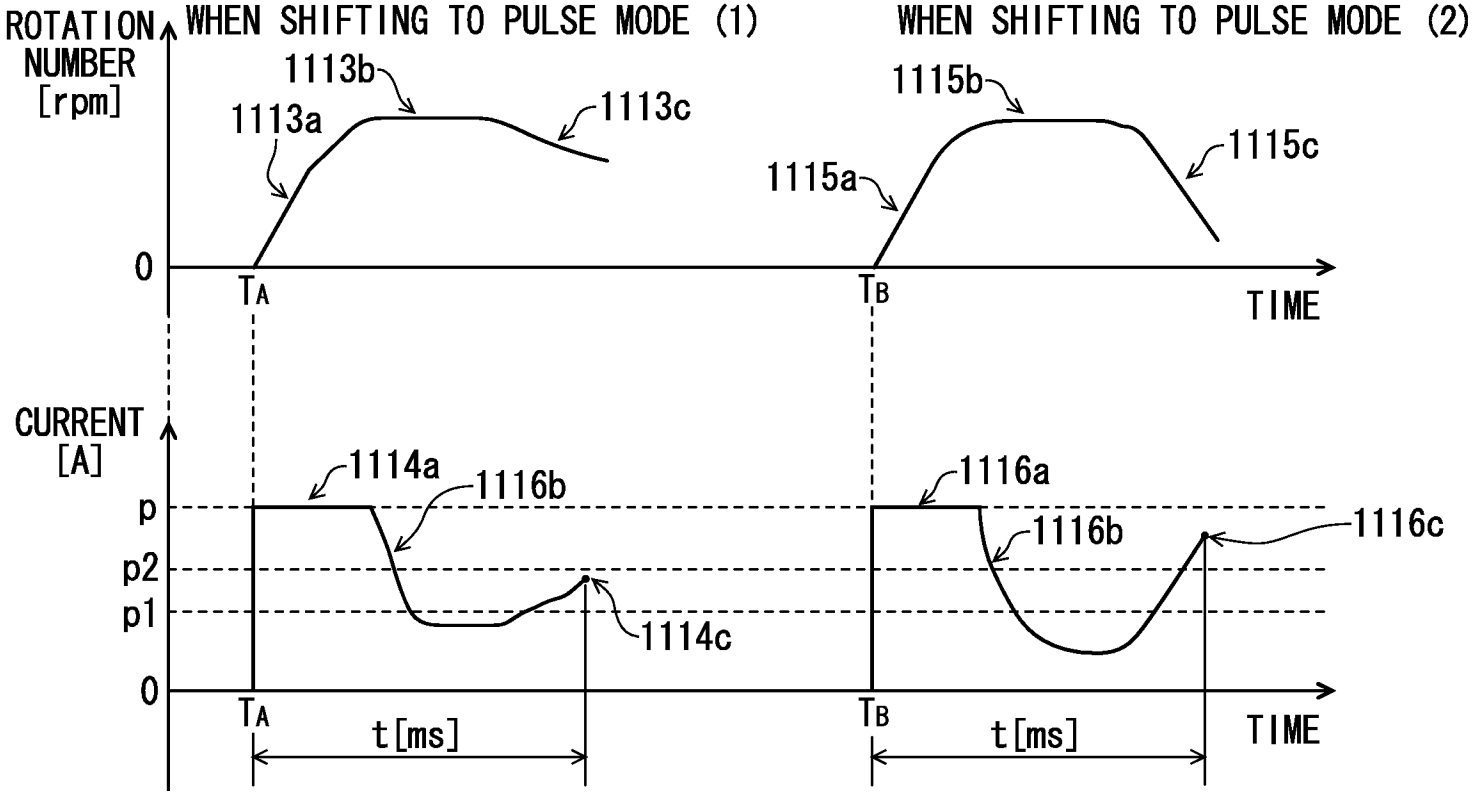
FIG. 13 illustrates a graph for explaining a driving mode of the hammer 41 in the first embodiment, in which a current to be applied to the motor and the rotation number are shown.

The determination procedure of the mode shifting in Steps 1107 and 1108 will be described with reference to FIG. 13. An upper graph shows the relationship between elapsed time and the rotation number of the motor 3, a lower graph shows the relationship between a current value to be supplied to the motor 3, and time, and the time axes of the upper and lower graphs are made the same. In the left graph, when the trigger switch is pulled at time $T_A$ (equivalent to Step 1102 of FIG. 12), the motor 3 is started and accelerated as shown by arrow 1113*a*. During this acceleration, a constant current control in a state where the maximum current value p is limited as shown by arrow 1114*a* is performed. When the rotation number of the motor 3 reaches a given rotation number (arrow 1113*b*), a current during acceleration becomes a usual current as shown by arrow 1114*b*. Therefore, the current value decreases. Thereafter, when the reaction force received from a fastening-subject member increases as fastening of a screw, a bolt, etc. proceeds, the rotation number of the motor 3 decreases gradually as shown by arrow 1113*c*, and the value of a current to be supplied to the motor 3 increases. Then, the current value is determined after t milliseconds have elapsed from the starting of the motor 3. If the relationship of p1<I<p2 is satisfied as shown by arrow 1114*c*, the process shifts to the control of the pulse mode (1) which will be described later, as shown in Step 1120.

In the right graph, when the trigger switch is pulled at time $T_B$ (equivalent to Step 1102 of FIG. 12), the motor 3 is started and accelerated as shown by arrow 1115*a*. During this acceleration, a constant current control in a state where the maximum current value p is limited as shown by arrow 1116*a* is performed. When the rotation number of the motor 3 reaches a given rotation number (arrow 1115*b*), a current during acceleration becomes a usual current as shown by arrow 1116*b*. Therefore, the current value decreases. Thereafter, when the reaction force received from a fastening-subject member increases as fastening of a screw, a bolt, etc. proceeds, the rotation number of the motor 3 decreases gradually as shown by arrow 1115*c*, and the value of a current to be supplied to the motor 3 increases. In this example, the reaction force received from a fastening-subject member increased rapidly. Therefore, as shown by arrow 1116*c*, decrease of the rotation number of the motor 3 is large, and the rising degree of the current value is large. Then, since the current value after t milliseconds have elapsed from the starting of the motor 3 satisfies the relationship of p2<I as shown by arrow 1116*c*, the process shifts to the control of the pulse mode (2) shown in FIG. 16 as shown in Step 1140.

Usually, in the fastening operation of a screw, a bolt, etc., required that fastening torque is not often constant due to variation in the machining accuracy of a screw or a bolt, the state of a fastening-subject member, variation in materials, such as knots, grain, etc. of timber. Therefore, fastening may be performed at a stroke until immediately before completion of the fastening only by the drill mode. In such a case, when fastening in the impact mode (1) is skipped, and shifting to the fastening by the drill mode (2) with a higher fastening torque is made, the fastening operation can be efficiently completed in a short time.

Next, the control procedure of the impact tool in the pulse mode (1) will be described with reference to FIG. 14. If the process has shifted to the pulse mode (1), the peak current is first limited to equal to or less than p3 ampere (Step 1121) after a given pause period, and the motor 3 is rotated by supplying a normal rotation current to the motor 3 during a given time, i.e., T milliseconds (Step 1122). Next, the rotation number $N_{1n}$ [rpm] of the motor 3 after time T milliseconds have elapsed is detected (n=1, 2, . . . ) (Step 1123).

Next, a driving current to be supplied to the motor 3 is turned off, and the time $t_{1n}$ which is required until the rotation number of the motor 3 is lowered to $N_{2n}$ ($=N_{1n}/2$) from $N_{1n}$ is measured. Next, $t_{2n}$ is obtained from $t_{2n}=X-t_{1n}$, a normal rotation current is applied to the motor 3 during a period of this $t_{2n}$ (Step 1126), and the peak current is suppressed to equal to or less than p3 ampere, thereby accelerating the motor 3. Next, it is determined whether or not the rotation number $N_{1(n+1)}$ of the motor 3 is equal to or less than a threshold rotation number $R_{th}$ for shifting to the pulse mode (2) after the elapse of the time $t_{2n}$. If the rotation number of the motor is equal to or less than $R_{th}$, the processing of the pulse mode (1) is ended, the processing returns to Step 1120 of FIG. 12, and if the rotation number of the motor is equal to or more than $R_{th}$, the processing returns to Step 1124 (Step 1128).

Figure 15:
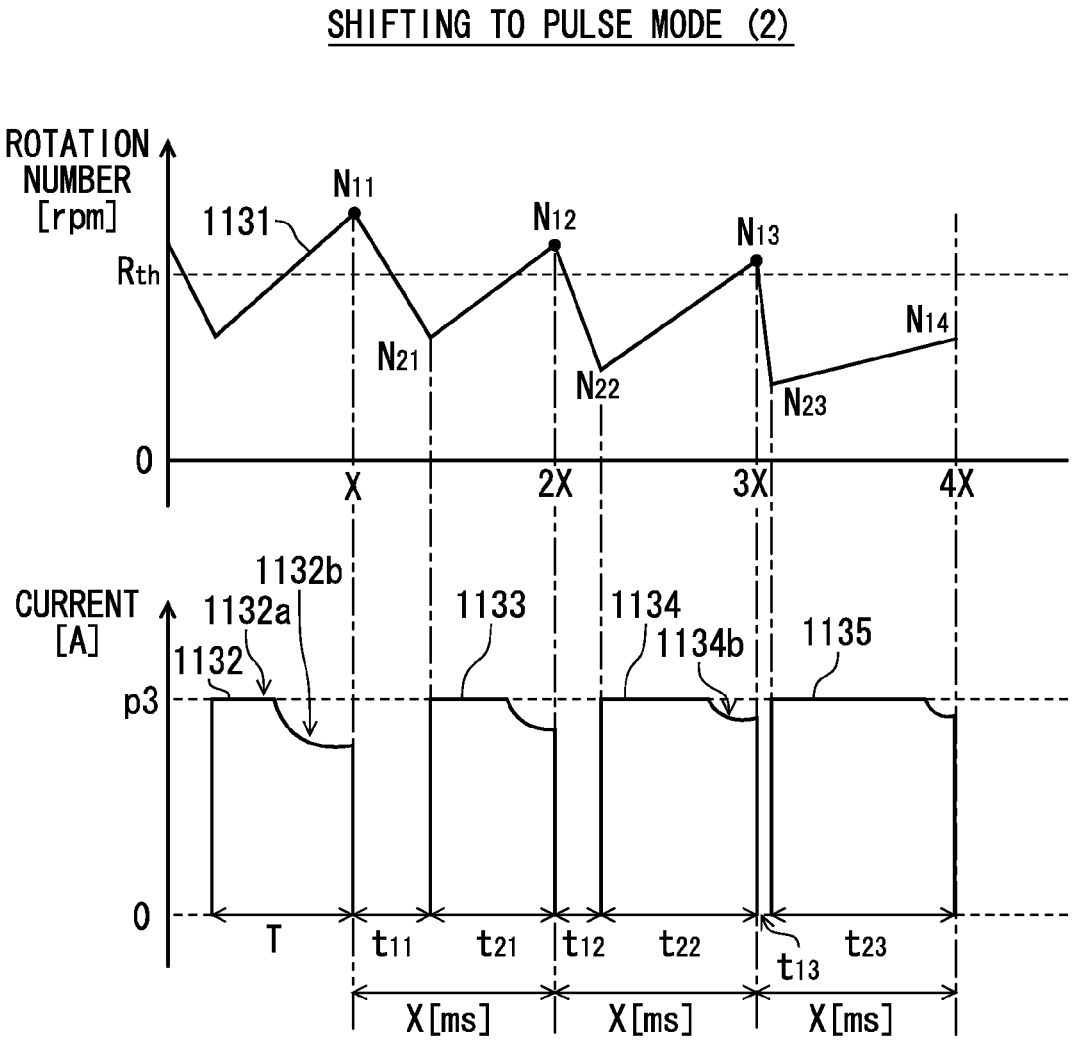
FIG. 15 illustrates the relationship between the rotation number of the motor 3 and elapsed time and the relationship between the value of a current to be supplied to the motor 3 and elapsed time.

FIG. 15 illustrates the relationship between the rotation number of the motor 3 and elapsed time and the relationship between a current to be supplied to the motor 3 and elapsed time while the control procedure illustrated in FIG. 14 is executed. A driving current 1132 is first supplied to the motor 3 by time T. Since the driving current limits the peak current to equal to or less than p3 ampere, the current during acceleration is limited as shown by arrow 1132*a*, and thereafter, the current value decreases as shown by arrow 1132*b* as the rotation number of the motor 3 increases. At time $T_1$, when it is measured that the rotation number of the motor 3 has reached $N_{11}$, the rotation number $N_{21}$ which starts the rotation of the motor 3 from $N_{21}=N_{11}/2$ is calculated by calculation. The rotation number $N_{11}$ is, for example, 10,000 rpm. When the rotation number of the motor 3 decreases to $N_{21}$, a driving current 1133 is supplied, and the motor 3 is accelerated again. Time $t_{2n}$ during which the driving current 1133 is applied is determined by $t_{2n}=X-t_{1n}$. Similarly, although the same control is performed at times 2× and 3×, the rising degree of the rotation number of the motor 3 decreases as the fastening reaction force becomes large, and the rotation number $N_{14}$ will become equal to or less than the threshold rotation value $R_{th}$ at time 4×. At this time, the processing of the pulse mode (1) is ended, and the process shifts to the processing of the pulse mode (2).

Next, the control procedure of the impact tool in the pulse mode (2) will be described with reference to FIG. 16. First, a driving current to be supplied to the motor 3 is turned off, and standby is performed for 5 milliseconds (Step 1141). Next, a reverse rotation current is supplied to the motor 3 so as to rotate the motor at −3000 rpm (Step 1142). The "minus" means that the motor 3 is rotated in a direction reverse to the rotation direction under operation at 3000 rpm. Next, if the rotation number of the motor 3 has reached −3000 rpm, a current to be supplied to the motor 3 is turned off, and standby is performed for 5 milliseconds (Step 1143). The reason why standby is performed for 5 milliseconds is because there is a possibility that the main body of the impact tool may be shaken when the motor 3 is reversely rotated suddenly in a reverse direction. Further, this is also because there is no consumption of electric power during this standby, and thus, energy saving can be achieved. Next, a normal rotation current is turned on in order to rotate the motor 3 in the normal rotation direction (Step 1144). A current to be supplied to the motor 3 is turned off 95 milliseconds after the normal rotation current is turned on. However, strong fastening torque is generated in the tip tool as the hammer 41 collides with (strikes) the anvil 46 before this current is turned off, (Step 1145). Thereafter, it is detected whether or not the ON state of the trigger switch is maintained. If the trigger switch is in an OFF state, the rotation of a motor 3 is stopped, the processing of the pulse mode (2) is ended, and the processing returns to Step 1140 of FIG. 12 (Steps 1147 and 1148). In Step 1147, if the trigger switch 8 is in an ON state, the processing returns to Step 1141 (Step 1147).

As described above, according to the first embodiment, a fastening-subject member can be efficiently fastened by performing continuous rotation, intermittent rotation only in the normal direction, and intermittent rotation in the normal direction and in the reverse direction for the motor using the hammer and the anvil between which the relative rotation angle is less than one rotation. Further, since the hammer and the anvil can be made into a simple structure, miniaturization and cost reduction of the impact tool can be realized.

The invention is not limited to the above-described embodiment. For example, although a brushless DC motor is exemplified, other kinds of motor which can be driven in the normal direction and in the reverse direction may be used.

Further, the shape of the anvil and the hammer is arbitrary. It is only necessary to provide a structure in which the anvil and the hammer cannot continuously rotate relative to each other (cannot rotate while riding over each other), secure a given relative rotation angle of less than 360 degrees, and form a striking-side surface and a struck-side surface. For example, the protruding portion of the hammer and the anvil may be constructed so as not to protrude axially but to protrude in the circumferential direction. Further, since the protruding portions of the hammer and the anvil are not necessarily only protruding portions which become convex to the outside, and have only to be able to form a striking-side surface and a struck-side surface in a given shape, the protruding portions may be protruding portions (that is, recesses) which protrude inside the hammer or the anvil. The striking-side surface and the struck-side surface are not necessarily limited to flat surfaces, and may be a curved shape or other shapes which form a striking-side surface or a struck-side surface well.

[Second Embodiment]

Next the impact tool according to a second embodiment will be described. The substantially same portions as those of the first embodiment are designated by the same reference numerals, and an explanation thereof will be omitted.

The impact tool 1 according to the second embodiment has substantially the same structure as the impact tool 1 according to the first embodiment. The striking mechanism 40 according to the second embodiment includes the anvil 46 and the hammer 41 as shown in FIGS. 8 and 9. First, the striking operation according to the second embodiment is described with the hammer 151 and the anvil 156 according to the basic construction as shown in FIG. 6.

Figure 17:
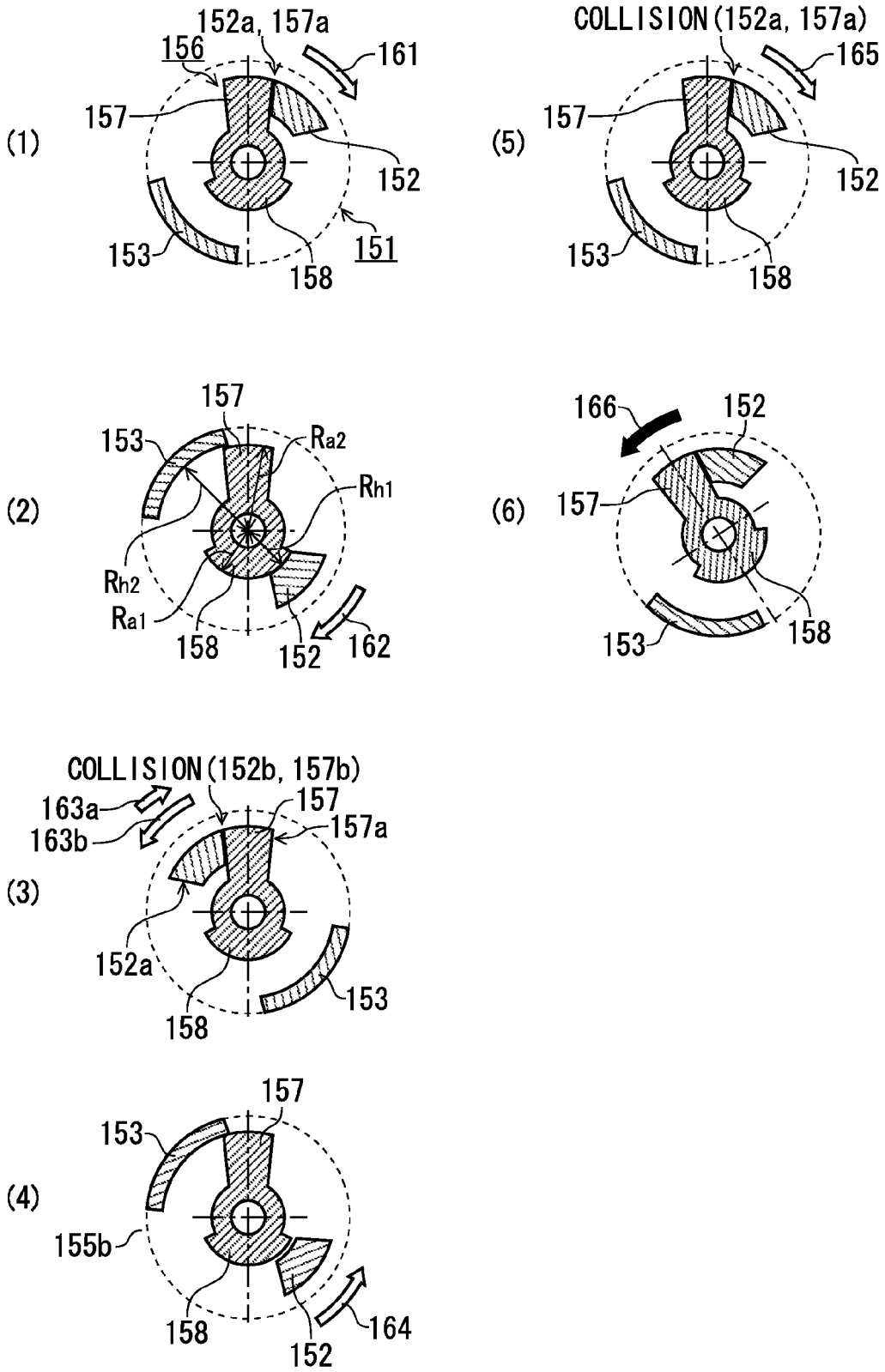
FIG. 17 illustrates the striking operation according to a second embodiment using the hammer 151 and the anvil 156 of FIG. 6, in six stages.

FIG. 17 illustrates one rotation movement of the hammer 151 and the anvil 156 according to the basic construction of FIG. 6, in six stages. The sectional plane of FIG. 17 is vertical to the axial direction, and includes a striking-side surface 152*a* (FIG. 6). In the state of FIG. 17(1), while fastening torque received from the tip tool is small, the anvil 156 rotates counterclockwise by being pushed from the hammer 151. However, when the fastening torque becomes large, and rotation becomes impossible only by the pushing force from the hammer 151, since the anvil 156 is struck by the hammer 151, the reverse rotation of the motor 3 is started in order to reversely rotate the hammer 151 in the direction of arrow 161. By starting the reverse rotation of the motor 3 in a state shown in (1), thereby rotating the protruding portion 152 of the hammer 151 in the direction of arrow 161, and further reversely rotate the motor 3, the protruding portion 152 rotates while being accelerated in the direction of arrow 162 through the outer peripheral side of the protruding portion 158 as shown in (2). Similarly, the external diameter $R_{a1}$ of the protruding portion 158 is made smaller than the internal diameter $R_{h1}$ of the protruding portion 152, and thus both the protruding portions do not collide with each other. The external diameter $R_{a2}$ of the protruding portion 157 is made smaller than the internal diameter $R_{h2}$ of the protruding portion 153, and thus both the protruding portions do not collide with each other. If the protruding portions are constructed in such positional relationship, the relative rotation angle of the hammer 151 and the anvil 156 can be made greater than 180 degrees, and the sufficient reverse rotation angle of the hammer 151 with respect to the anvil 156 can be secured.

When the hammer 151 further reversely rotates, and arrives at a position of FIG. 17(3) as shown by arrow 163*a*, the striking-side surface 152*b* of the protruding portion 152 is made to collide with the striking-side surface 157*b* of the protruding portion 157*a*. This collision is performed not to strike the anvil 156 but to stop the reverse rotation of the hammer 151, and is so-called striking for braking. Since the reverse rotation of the hammer 151 is stopped by striking in this way, there is no need of applying a brake current (a driving current in the normal rotation direction) to the motor 3.

After the hammer 151 collides with the anvil 156, the rotation of the motor 3 in the direction (the normal rotation direction) of arrow 163*b* is started. In the second embodiment, the reverse rotation stop position of the hammer 151 becomes a position where the hammer collides with the anvil 156, and the stop position becomes the same position every time.

Then, the hammer 151 is further accelerated while passing through the position of FIG. 17(4) in the direction of arrow 164, and the striking-side surface 152*a* of the protruding portion 152 collides with the struck-side surface 157*a* of the anvil 156 at a position shown in FIG. 17(5) in a state under acceleration. As a result of this collision, powerful rotation torque is transmitted to the anvil 156, and the anvil 156 rotates in the direction shown by arrow 166. The position of FIG. 17(6) is a state where both the hammer 151 and the anvil 156 have rotated at a given angle from the state of FIG. 17(1), and a fastening-subject member is fastened to a proper torque by repeating the operation from the state shown in FIG. 17(1) to FIG. 17(5) again.

As described above, an impact tool can be realized with the hammer 151 and the anvil 156 according to the basic construction serving as a striking mechanism by using a driving mode where the motor 3 is reversely rotated. In the striking mechanism of this construction, the motor can also be rotated in the drill mode by the setting of the driving mode of the motor 3. For example, in the drill mode, it is possible to rotate the hammer so as to follow the anvil 156 like FIG. 17(6) simply by rotating the motor 3 from the state of FIG. 17(5) to rotate the hammer 151 in a normal direction. Thus, by repeating this, fastening-subject members, such as screws or bolts, capable of making fastening torque small, can be fastened at high speed.

As described above, an impact tool can be realized with a simple construction of the hammer 151 and the anvil 156 serving as a striking mechanism by using a driving mode where the motor 3 is reversely rotated. In the striking mechanism of this construction, the motor can also be rotated in the drill mode by the setting of the driving mode of the motor 3. For example, in the drill mode, it is possible to rotate the hammer so as to follow the anvil 156 like FIG. 17(6) simply by rotating the motor 3 from the state of FIG. 17(5) to rotate the hammer 151 in a normal direction. Thus, by repeating this, fastening-subject members, such as screws or bolts, capable of making fastening torque small, can be fastened at high speed.

Figure 18:
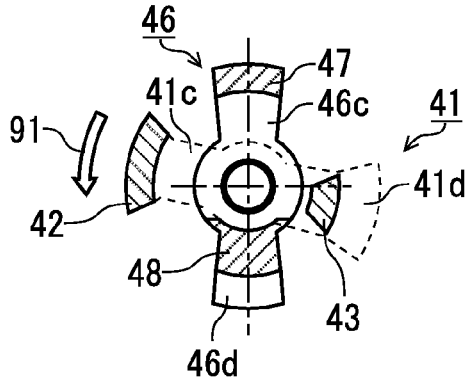
FIG. 18 illustrates the striking operation according to the second embodiment using the hammer 41 and the anvil 46 shown in FIGS. 8 and 9.
Figure 18:
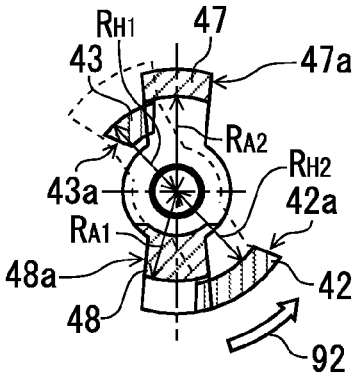
Figure 18:
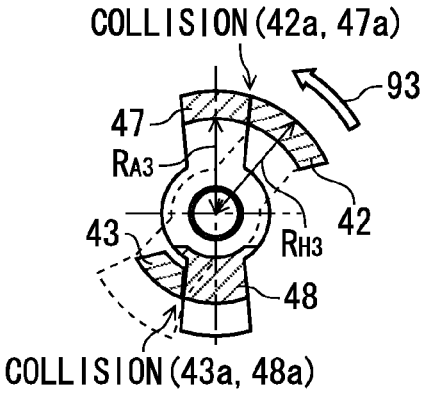
Figure 18:
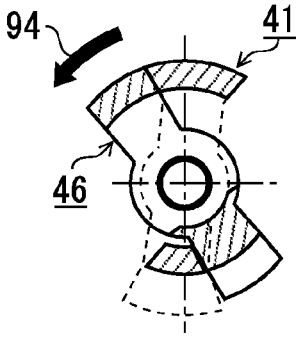

Next, the striking operation of the hammer 41 and the anvil 46 which are shown in FIGS. 8 and 9 will be described with reference to FIG. 18. The basic operation is the same as the operation described in FIG. 17, and the difference is that striking simultaneously performed in striking-side surfaces not at one place but at substantially-axisymmetric two places during striking. FIG. 18 illustrates a cross-section of a portion A-A of FIG. 3. FIG. 18 illustrates the positional relationship between the protruding portions 42 and 43 which protrude axially from the hammer 41, and the protruding portions 47 and 48 which protrude axially from the anvil 46. The rotation direction of the anvil 47 during the fastening operation (during normal rotation) is counter-clockwise.

FIG. 18(1) is in a state where the hammer 41 reversely rotates to the maximum reverse rotation position with respect to the anvil 46 (equivalent to the state of FIG. 17(3)). From this state, the hammer 41 is accelerated in the direction of arrow 91 (in the normal direction) to strike the anvil 46. Then, like FIG. 18(2), the protruding portion 42 passes through the outer peripheral side of the protruding portion 48, and simultaneously the protruding portion 43 passes through the inner peripheral side of the protruding portion 47. In order to allow passage of both the protruding portions, the internal diameter $R_{H2}$ of the protruding portion 42 is made greater than the external diameter $R_{A1}$ of the protruding portion 48, and thus the protruding portions do not collide with each other. Similarly, the external diameter $R_{H1}$ of the protruding portion 43 is made smaller than the internal diameter $R_{A2}$ of the protruding portion 47, and thus both the protruding portions do not collide with each other. According to such positional relationship, the relative rotation angle of the hammer 41 and the anvil 46 can be made larger more than 180 degrees, the sufficient reverse rotation angle of the hammer 41 to the anvil 46 can be secured, and this reverse rotation angle can be located in the accelerating section before the hammer 41 strikes the anvil 46.

Next, when the hammer 41 normally rotates to the state of FIG. 18(3), the striking-side surface 42*a* of the protruding portion 42 collides with the struck-side surface 47*a* of the protruding portion 47. Simultaneously, the striking-side surface 43*a* of the protruding portion 43 collides with the striking-side surface 48*a* of the protruding portion 48. By causing collision at two places opposite to a rotation axis in this way, the striking which is well-balanced with respect to the anvil 46 can be performed. As a result of this striking, as shown in FIG. 18(4), the anvil 46 rotates in the direction of arrow 94, and fastening of a fastening-subject member is performed by this rotation. The hammer 41 has the protruding portion 42 which is a solitary protrusion at a radial concentric position (a position above $R_{H2}$ and below $R_{H3}$), and has the protruding portion 43 which is a third solitary protrusion at a concentric position (position below $R_{H1}$). The anvil 46 has the protruding portion 47 which is a solitary protrusion at a radial concentric position (a position above $R_{A2}$ and below $R_{A3}$), and has the protruding portion 48 which is a solitary protrusion at a concentric position (position below $R_{A1}$).

Figure 19:
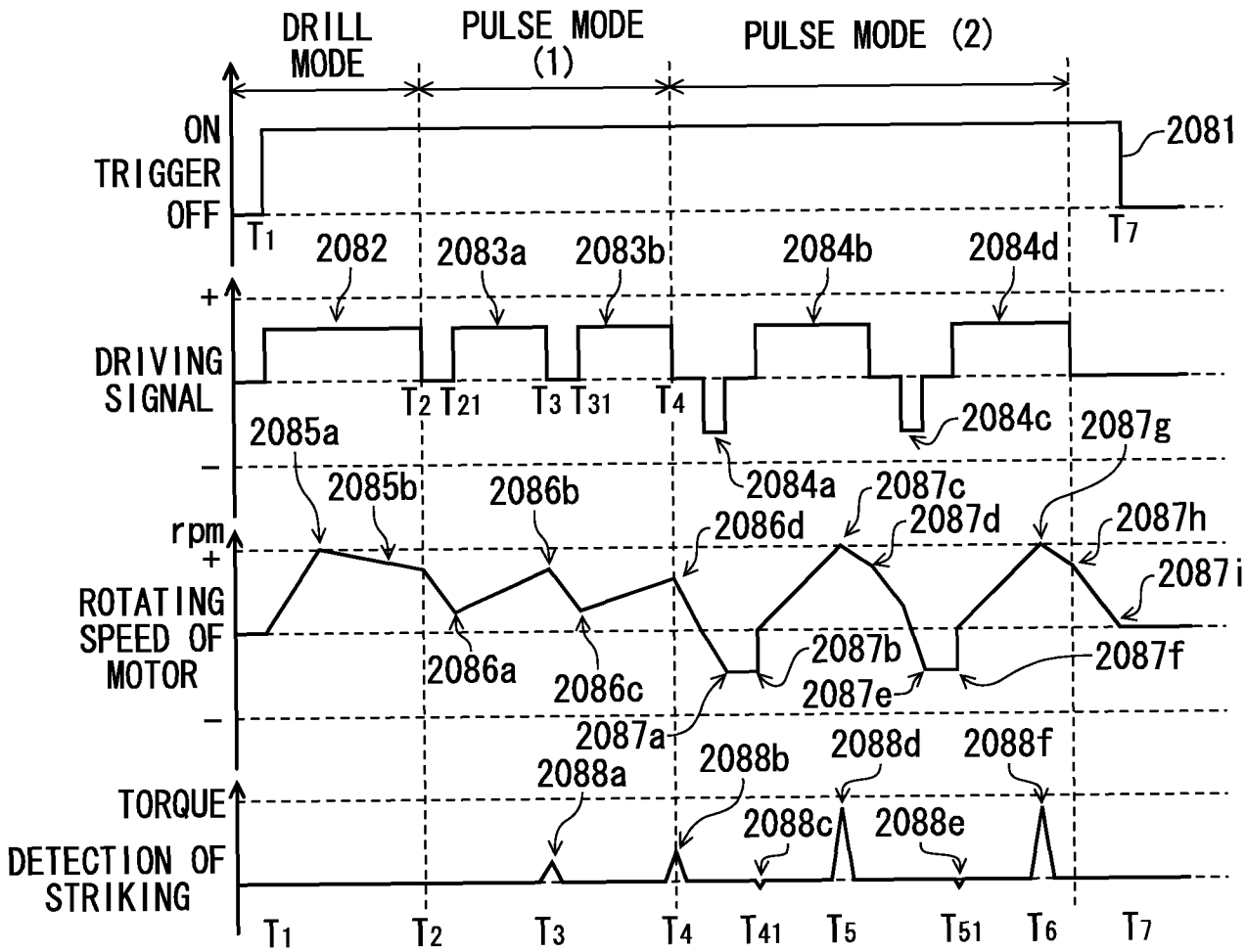
FIG. 19 illustrates a trigger signal during the operation of the impact tool 1, a driving signal of an inverter circuit, the rotating speed of the motor 3, and the striking state of the hammer 41 and the anvil 46.

Next, the driving method of the impact tool 1 according to the second embodiment will be described. In the impact tool 1 according to the second embodiment, the anvil 46 and the hammer 41 are formed so as to be relatively rotatable at a rotation angle of less than 360 degrees. Since the hammer 41 cannot perform rotation of more than one rotation relative to the anvil 46, the control of the rotation is also unique. FIG. 19 illustrates a trigger signal during the operation of the impact tool 1, a driving signal of an inverter circuit, the rotating speed of the motor 3, and the striking state of the hammer 41 and the anvil 46. The horizontal axis is time in the respective graphs (timings of the respective graphs are matched).

In the impact tool 1 according to the second embodiment, in the case of the fastening operation in the impact mode, fastening is first performed at high speed in the drill mode, fastening is performed by switching to the impact mode (1) if it is detected that the required fastening torque becomes large, and fastening is performed by switching to the impact mode (2) if the required fastening torque becomes still larger. In the drill mode from time $T_1$ to time $T_2$ of FIG. 19, the control unit 51 controls the motor 3 based on a target rotation number. For this reason, the motor is accelerated until the motor 3 reaches the target rotation number shown by arrow 2085*a*. Thereafter, the rotating speed of the motor 3 with a large fastening reaction force from the tip tool attached to the anvil 46 decreases gradually as shown by arrow 2085*b*. Thus, decrease of the rotation speed is detected by the value of a current to be supplied to the motor 3, and switching to the rotation driving mode by the pulse mode (1) is performed at time $T_2$.

The pulse mode (1) is a mode in which the motor 3 is not continuously driven but intermittently driven, and is driven in pulses so that "pause→normal rotation driving" is repeated multiple times. The expression "driven in pulses" means controlling driving so as to pulsate a gate signal to be applied to the inverter circuit 52, pulsate a driving current to be supplied to the motor 3, and thereby pulsate the rotation number or output torque of the motor 3. This pulsation is generated by repeating ON/OFF of a driving current with a large period (for example, about several tens of hertz to a hundred and several tens of hertz), such as ON (driving) of the driving current to be supplied to the motor from time $T_2$ to time $T_{21}$ (pause), ON (driving) of the driving current of the motor from time $T_{21}$ to time $T_3$, OFF (pause) of the driving current from time $T_3$ to time $T_{31}$, and ON of the driving current from time $T_{31}$ to time $T_4$. Although PWM control is performed for the control of the rotation number of the motor 3 in the ON state of the driving current, the period to be pulsated is sufficiently small compared with the period (usually several kilohertz) of duty ratio control.

In the example of FIG. 19, after supply of the driving current to the motor 3 for a certain time period from $T_2$ is paused, and the rotating speed of the motor 3 decreases to arrow 2086*a*, the control unit 51 (refer to FIG. 5) sends a driving signal 2083*a* to the control signal output circuit 53, thereby supplying a pulsating driving current (driving pulse) to the motor 3 to accelerate the motor 3. In addition, this control during acceleration does not necessarily mean driving at a duty ratio of 100% but means control at a duty ratio of less than 100%. Next, striking power is given as shown by arrow 2088*a* as the hammer 41 collides with the anvil 46 strongly at arrow 2086*b*. When striking power is given, the supply of a driving current to the motor 3 for a given time period is paused, and the rotating speed of the motor decreases again as shown by arrow 2086*a*. Thereafter, the control unit 51 sends a driving signal 2083*b* to the control signal output circuit 53, thereby accelerating the motor 3. Then, striking power is given as shown by arrow 2088*b* as the hammer 41 collides with the anvil 46 strongly at arrow 2086*d*. In the pulse mode (1), the above-described intermittent driving of repeating "pause→normal rotation driving" of the motor 3 is repeated one time or multiple times. However, if higher fastening torque has been required, the state is detected, and switching to the rotation driving mode by the pulse mode (2) is performed. Whether or not higher fastening torque has been required can be determined using, for example, the rotation number (before or after arrow 2086*d*) of the motor 3 when the striking power shown by arrow 2088*b* has been given.

Although the pulse mode (2) is a mode in which the motor 3 is intermittently driven, and is driven in pulses similarly to the pulse mode (1), the motor is driven so that "pause→reverse rotation driving→pause (stop)→normal rotation driving" is repeated plural times. That is, in the pulse mode (2), in order to add not only the normal rotation driving but the reverse rotation driving of the motor 3, the hammer 41 is accelerated in the normal rotation direction so as to collide with the anvil 46 strongly after the hammer 41 is reversely rotated by sufficient angular relation with respect to the anvil 46. By driving the hammer 41 in this way, strong fastening torque is generated in the anvil 46. In the second embodiment, when the rotation of the motor 3 which has been reversely rotated and driven is stopped (around arrows 2087*c* and 2087*g* in the drawing), the motor 3 is not decelerated and stopped by applying a normal rotation current to the motor 3, but the motor 3 is decelerated and stopped by making the hammer 41 collide with the anvil 46.

In the example of FIG. 19, when switching to the pulse mode (2) is performed at time $T_4$, driving of the motor 3 is temporarily paused, and then, the motor 3 is reversely rotated by sending the control driving signal 2084*a* in a negative direction to the signal output circuit 53. When normal rotation or reverse rotation is performed, this normal rotation or reverse rotation is realized by switching the signal pattern of each driving signal (ON/OFF signal) to be output to each of the switching elements Q1 to Q6 from the control signal output circuit 53. If the motor 3 has been reversely rotated by a given rotation angle, driving of the motor 3 is temporarily paused to start normal rotation driving. For this reason, a driving signal 2084*b* in a positive direction is sent to the control signal output circuit 53. In addition, in the rotational driving using the inverter circuit 52, a driving signal is not switched to the plus side or minus side. However, a driving signal is classified into the + direction and − direction and is schematically expressed in FIG. 19 so that whether the motor is rotationally driven in any direction can be easily understood.

The hammer 41 collides with the anvil 46 at a time when the rotating speed of the motor 3 reaches a maximum speed (arrow 2087*c*). Due to this collision, significant large fastening torque 2088*d* is generated compared to fastening torques (2088*a*, 2088*b*) to be generated in the pulse mode (1). When collision is performed in this way, the rotation number of the motor 3 decreases so as to reach arrow 2087*d* from arrow 2087*c*. In addition, the control of stopping a driving signal to the motor 3 at the moment when the collision shown by arrow 2088*d* has been detected may be performed. In that case, if a fastening-subject member is a bolt, a nut, etc., the recoil transmitted to an operator's hand after striking is little. By applying a driving current to the motor 3 as in the second embodiment even after collision, the reaction force to an operator is small as compared to the drill mode, and is suitable for the operation in a middle load state. Further, an effect that the fastening speed is high, and power consumption is little compared to a strong pulse mode is obtained. Thereafter, similarly, fastening with strong fastening torque is performed by repeating "pause→reverse rotation driving→striking (opposite direction)→normal rotation driving" by a given number of times. Since the striking during reverse rotation becomes striking the anvil 46 in the opposite direction, a small striking torque is generated in the opposite direction as shown by arrows 2088*c* and 2088*e*. However, since the striking torque is proportional to the square of the rotation number during collision, the striking torque in the opposite direction is sufficiently small compared to the striking torque (arrows 2088*d* and 2088*f*) in the normal rotation direction, and an adverse effect is not exerted on the fastening operation. As an operator releases the trigger operation at time $T_7$, the motor 3 stops, and the fastening operation is completed. The completion of the operation may be controlled so as to stop driving of the motor 3 when the computing unit 51 has determined based on not only the release of the trigger operation by an operator but also the output of the striking impact detecting sensor 56 (refer to FIG. 5) that fastening with set fastening torque is completed.

As described above, in the second embodiment, rotational driving is performed in the drill mode in an initial stage of fastening where only small fastening torque is required, fastening is performed in the impact mode (1) by intermittent driving of only normal rotation as the fastening torque becomes large, and fastening is strongly performed in the impact mode (2) by intermittent driving by the normal rotation and reverse rotation of the motor 3, in the final stage of fastening. In addition, driving may be performed using the impact mode (1) and the impact mode (2). The control of proceeding directly to the impact mode (2) from the drill mode without providing the impact mode (1) is also possible. Since the normal rotation and reverse rotation of the motor are alternately performed in the impact mode (2), fastening speed becomes significantly slower than that in the drill mode or impact mode (1). When the fastening speed becomes abruptly slow in this way, the sense of discomfort when transiting to the striking operation becomes large compared to an impact tool which has a conventional rotation striking mechanism. Thus, in the shifting to the impact mode (2) from the drill mode, an operation feeling becomes a natural feeling by interposing the impact mode (1) therebetween. For example, by performing fastening in the drill mode or impact mode (1) as much as possible, fastening operation time can be shortened.

Figure 20:
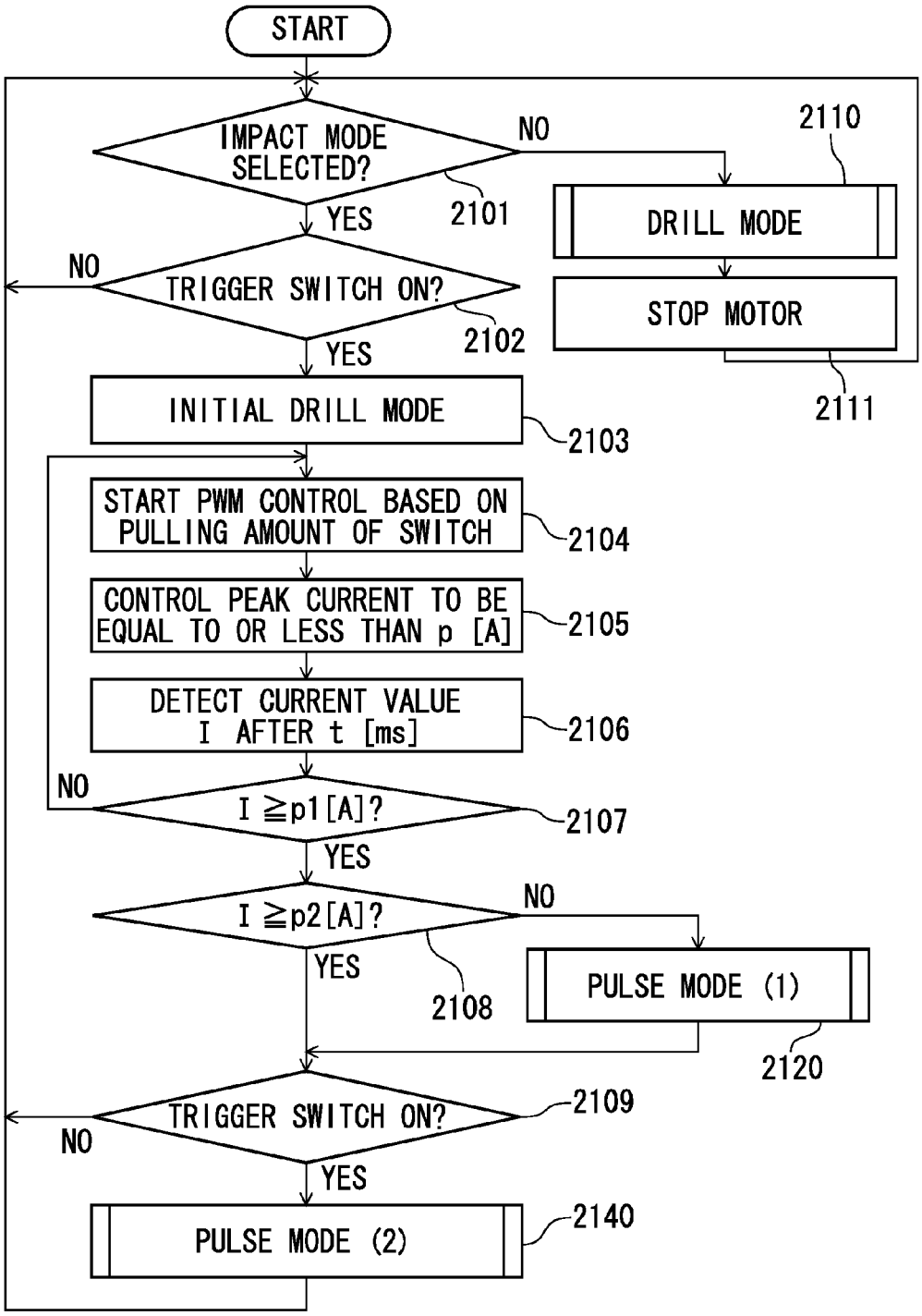
FIG. 20 illustrates a driving control procedure of the motor 3 according to the second embodiment.

Next, the control procedure of the impact tool 1 according to the second embodiment will be described with reference to FIG. 20 to FIG. 24. FIG. 20 illustrates the control procedure of the impact tool 1 according to the second embodiment. The impact tool 1 determines whether or not the impact mode is selected using the toggle switch 32 (refer to FIG. 2) prior to start of the operation by the user (Step 2101). If the impact mode is selected, the process proceeds to Step 2102, and if the impact mode is not selected, that is, in the case of a normal drill mode, the process proceeds to Step 2110.

In the impact mode, the computing unit 51 determines whether or not the trigger switch 8 is turned on. If the trigger switch is turned on (the trigger operating portion 8*a* is pulled), as shown in FIG. 19, the motor 3 is started by the drill mode (Step 2103), and the PWM control of the inverter circuit 52 is started according to the pulling amount of the trigger operating portion 8*a* (Step 2104). Then, the rotation of the motor 3 is accelerated while performing a control so that a peak current to be supplied to the motor 3 does not exceed an upper limit p. Next, the value I of a current to be supplied to the motor 3 after t milliseconds have elapsed after starting is detected using the output of the current detecting circuit 59 (refer to FIG. 5). If the detected current value I does not exceed p1 ampere, the process returns to Step 2104, and if the current value has exceeded p1 ampere, the process proceeds to Step 2108 (Step 2107). Next, it is determined whether or not the detected current value I exceeds p2 ampere (Step 2108).

Figure 22:
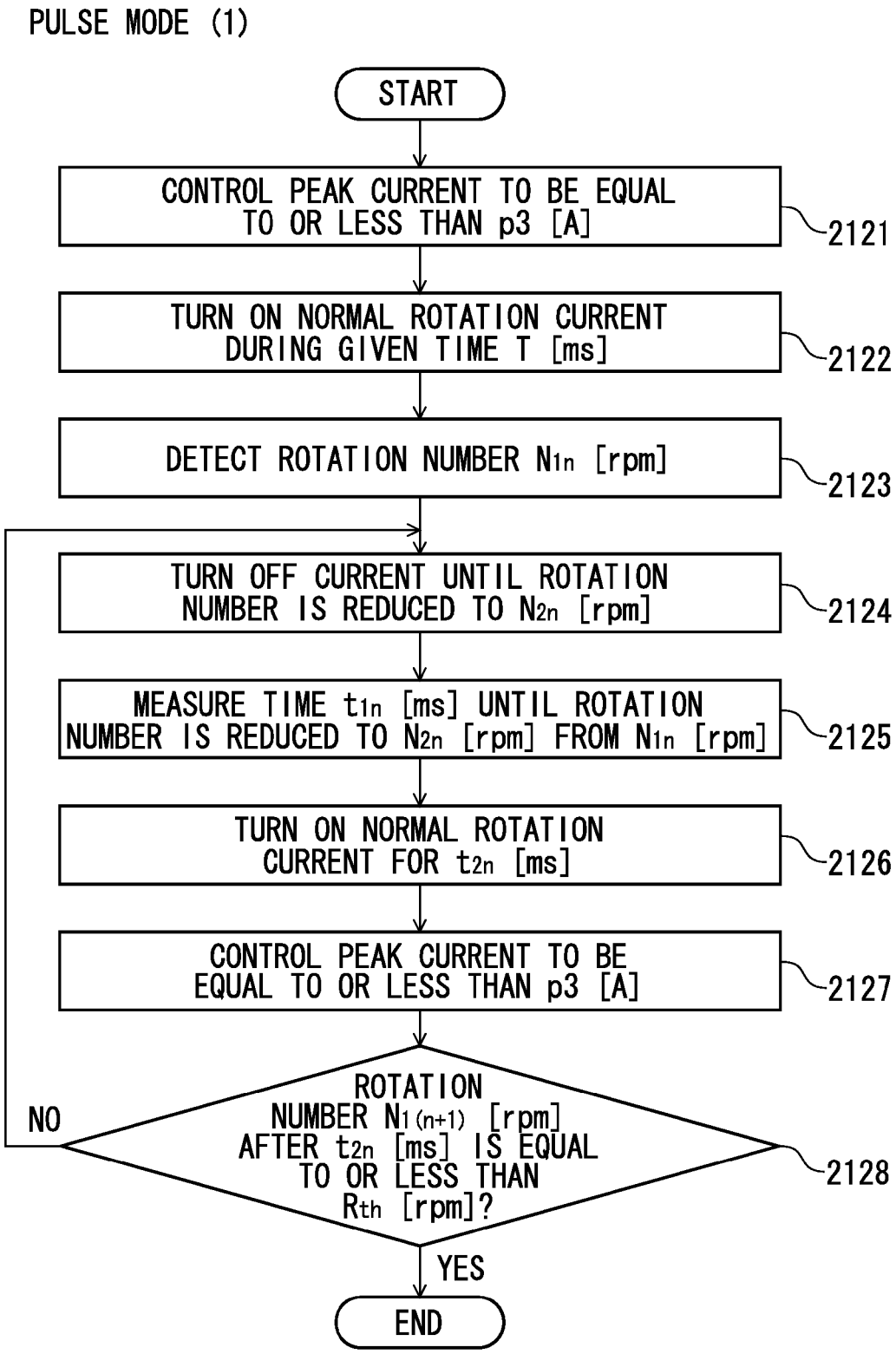
FIG. 22 illustrates the driving control procedure of the motor in a pulse mode (1) according to the second embodiment.
Figure 24:
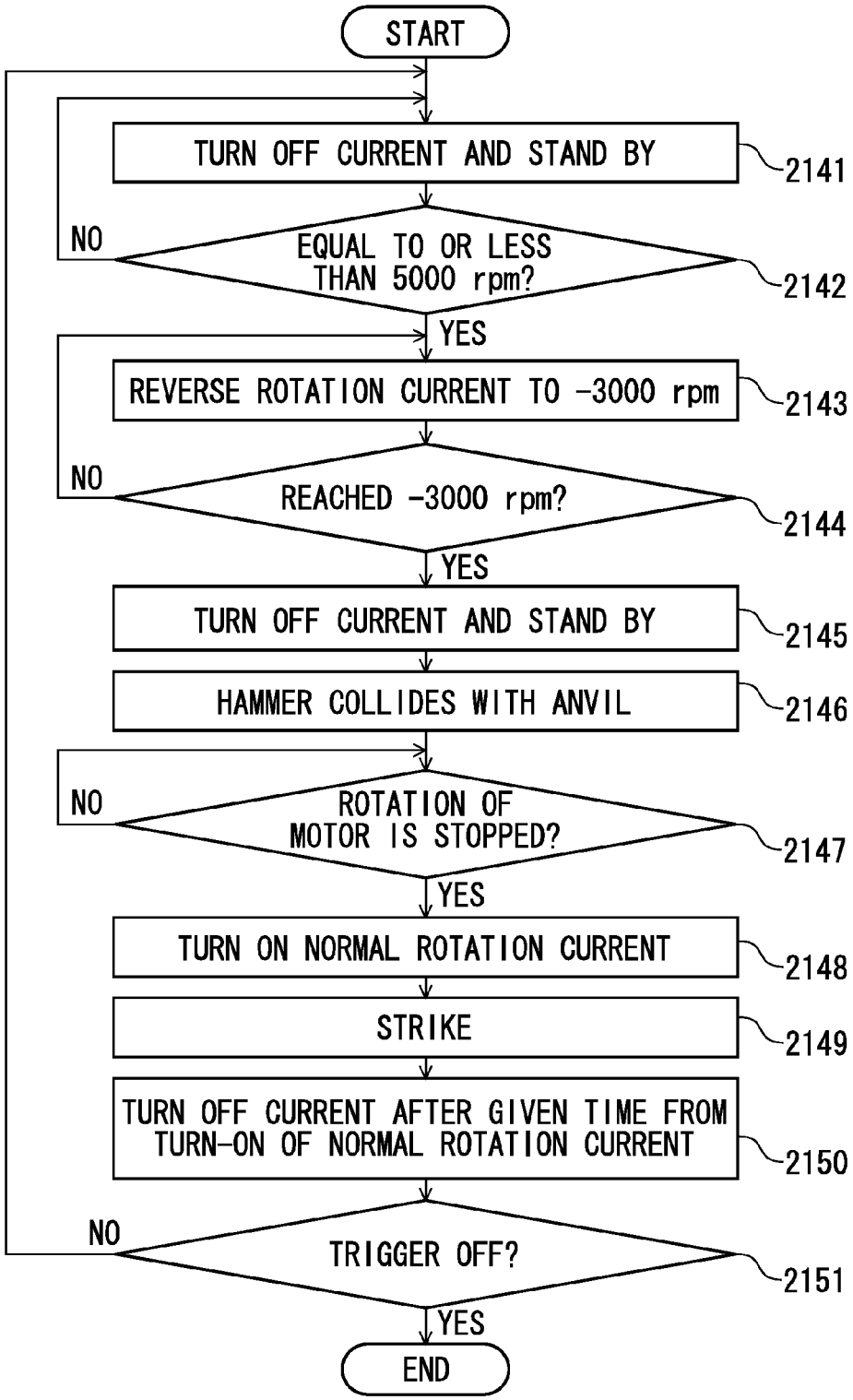
FIG. 24 illustrates the driving control procedure of the motor 3 in the pulse mode (2) according to the second embodiment.

If the detected current value I does not exceed p2 [A] in Step 2108, that is, if the relationship of p1<I<p2 is satisfied, the process proceeds to Step 2109 (Step 2120) after the procedure of the pulse mode (1) shown in FIG. 22 is executed. Then, if the detected current value I exceeds p2 [A], the process proceeds directly to Step 2109, without executing the procedure of the pulse mode (1). In Step 2109, it is determined whether or not the trigger switch 8 is set to ON. If the trigger switch is turned off, the processing returns to Step 2101. If the ON state is continued, the processing returns to Step 2101 after the procedure of the pulse mode (2) shown in FIG. 24 is executed.

If the drill mode is selected in Step 2101, the drill mode 2110 is executed, but the control of the drill mode is the same as the control of Steps 2102 to 2107. Then, by detecting a control current in an electronic clutch or an overcurrent state immediately before the motor 3 is locked as p1 of Step 2107, thereby stopping the motor 3 (Step 2111), the drill mode is ended, and the processing returns to Step 2101.

Figure 21:
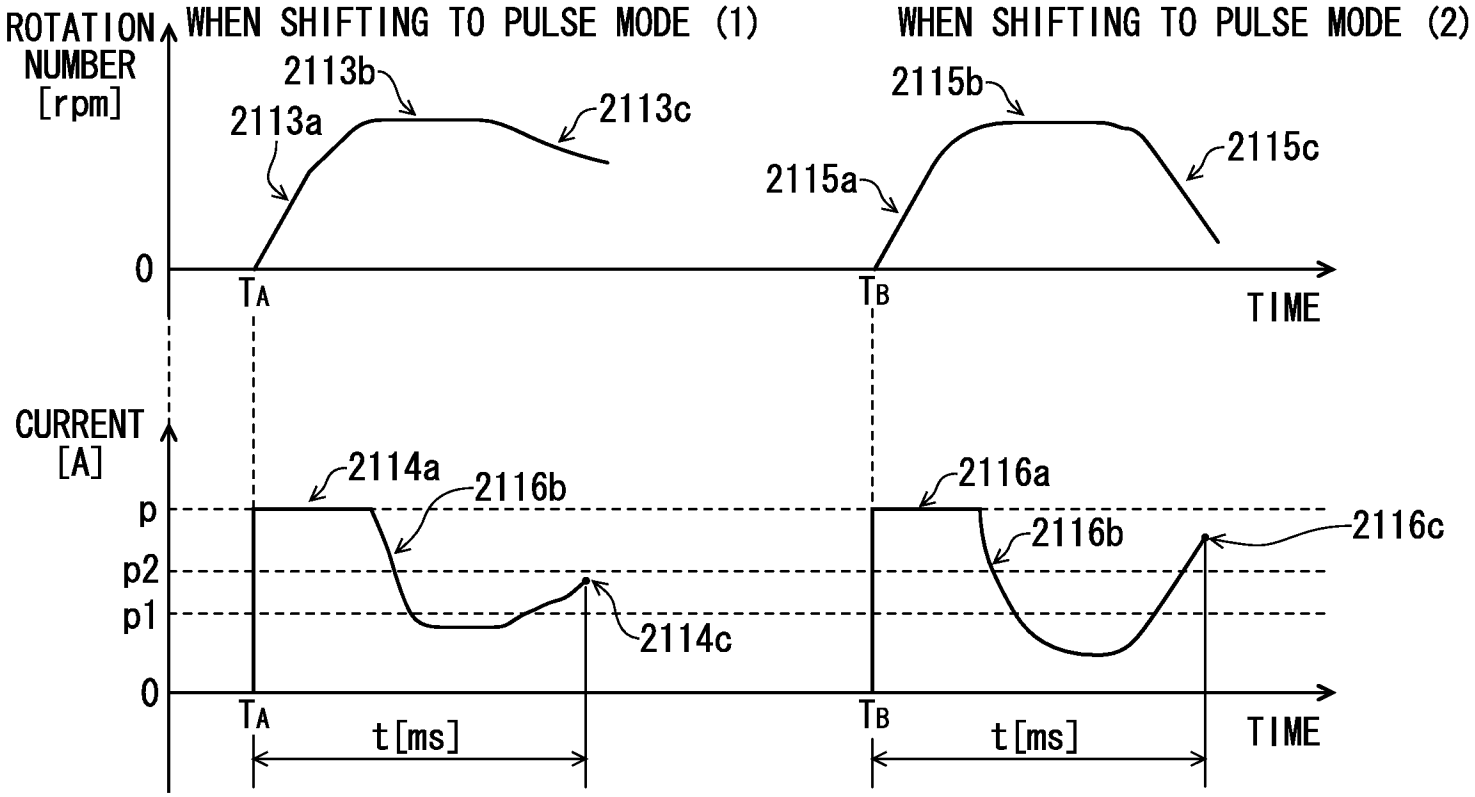
FIG. 21 illustrates a graph for explaining a driving mode of the hammer 41 in the second embodiment, in which a current to be applied to the motor and the rotation number are shown.

The determination procedure of the mode shifting in Steps 2107 and 2108 will be described with reference to FIG. 21. An upper graph shows the relationship between elapsed time and the rotation number of the motor 3, a lower graph shows the relationship between a current value to be supplied to the motor 3, and time, and the time axes of the upper and lower graphs are made the same. In the left graph, when the trigger switch is pulled at time TA (equivalent to Step 2102 of FIG. 20), the motor 3 is started and accelerated as shown by arrow 2113*a*. During this acceleration, a constant current control in a state where the maximum current value p is limited as shown by arrow 2114*a* is performed. When the rotation number of the motor 3 reaches a given rotation number (arrow 2113*b*), a current during acceleration becomes a usual current as shown by arrow 2114*b*. Therefore, the current value decreases. Thereafter, when the reaction force received from a fastening-subject member increases as fastening of a screw, a bolt, etc. proceeds, the rotation number of the motor 3 decreases gradually as shown by arrow 2113*c*, and the value of a current to be supplied to the motor 3 increases. Then, the current value is determined after t milliseconds have elapsed from the starting of the motor 3. If the relationship of p1<I<p2 is satisfied as shown by arrow 2114*c*, the process shifts to the control of the pulse mode (1) which will be described later, as shown in Step 2120.

In the right graph, when the trigger switch is pulled at time TB (equivalent to Step 2102 of FIG. 20), the motor 3 is started and accelerated as shown by arrow 2115*a*. During this acceleration, a constant current control in a state where the maximum current value p is limited as shown by arrow 2116*a* is performed. When the rotation number of the motor 3 reaches a given rotation number (arrow 2115*b*), a current during acceleration becomes a usual current as shown by arrow 2116*b*. Therefore, the current value decreases. Thereafter, when the reaction force received from a fastening-subject member increases as fastening of a screw, a bolt, etc. proceeds, the rotation number of the motor 3 decreases gradually as shown by arrow 2115*c*, and the value of a current to be supplied to the motor 3 increases. In this example, the reaction force received from a fastening-subject member increased rapidly. Therefore, as shown by arrow 2116*c*, decrease of the rotation number of the motor 3 is large, and the rising degree of the current value is large. Then, since the current value after t milliseconds have elapsed from the starting of the motor 3 satisfies the relationship of p2<I as shown by arrow 2116*c*, the process shifts to the control of the pulse mode (2) shown in FIG. 24 as shown in Step 2140.

Usually, in the fastening operation of a screw, a bolt, etc., required that fastening torque is not often constant due to variation in the machining accuracy of a screw or a bolt, the state of a fastening-subject member, variation in materials, such as knots, grain, etc. of timber. Therefore, fastening may be performed at a stroke until immediately before completion of the fastening only by the drill mode. In such a case, when fastening in the impact mode (1) is skipped, and shifting to the fastening by the drill mode (2) with a higher fastening torque is made, the fastening operation can be efficiently completed in a short time.

Next, the control procedure of the impact tool in the pulse mode (1) will be described with reference to FIG. 22. If the process has shifted to the pulse mode (1), the peak current is first limited to equal to or less than p3 ampere (Step 2121) after a given pause period, and the motor 3 is rotated by supplying a normal rotation current to the motor 3 during a given time, i.e., T milliseconds (Step 2122). Next, the rotation number N1*n* [rpm] of the motor 3 after time T milliseconds have elapsed is detected (n=1, 2, . . . ) (Step 2123). Next, a driving current to be supplied to the motor 3 is turned off, and the time tin which is required until the rotation number of the motor 3 is lowered to N2*n* (=N1*n*/2) from N1*n* is measured. Next, t2*n* is obtained from t2*n*=X−t1*n*, a normal rotation current is applied to the motor 3 during a period of this t2*n* (Step 2126), and the peak current is suppressed to equal to or less than p3 ampere, thereby accelerating the motor 3. Next, it is determined whether or not the rotation number N1(n+1) of the motor 3 is equal to or less than a threshold rotation number Rth for shifting to the pulse mode (2) after the elapse of the time t2*n*. If the rotation number of the motor is equal to or less than Rth, the processing of the pulse mode (1) is ended, the processing returns to Step 2120 of FIG. 20, and if the rotation number of the motor is equal to or more than Rth, the processing returns to Step 2124 (Step 2128).

Figure 23:
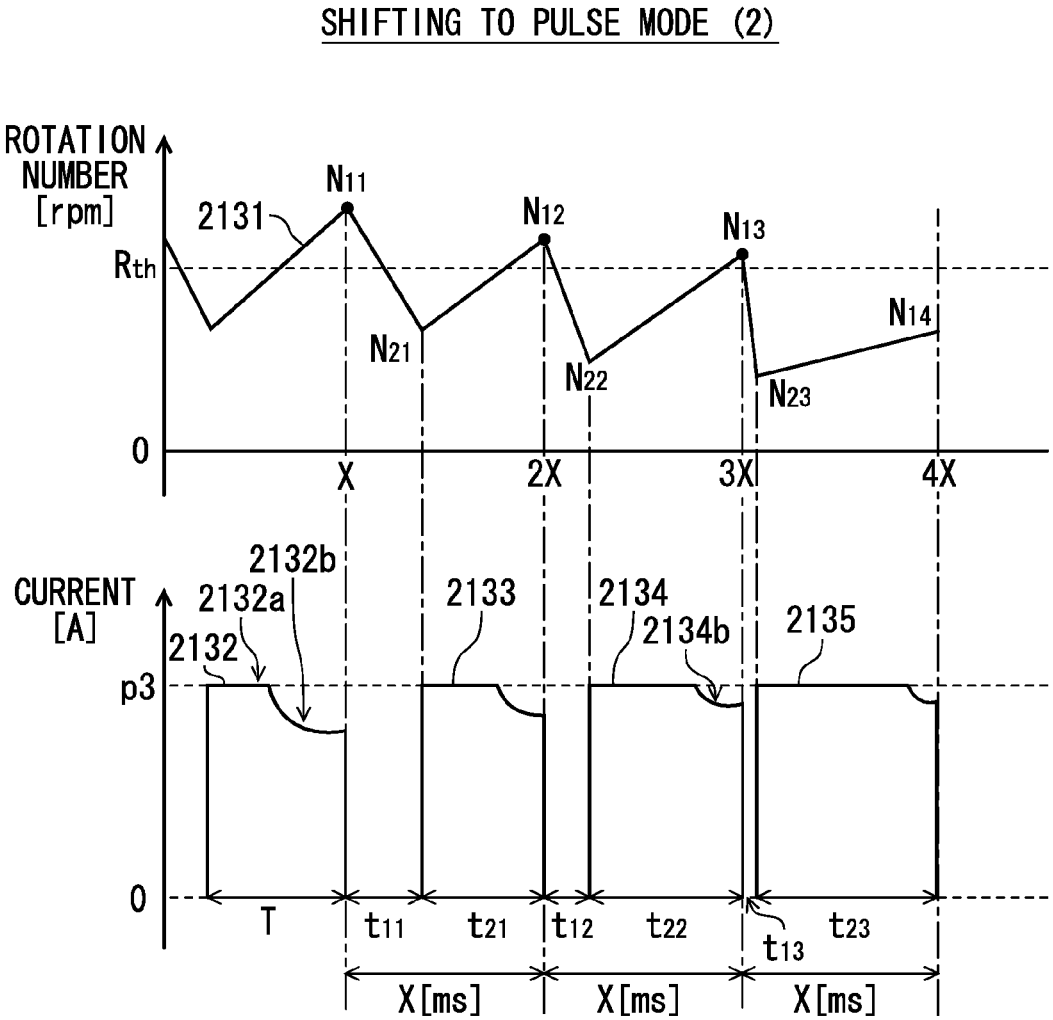
FIG. 23 illustrates the relationship between the rotation number of the motor 3 and elapsed time and the relationship between the value of a current to be supplied to the motor 3 and elapsed time.

FIG. 23 illustrates the relationship between the rotation number of the motor 3 and elapsed time and the relationship between a current to be supplied to the motor 3 and elapsed time while the control procedure illustrated in FIG. 22 is executed. A driving current 2132 is first supplied to the motor 3 by time T. Since the driving current limits the peak current to equal to or less than p3 ampere, the current during acceleration is limited as shown by arrow 2132*a*, and thereafter, the current value decreases as shown by arrow 2132*b* as the rotation number of the motor 3 increases. At time T1, when it is measured that the rotation number of the motor 3 has reached N11, the rotation number N21 which starts the rotation of the motor 3 from N21=N11/2 is calculated by calculation. The rotation number N11 is, for example, 10,000 rpm. When the rotation number of the motor 3 decreases to N21, a driving current 2133 is supplied, and the motor 3 is accelerated again. Time t2*n* during which the driving current 2133 is applied is determined by t2*n*=X−t1*n*. Similarly, although the same control is performed at times 2× and 3×, the rising degree of the rotation number of the motor 3 decreases as the fastening reaction force becomes large, and the rotation number N14 will become equal to or less than the threshold rotation value Rth at time 4×. At this time, the processing of the pulse mode (1) is ended, and the process shifts to the processing of the pulse mode (2).

Next, the control procedure of the impact tool in the pulse mode (2) will be described with reference to FIG. 24. First, a driving current to be supplied to the motor 3 is turned off, and standby is performed (Step 2141). If the rotation number of the motor is reduced to equal to or less than 5000 rpm during standby, a reverse rotation current is supplied to the motor 3 so that the motor 3 is rotated at −3000 rpm (Step 2142). The rotation number of the motor 3 is detected using an output signal of the rotational position detecting element 58. Here, the "minus" means that the motor 3 is rotated in a direction reverse to the rotation direction under operation at 3000 rpm. Next, if the rotation number of the motor 3 has reached −3000 rpm, a current to be supplied to the motor 3 is turned off, and standby is performed (Steps 2143 and 2144). When a current is turned off, the motor 3 continues to rotate by inertia, and the hammer 41 collides with the anvil 46. Since this collision is a collision in a direction reverse to the rotation direction under operation, and is sufficiently as small as 3000 rpm or less compared with the rotation number (10,000 rpm) during collision of the operation direction (the normal rotation direction), though a direction which impedes operation, the striking power in the opposite direction is sufficiently small, and fastening-subject members, such as a screw, are not loosened. Since the motor 3 which has been reversed without consuming a current can be stopped by making the hammer 41 collide with the anvil 46 during the reverse rotation of the motor 3 in this way, current consumption can be significantly saved.

Next, if it is confirmed that the motor 3 has stopped, a normal rotation current is turned on in order to rotate the motor 3 in the normal rotation direction (Steps 2147 and 2148). The stop of rotation of the motor 3 can be detected using an output signal of the rotational position detecting element 58, and an output signal of the striking impact detecting sensor 56. When a normal rotation current is turned on, the motor 3 is accelerated to the rotation of 10,000 rpm, and the hammer 41 collides with the anvil 46 at this rotation number. In this way, fastening is performed by the output torque of the motor 3 and the inertial energy of the motor 3 and the hammer 41 (Step 2149). Then, after a normal rotation current is turned on, a current to be supplied to the motor 3 after the elapse of a given time is turned off (Step 2150). It is preferable that this given time be set so as to elapse after striking is performed.

Thereafter, it is detected whether or not the ON state of the trigger switch is maintained. If the trigger switch is in an OFF state, the rotation of a motor 3 is stopped, the processing of the pulse mode (2) is ended, and the processing returns to Step 2140 of FIG. 20 (Step 2151). If the trigger switch 8 is in an ON state, the processing returns to Step 2141 (Step 2151).

In addition, in Step 2146, the impact during reverse rotation may be mitigated by making a normal rotation current flow immediately before a collision during reverse rotation, thereby putting on the brake though slightly, to reduce the rotation number in a reverse of direction of the motor immediately before the collision.

As described above, according to the second embodiment, a fastening-subject member can be efficiently fastened by performing continuous rotation, intermittent rotation only in the normal direction, and intermittent rotation in the normal direction and in the reverse direction for the motor using the hammer and the anvil between which the relative rotation angle is less than one rotation. Since the shape of the hammer and the anvil can be made into a simple structure, miniaturization and cost reduction of the impact tool can be realized. Since there is no need for applying a large normal rotation current in stopping the motor under rotation in the reverse direction and the motor is effectively stopped in a short time due to impact energy, the amount of consumption of a current can be reduced. Since the reversed hammer is made to collide with the anvil, the error of the initial position where acceleration of the normal rotation of the hammer is started decreases, and variation in striking power can be made small.

The invention is not limited to the above-described embodiment. For example, although a brushless DC motor is exemplified, other kinds of motors which can be driven in the normal direction and in the reverse direction may be used.

The shape of the anvil and the hammer is arbitrary. It is only necessary to provide a structure in which the anvil and the hammer cannot continuously rotate relative to each other (cannot rotate while riding over each other), secure a given relative rotation angle of less than 360 degrees, and form a striking-side surface and a struck-side surface. For example, the protruding portion of the hammer and the anvil may be constructed so as not to protrude axially but to protrude in the circumferential direction. Since the protruding portions of the hammer and the anvil are not necessarily only protruding portions which become convex to the outside, and have only to be able to form a striking-side surface and a struck-side surface in a certain shape, the protruding portions may be protruding portions (that is, recesses) which protrude inside the hammer or the anvil. The striking-side surface and the struck-side surface are not necessarily limited to flat surfaces, and may be a curved shape or other shapes which form a striking-side surface or a struck-side surface well.

[Third Embodiment]

Next the impact tool according to a third embodiment will be described. The substantially same portions as those of the first embodiment are designated by the same reference numerals, and an explanation thereof will be omitted.

Figure 25:
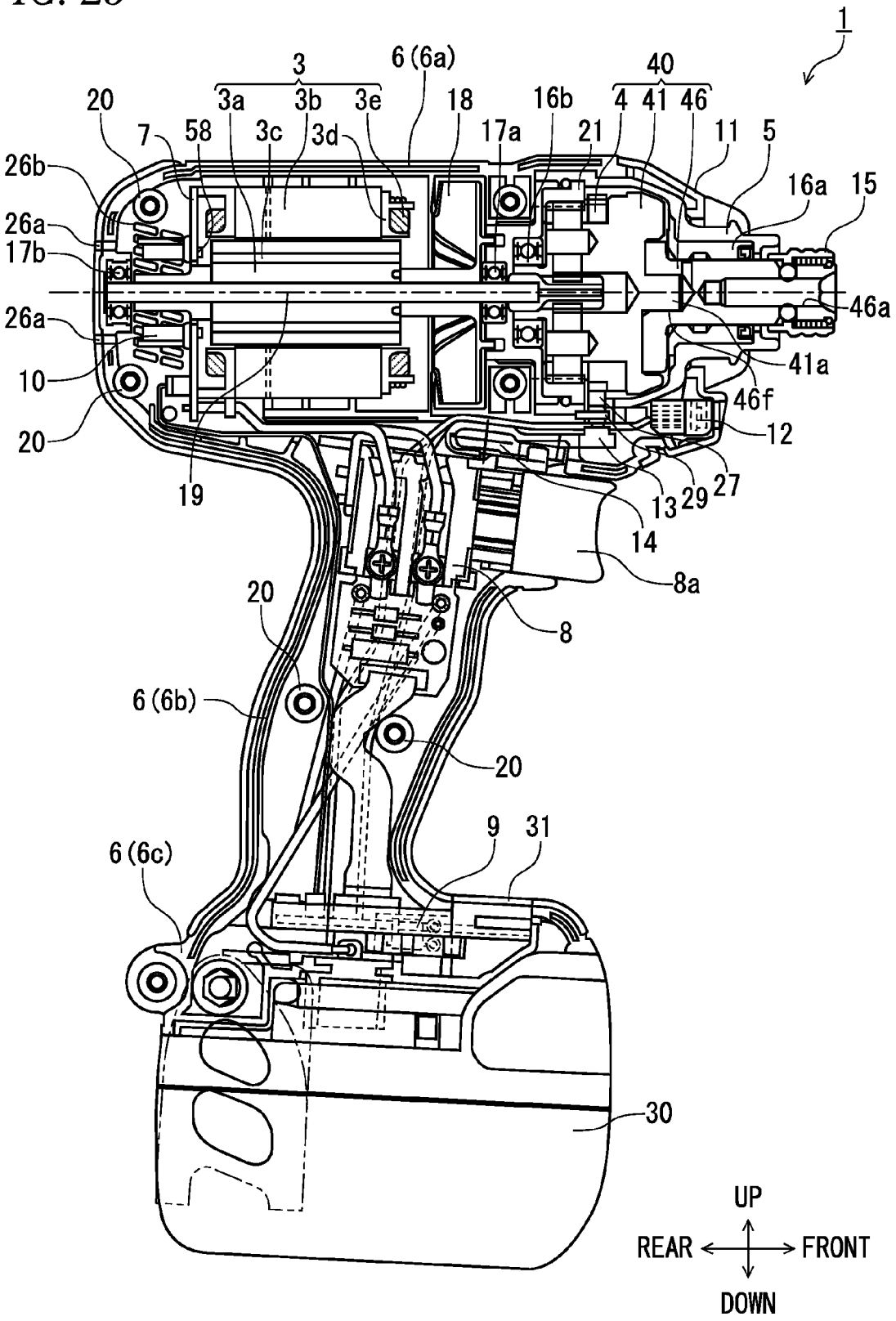
FIG. 25 cross-sectionally illustrates an impact tool 1 according to a third embodiment.

FIG. 25 cross-sectionally illustrates an impact tool according to the invention. The impact tool 1 according to the third embodiment is almost the same with the impact tool 1 according to the first embodiment. The third embodiment is different from the first embodiment in that a convex portion 13 is connected to the front of the normal/reverse switching lever 14 and that the striking mechanism 40 includes the anvil 46, the hammer 41 and a sprocket 4.

The sprocket 4 is mounted on the rear of the hammer 41, and performs a braking operation during the reverse rotation of the hammer 41. An appearance of the impact tool according to the third embodiment is substantially the same as that of the impact tool according to the first embodiment.

Figure 26:
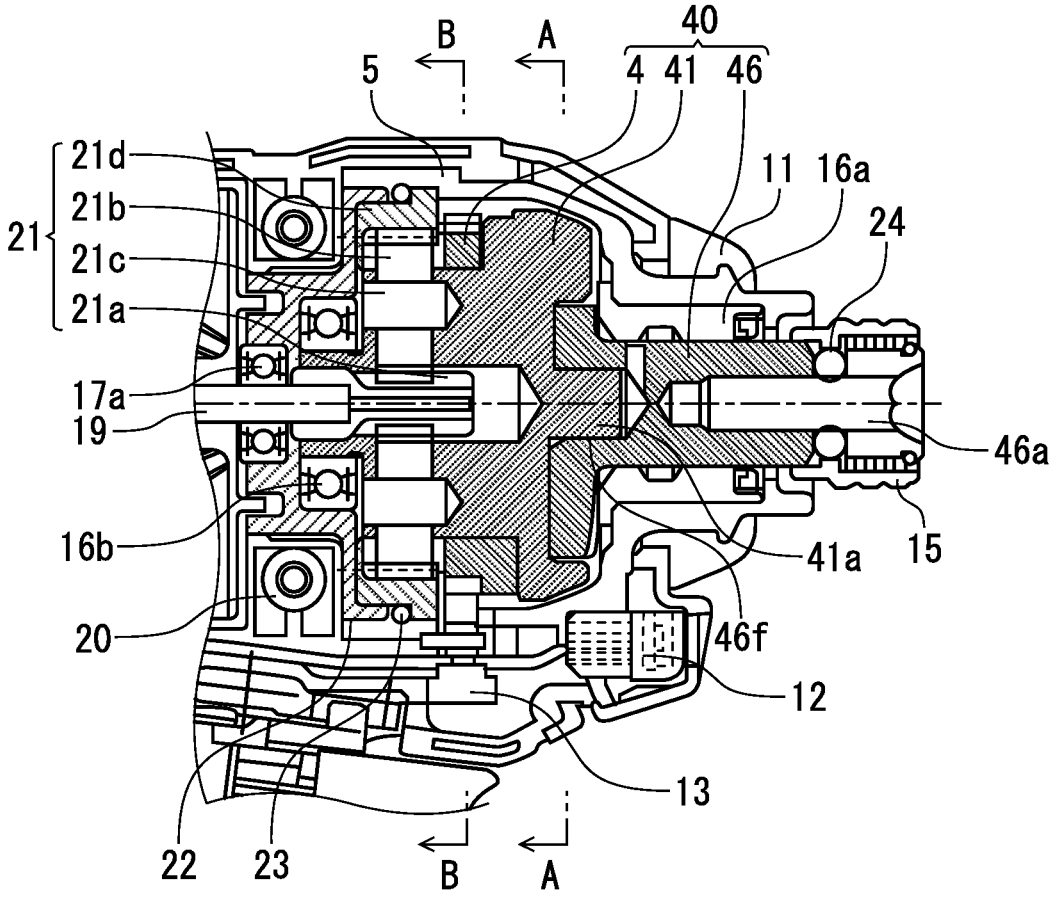
FIG. 26 enlargedly illustrates around a striking mechanism 40 of FIG. 25.

FIG. 26 is an enlarged sectional view around a striking mechanism 40 of FIG. 25. The planetary gear speed-reduction mechanism 21 is a planetary type. A sun gear 21*a* connected to the tip of the rotary shaft 19 of the motor 3 becomes a driving shaft (input shaft), and plural planetary gears 21*b* rotate within an outer gear 21*d* fixed to the trunk portion 6*a*. Plural rotary shafts 21*c* of the planetary gears 21*b* is held by the hammer 41 as a planetary carrier. The hammer 41 rotates at a given reduction ratio in the same direction as the motor 3, as a driven shaft (output shaft) of the planetary gear speed-reduction mechanism 21. Whether this reduction ratio is set to a certain degree has only to be appropriately set from factors, such as a fastening-subject member (a screw or a bolt) and the output of the motor 3 and the magnitude of required fastening torque. In the third embodiment, the reduction ratio is set so that the rotation number of the hammer 41 becomes about ⅛ to 1/15 of the rotation number of the motor 3.

The annual-shaped sprocket 4 is provided on the front side of the planetary gear 21*b*. The sprocket 4 acts as a brake mechanism of the hammer 41, and is provided on the outer peripheral side of a cylindrical portion as the planetary carrier of the hammer 41. Although the sprocket 4 rotates so as to follow the hammer 41 during normal rotation, the hammer 41 is rotated by 120 degrees relative to the anvil 46 during reverse rotation. The detailed structure of the sprocket 4 will be described later. An inner cover 22 is provided on the inner peripheral side of two screw bosses 20 inside the trunk portion 6*a*. The inner cover 22 is a member manufactured by integral molding of synthetic resin, such as plastic. A cylindrical portion is formed on the rear side of the inner cover, and bearings 17*a* which rotatably fix the rotary shaft 19 of the motor 3 are held by a cylindrical portion of the inner cover. A cylindrical stepped portion which has two different diameters is provided on the front side of the inner cover 22. Ball type bearings 16*b* are provided at the stepped portion with a smaller diameter, and a portion of an outer gear 21*d* is inserted from the front side at the cylindrical stepped portion with a larger diameter. In addition, since the outer gear 21*d* is non-rotatably attached to the inner cover 22, and the inner cover 22 is non-rotatably attached to the trunk portion 6*a* of the housing 6, the outer gear 21*d* is fixed in a non-rotating state. An outer peripheral portion of the outer gear 21*d* is provided with a flange portion with a largely formed external diameter, and an O ring 23 is provided between the flange portion and the inner cover 22. Grease (not shown) is applied to rotating portions of the hammer 41 and the anvil 46, and the O ring 23 performs sealing so that the grease does not leak into the inner cover 22.

In the third embodiment, a hammer 41 functions as a planetary carrier which holds the plural rotary shafts 21*c* of the planetary gear 21*b*. Therefore, the rear end of the hammer 41 extends to the inner peripheral side of the bearings 16*b*. The rear inner peripheral portion of the hammer 41 is arranged in a cylindrical inner space which accommodates the sun gear 21*a* attached to the rotary shaft 19 of the motor 3. A fitting shaft 41*a* which protrudes axially forward is formed around the front central axis of the hammer 41, and the fitting shaft 41*a* fits to a cylindrical fitting groove 46*f* formed around the rear central axis of the anvil 46. In addition, the fitting shaft 41*a* and the fitting groove 46*f* are journalled so that both are rotatable relative to each other.

Figure 27:
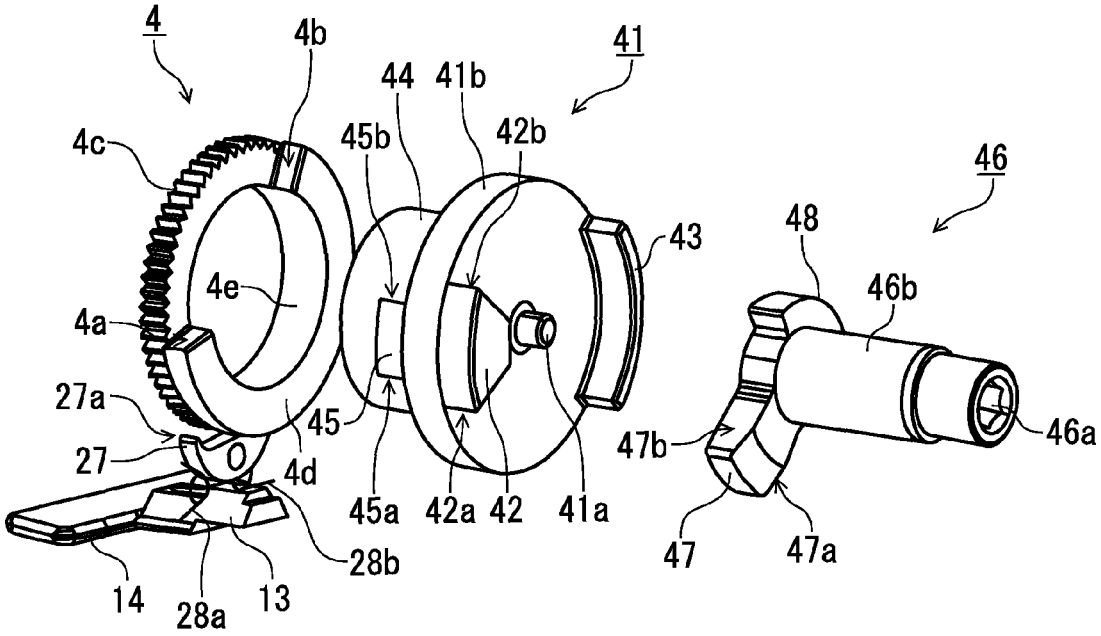
FIG. 27 illustrates the striking mechanism 40 according to the third embodiment.

Next, the detailed structure of the striking mechanism 40 will be described with reference to FIGS. 27 and 28. FIG. 27 illustrates the striking mechanism 40 according to the third embodiment. The hammer 41 is formed with a set of protruding portions, i.e., a protruding portion 42 and a protruding portion 43 which protrude axially forward from the cylindrical main body portion 41*b*. Further, a protruding portion 45 which protrudes axially rearward from the cylindrical main body portion 41*b* is formed. Although the protruding portion 45 is formed at the same position with a rotation angle with the protruding portion 42, the width of the protruding portion in the circumferential direction is made smaller than the protruding portion 42.

The front center of the main body portion 41*b* is formed with a fitting shaft 41*a* which fits to a fitting groove (not shown) formed at the rear of the anvil 46, and the hammer 41 and the anvil 46 are connected together so as to be rotatable relative to each other by a given angle of less than one rotation (less than 360 degrees). The protruding portion 42 acts as a striking pawl, and has planar striking-side surfaces 42*a* and 42*b* formed on both sides in a circumferential direction. The hammer 41 is formed with a protruding portion 43 for maintaining rotation balance with the protruding portions 42 and 45. Since the protruding portion 43 functions as a weight portion for taking rotation balance, no striking-side surface is formed. A cylindrical portion 44 is formed on the rear side of the main body portion 41*b* on the inner peripheral side including an axial center. Since the cylindrical portion 44 is provided to arrange the planetary gear 21*b* of the planetary gear speed-reduction mechanism 21, although the description thereof is omitted in the drawing, a space for accommodating the planetary gear 21*b* and through holes for holding the rotary shafts 21*c* are formed.

The anvil 46 is formed with a mounting hole 46*a* for mounting the tip tool on the front end side of the cylindrical main body portion 46*b*, and two protruding portions 47 and 48 which protrude radially outward from the main body portion 46*b* are formed on the rear side of the main body portion 46*b*. The protruding portion 47 is a striking pawl which has struck-side surfaces 47*a* and 47*b*, and is a weight portion in which a protruding portion 48 does not have a struck-side surface. Since the protruding portion 47 is adapted to collide with the protruding portion 42, the external diameter thereof is made equal to the appearance of the protruding portion 42. However, since both the protruding portions 43 and 48 are made to only act as a weight, and are not made to collide with any part, it is important to form and arrange the protruding portions with such positions and size that the protruding portions do not interfere with each other. In order to secure the rotation angle between the hammer 41 and the anvil 46 (here, less than one rotation at the maximum), the radial thicknesses of the protruding portions 43 and 48 are made small to increase a circumferential length so that the rotation balance between the protruding portions 42 and 47 is maintained. In the sprocket 4, a gear portion 4*c* is formed on the axial rear side, and an intermittent ring portion 4*d* having the axial thickness comparable to the gear portion 4*c* is formed on the front side. This intermittent ring portion 4*d* is formed by about 240 degrees in the circumferential direction, the remaining portion of 120 degrees has a cutaway shape, and two abutting surfaces 4*a* and 4*b* are formed at both ends of the cutaway portion. The abutting surfaces 4*a* and 4*b* abut on the abutting surfaces 45*a* and 45*b* of the protruding portion of the hammer 41 well. As the abutting surface 4*a* on the normal rotation side abuts on the abutting surface 45*a*, the sprocket 4 is rotated in the normal rotation direction in synchronization with the hammer 41. Similarly, as the abutting surface 4*b* on the reverse rotation side abuts on the abutting surface 45*b*, the sprocket 4 can be rotated in the reverse rotation direction. A cam 27 is provided on the lower side of the sprocket 4, and the cam 27 is biased by two springs 28*a* and 28*b* which are torsion springs. The initial position of the cam 27 is set by the convex portion 13 connected to the normal/reverse switching lever 14.

Figure 28:
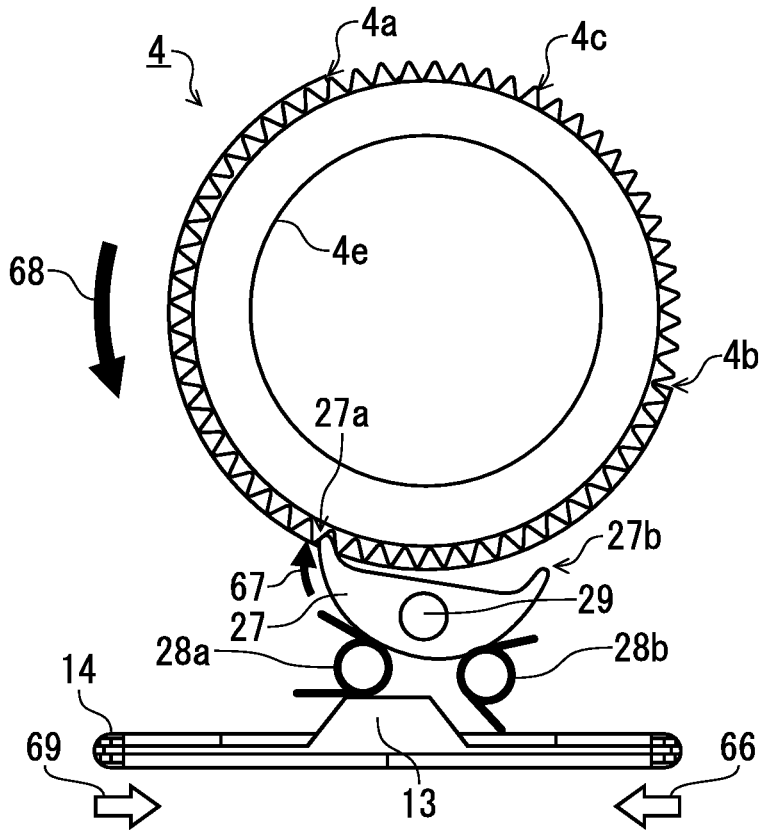
FIG. 28 illustrates a sprocket 4 according to the third embodiment as viewed from rear.

FIG. 28 illustrates the sprocket 4 according to the third embodiment as viewed from rear. The cam 27 located on the lower side of the gear portion 4*c* of the sprocket 4 is adapted to be rotatable, though slightly, about the shaft 29. The shaft 29 is held by the trunk portion 6*a* of the housing 6. By moving the normal/reverse switching lever 14 to the normal rotation side (in the direction of an arrow 66), the convex portion 13 moves to the left, the spring 28*a* is compressed by the convex portion 13, the cam 27 is moved in the direction of an arrow 67 by the force of the compressed spring 28*a*, and a pawl 27*a* (first pawl) of the cam 27 meshes with the gear portion 4*c*. As the pawl 27*a* of the cam 27 meshes with the gear portion 4*c*, movement of the sprocket 4 in the direction of an arrow 68 is limited. Here, when the sprocket 4 is rotated in a direction opposite to the direction of the arrow 68 in the state of FIG. 28, rotation of the sprocket 4 is not impeded from the relationship between the shape of the pawl 27*a* of the cam 27, and the shape of the gear portion 4*c*. By limiting only the rotation of the sprocket 4 in a given direction by the action between the sprocket 4 and the cam 27 in this way, the sprocket can be used as a brake during the reverse rotation of the hammer 41. As for this braking operation, the normal/reverse switching lever 14 is moved to the reverse rotation side (in the direction of an arrow 69) so that a pawl 27*b* (second pawl) of the cam 27 meshes with the gear portion 4*c* during the reverse rotation (during the loosening operation of a screw). This similarly can be made to operate as a brake portion.

Figure 29:
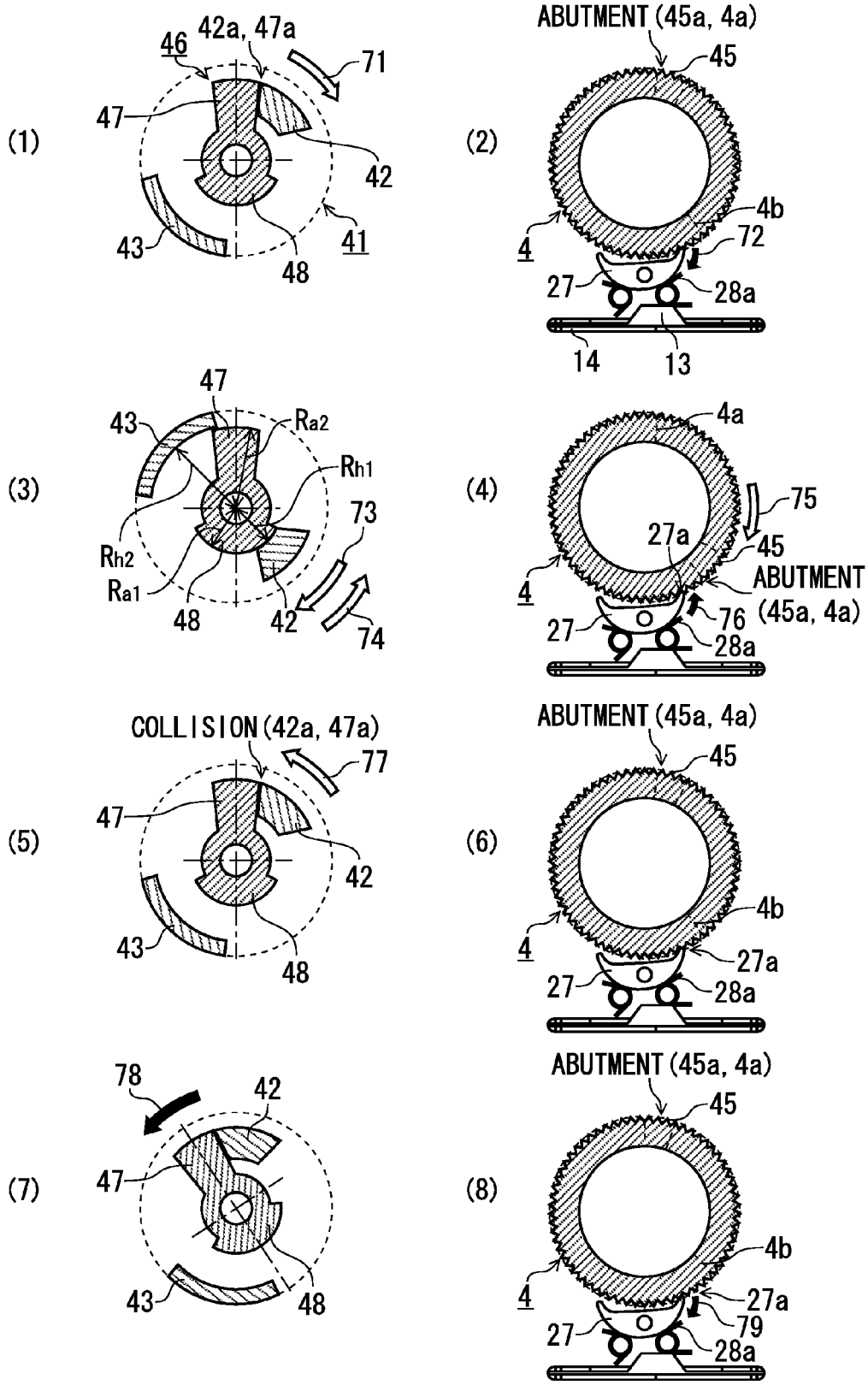
FIG. 29 illustrates the striking operation according to the third embodiment using a hammer 41, an anvil 46 and the sprocket 4, in four stages.

FIG. 29 illustrates the striking operation of the hammer 41 and the anvil 46 in four stages. FIG. 29 illustrates a plane vertical to the axial direction, the left view (odd number) corresponds to a portion A-A of FIG. 25, the right view (even number) corresponds to a portion B-B of FIG. 25, and these views are shown in a corresponding manner. In the right view, the protruding portion 45, and the abutting surfaces 4*a* and 4*b* are indicated by dotted lines. Since respective views of (2), (4), (6), and (8) of FIG. 29 are views seen from the front of the sprocket 4, and the rotation direction becomes reverse to the rear view shown in FIG. 28, attention should be paid.

In the state of FIGS. 29(1) and 7(2), while fastening torque received from the tip tool is small, the anvil 46 rotates counterclockwise (fastening direction) so as to follow the anvil 41 by being pushed from the hammer 41. In this case, since the abutting surface 45*a* of the protruding portion 45 is in contact with the abutting surface 4*a* of the sprocket 4 as shown in (2), the sprocket 4 rotates in the same direction so as to follow the hammer 41. Since the pawl 27*a* of the cam 27 is pushed and turns in the direction of an arrow 72 as the sprocket 4 rotates counterclockwise, the brake is not applied to the sprocket 4. In this state, the anvil 46 and the sprocket 4 rotate in synchronization with each other without rotating relative to the hammer 41. However, when the fastening torque becomes large, and rotation of the anvil 46 becomes impossible unless by the force of rotating the hammer 41, the reverse rotation of the motor 3 is started in order to reversely rotate the hammer 41 in the direction of arrow 66.

By starting the reverse rotation of the motor 3 from the state shown in a FIG. 29(1), the protruding portion 42 of the hammer 41 is rotated in the direction of arrow 71. In this case, since a cutaway portion is formed on the reversal side of the protruding portion 45 by about 120 degrees as a rotation angle, during this reverse rotation, the protruding portion 45 can be reversed without abutting on the sprocket 4. That is, the hammer 41 is reversed by about 120 degrees as a rotation angle from the state of FIG. 29(1), and neither the anvil 46 nor the sprocket 4 rotates.

When the motor 3 is further reversely rotated, and as shown in FIG. 29(3), the protruding portion 42 rotates in the direction of arrow 73 through the outer peripheral side of the protruding portion 48, as shown in FIG. 29(4), the abutting surface 45*b* of the protruding portion 45 abuts on the abutting surface 4*b*, whereby the sprocket 4 rotates in the direction of arrow 75. However, the cam 27 rocks immediately like arrow 76, and the pawl 27*a* meshes with the teeth of the gear portion 4*c*. As a result, the rotation of the sprocket 4 is stopped, and the rotation of the hammer 41 is also stopped by the stop of the sprocket 4. By using the sprocket 4 and the cam 27 in this way, the rotation of the hammer 41 in a reverse rotation state can be stopped. Since this braking operation is realized by mechanical elements, and electric power is not consumed, electric power can be prevented from being consumed for the braking operation. In FIG. 29(3), the external diameter $R_{a1}$ of the protruding portion 48 is made smaller than the internal diameter $R_{h1}$ of the protruding portion 42, and thus both the protruding portions do not collide with each other. Similarly, the external diameter $R_{a2}$ of the protruding portion 47 is made smaller than the internal diameter $R_{h2}$ of the protruding portion 43, and thus both the protruding portions do not collide with each other. Accordingly, braking operation is performed on only the hammer 41, and the anvil 46 is not influenced at all.

When the hammer 41 has stopped, the motor 3 is started to start the rotation of the hammer 41 in the direction (normal rotation direction) of arrow 74 of FIG. 29(3). Then, the normal rotation of the hammer 41 is accelerated and the striking-side surface 42*a* of the protruding portion 42 collides with the struck-side surface 47*a* on the anvil 46 at position shown in FIG. 29(5) in a state under acceleration. As a result of this collision, powerful rotation torque is transmitted to the anvil 46, and the anvil 46 rotates in the direction shown by arrow 77. Although the protruding portion 45 also moves by the movement of the hammer 41 between (3) to (5) of FIG. 29, since the protruding portion contacts neither the abutting surface 4*a* nor the abutting surface 4*b*, the sprocket 4 remains fixed without rotating as shown in FIG. 29(6).

The position of FIG. 29(7) is a state where both the hammer 41 and the anvil 46 have rotated in the direction of arrow 78 by a given angle from the state shown by FIG. 29(5). At this time, the sprocket 4 also rotates by the same angle as the anvil 46 in the direction of arrow 78. In this case, since the pawl of the cam 27 is pushed from inside and turns in the direction of an arrow 79 as the sprocket 4 rotates counterclockwise, the rotation of the sprocket 4 is not limited. By repeating operation from FIG. 29(1) to FIG. 29(8) in this way, a fastening-subject member is fastened until a proper torque is reached.

As described above, in the hammer 41 and the anvil 46 according to the invention, an impact tool can be realized with an extremely simple construction of only the hammer 41 and the anvil 46 serving as a striking mechanism by using a driving mode where the motor 3 is reversely rotated. Since electric power is not utilized for the braking operation of the hammer 41 when the motor 3 is reversed, rapid braking operation can be performed while minimizing power consumption. In the third embodiment, the cam 27 is moved by the convex portion 13 which is formed integrally with the normal/reverse switching lever 14. The cam 27 may be electrically driven to move, under the control by a control unit. In this case, the cam 27 can be moved only when braking is required while the pawls 27*a* and 27*b* of the cam 27 do not contact the teeth of the gear portion 4*c* when braking is not operated. If the cam 27 is electrically driven, the reverse rotation angle of the hammer 41 can be variably set, and the reverse rotation angle may be set depending on a required striking torque. If the cam 27 is electrically driven, it is also possible to form the sprocket 4 and the hammer 41 not separately but integrally.

The construction of the motor driving control system according to the third embodiment is substantially the same as that in the foregoing embodiments shown in FIG. 5. And, the operation of the motor driving control system according to the third embodiment is almost the same as that in the foregoing embodiments. Only the differences form the foregoing embodiments will be described.

Figure 30:
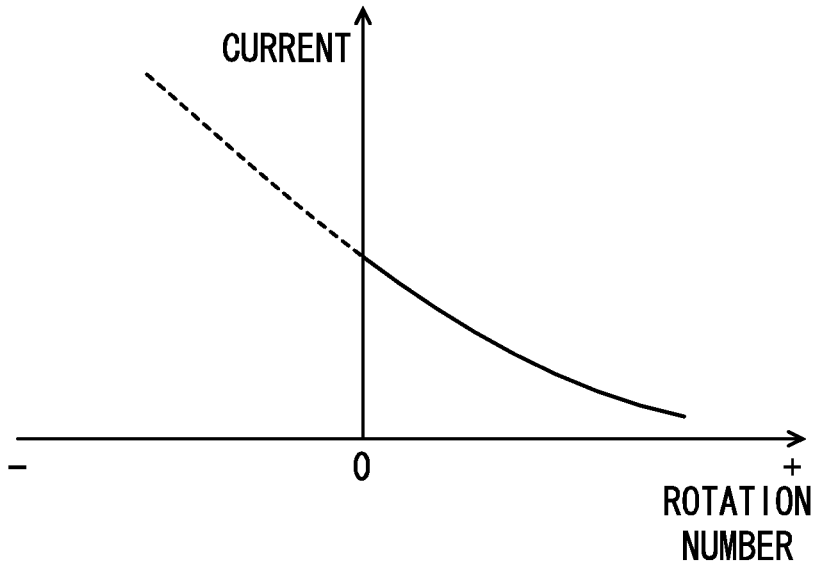
FIG. 30 illustrates the relationship between the rotation direction of the motor 3 and the driving current of the motor.

FIG. 30 illustrates the relationship between the rotation direction of the motor 3 and the driving current of the motor. The horizontal axis represents the rotation number of the motor when the driving current for rotating the motor is applied at a given rotation number, and the vertical axis represents the magnitude of a current which actually flows into the motor. Usually, when the rotation number of the motor is 0, i.e., during stop of the motor, and when a driving current is applied, a large current flows (this is called "starting current"). And, when the motor normally rotates (+ rotation), though slightly, and a driving current is applied in the normal rotation direction, the value of a current which actually flows becomes gradually small as shown by a solid line, and the rotation number of the motor becomes large. On the other hand, when the motor reversely rotates (– rotation) and when a driving current for normally rotating the motor is applied, since the rotation direction is opposite, a large current which is equal to or greater than the starting current flows as shown by a dotted line. Since a current is applied in this dotted-line region, a driving current (brake current) to be applied when the motor 3 is reversed is useless electric power which is not according to fastening operation if the driving current flows only for the braking operation. In order to prevent this useless electric power, it is necessary to start normal rotation after the rotation of the motor stops completely. However, in the third embodiment, since the braking operation is performed by mechanical elements, it is not necessary to apply a brake current unlike the dotted-line portion of FIG. 30. Therefore, power consumption can be suppressed to be small.

Next, the driving method of the impact tool 1 according to the third embodiment will be described. In the impact tool 1 according to the third embodiment, the anvil 46 and the hammer 41 are formed so as to be relatively rotatable at a rotation angle of about 120 degrees. And, the rotation control thereof is also unique. FIG. 30 illustrates a trigger signal during the operation of the impact tool 1, a driving signal of an inverter circuit, the rotating speed of the motor 3, and the striking state of the hammer 41 and the anvil 46. The horizontal axis is time in the respective graphs, and the horizontal axis is described together so that the timings of the respective graphs can be compared.

In the impact tool 1 according to the third embodiment, in the case of the fastening operation in the impact mode, fastening is first performed at high speed in the "drill mode", fastening is performed by switching to the "pulse mode (1)" if the value of the required fastening torque becomes large, and fastening is performed by switching to the "pulse mode (2)" if the value of required fastening torque becomes still larger. In the drill mode from time $T_1$ to time $T_2$ of FIG. 30, the computing unit 51 controls the motor 3 based on a target rotation number. For this reason, the motor is accelerated until the motor 3 reaches the target rotation number shown by arrow 3085*a*. Thereafter, the rotating speed of the motor 3 decreases gradually as shown by arrow 3085*b* when a fastening reaction force from the tip tool attached to the anvil 46 becomes large. Thus, decrease of the rotation speed is detected by the value of a current to be supplied to the motor 3, and switching to the rotation driving mode by the "pulse mode (1)" is performed at time $T_2$.

The pulse mode (1) is a mode in which the motor 3 is not continuously driven but intermittently driven, and is driven in pulses so that "pause→normal rotation driving" is repeated multiple times. Here, the expression "driven in pulses" means controlling driving so as to pulsate a gate signal to be applied to the inverter circuit 52, pulsate a driving current to be supplied to the motor 3, and thereby pulsate the rotation number or output torque of the motor 3. This pulsation is generated by repeating ON/OFF of a driving current with a large period (for example, about several tens of hertz to a hundred and several tens of hertz), such as OFF (pause) of the driving current to be supplied to the motor from time $T_2$ to time $T_{21}$ (pause), ON (driving) of the driving current of the motor from time $T_{21}$ to time $T_3$, OFF (pause) of the driving current from time $T_3$ to time $T_{31}$, and ON of the driving current from time $T_{31}$ to time $T_4$. Although PWM control is performed for the control of the rotation number of the motor 3 in the ON state of the driving current, the period to be pulsated is sufficiently small compared with the period (usually several kilohertz) of duty ratio control.

In the example of FIG. 30, after supply of a driving current to the motor 3 for a certain time period from $T_2$ is paused, and the rotating speed of the motor 3 is reduced. In this case, although the hammer 41 rotates later than the anvil 46, since the protruding portion 45 can be received in the cutaway portion of the sprocket 4 even if rotation of the hammer 41 is slightly delayed, the rotation of the hammer 41 is not influenced by the sprocket 4. After the rotating speed of the motor 3 decreases to arrow 3086*a*, the computing unit 51 (refer to FIG. 5) sends a driving signal 3083*a* to the control signal output circuit 53, thereby supplying a pulsating driving current (driving pulse) to the motor 3 to accelerate the motor 3. This control during acceleration does not necessarily mean driving at a duty ratio of 100% but means control at a duty ratio of less than 100%. Next, striking power is given as shown by arrow 3088*a* as the hammer 41 collides with the anvil 46 strongly at arrow 3086*b*. When striking power is given, the supply of a driving current to the motor 3 for a given time period is paused, and the rotating speed of the motor decreases again as shown by arrow 3086*c*. Thereafter, the computing unit 51 sends a driving signal 3083*b* to the control signal output circuit 53, thereby accelerating the motor 3. Then, striking power is given as shown by arrow 3088*b* as the hammer 41 collides with the anvil 46 strongly at arrow 3086*d*. In the pulse mode (1), the above-described intermittent driving of repeating "pause→normal rotation driving" of the motor 3 is repeated one time or multiple times. However, if higher fastening torque has been required, the state is detected, and switching to the rotation driving mode by the pulse mode (2) is performed. Whether or not higher fastening torque has been required can be determined using, for example, the rotation number (before or after arrow 3086*d*) of the motor 3 when the striking power shown by arrow 3088*b* has been given.

Although the pulse mode (2) is a mode in which the motor 3 is intermittently driven, and is driven in pulses similarly to the pulse mode (1), the motor is driven so that "pause→reverse rotation driving→braking (stop)→normal rotation driving" is repeated plural times. That is, in the pulse mode (2), in order to add not only the normal rotation driving but the reverse rotation driving of the motor 3, the hammer 41 is accelerated in the normal rotation direction so as to collide with the anvil 46 strongly after the hammer 41 is reversely rotated by a sufficient angular relation with respect to the anvil 46. By driving the hammer 41 in this way, strong fastening torque is generated in the anvil 46. In the third embodiment, when the rotation of the motor 3 which has been reversely rotated and driven is stopped (around arrows 3087*b* and 3087*f* in the drawing), the motor 3 is not decelerated and stopped by applying a normal rotation current to the motor 3, but the motor 3 is decelerated and stopped by making the hammer 41 collide with the sprocket 4.

In the example of FIG. 30, when switching to the pulse mode (2) is performed at time T4, driving of the motor 3 is temporarily paused, and then, the motor 3 is reversely rotated by sending the driving signal 3084*a* in a negative direction to the control signal output circuit 53. When normal rotation or reverse rotation is performed, this normal rotation or reverse rotation is realized by switching the signal pattern of each driving signal (ON/OFF signal) to be output to each of the switching elements Q1 to Q6 from the control signal output circuit 53. If the motor 3 has been reversely rotated by a given rotation angle (arrow 3087*a*), since the abutting surface 45*b* of the protruding portion 45 collides with the abutting surface 4*b* of the sprocket 4, the rotation of the motor 3 stops (arrow 3087*b*). Thereafter, the driving of the motor 3 is temporarily paused, and normal rotation driving is started. For this reason, a driving signal 3084*b* in a positive direction is sent to the control signal output circuit 53. In the rotational driving using the inverter circuit 52, a driving signal is not switched to the plus side or minus side. However, a driving signal is classified into the + direction and – direction and is schematically expressed in FIG. 30 so that whether the motor is rotationally driven in any direction can be easily understood.

The hammer 41 collides with the anvil 46 at a time when the rotating speed of the motor 3 reaches a maximum speed (arrow 3087*c*). Due to this collision, significant large torque (89*a*) is generated compared to fastening torques (3088*a*, 3088*b*) to be generated in the pulse mode (1). When collision is performed in this way, the rotation number of the motor 3 decreases so as to reach arrow 3087*d* from arrow 3087*c*. The control of stopping a driving signal to the motor 3 at the moment when the collision shown by arrow 89*a* has been detected may be performed. In that case, if a fastening-subject member is a bolt, a nut, etc., the recoil transmitted to an operator's hand after striking is little. By applying a driving current to the motor 3 as in the third embodiment even after collision, the reaction force to an operator is small as compared to the drill mode, and is suitable for the operation in a middle load state. Further, an effect that the fastening speed is high, and power consumption is little compared to a strong pulse mode is obtained. Thereafter, similarly, fastening with strong fastening torque is performed by repeating "pause→reverse rotation driving→braking→normal rotation driving" by a given number of times. As an operator releases the trigger operation at time $T_7$, the motor 3 stops, and the fastening operation is completed. The completion of the operation may be controlled so as to stop driving of the motor 3 when the computing unit 51 has determined based on not only the release of the trigger operation by an operator but the output of the striking impact detecting sensor 56 (refer to FIG. 5) that fastening with set fastening torque is completed.

As described above, in the third embodiment, rotational driving is performed in the drill mode in an initial stage of fastening where only small fastening torque is required, fastening is performed in the pulse mode (1) by intermittent driving of only normal rotation as the fastening torque becomes large, and fastening is powerfully performed in the pulse mode (2) by intermittent driving by the normal rotation and reverse rotation of the motor 3, in the final stage of fastening. Driving may be performed using only the pulse mode (1) and the pulse mode (2). The control of proceeding directly to the pulse mode (2) from the drill mode without providing the pulse mode (1) is also possible. Since the normal rotation and reverse rotation of the motor are alternately performed in the pulse mode (2), fastening speed becomes significantly slower than that in the drill mode or pulse mode (1). When the fastening speed becomes abruptly slow in this way, the sense of discomfort when transiting to the striking operation becomes large compared to an impact tool which has a well-known rotation striking mechanism. Thus, in the shifting to the pulse mode (2) from the drill mode, an operation feeling becomes a natural feeling on the side where the pulse mode (1) is interposed. By performing fastening in the drill mode or pulse mode (1) as much as possible, fastening operation time can be shortened.

Figure 31:
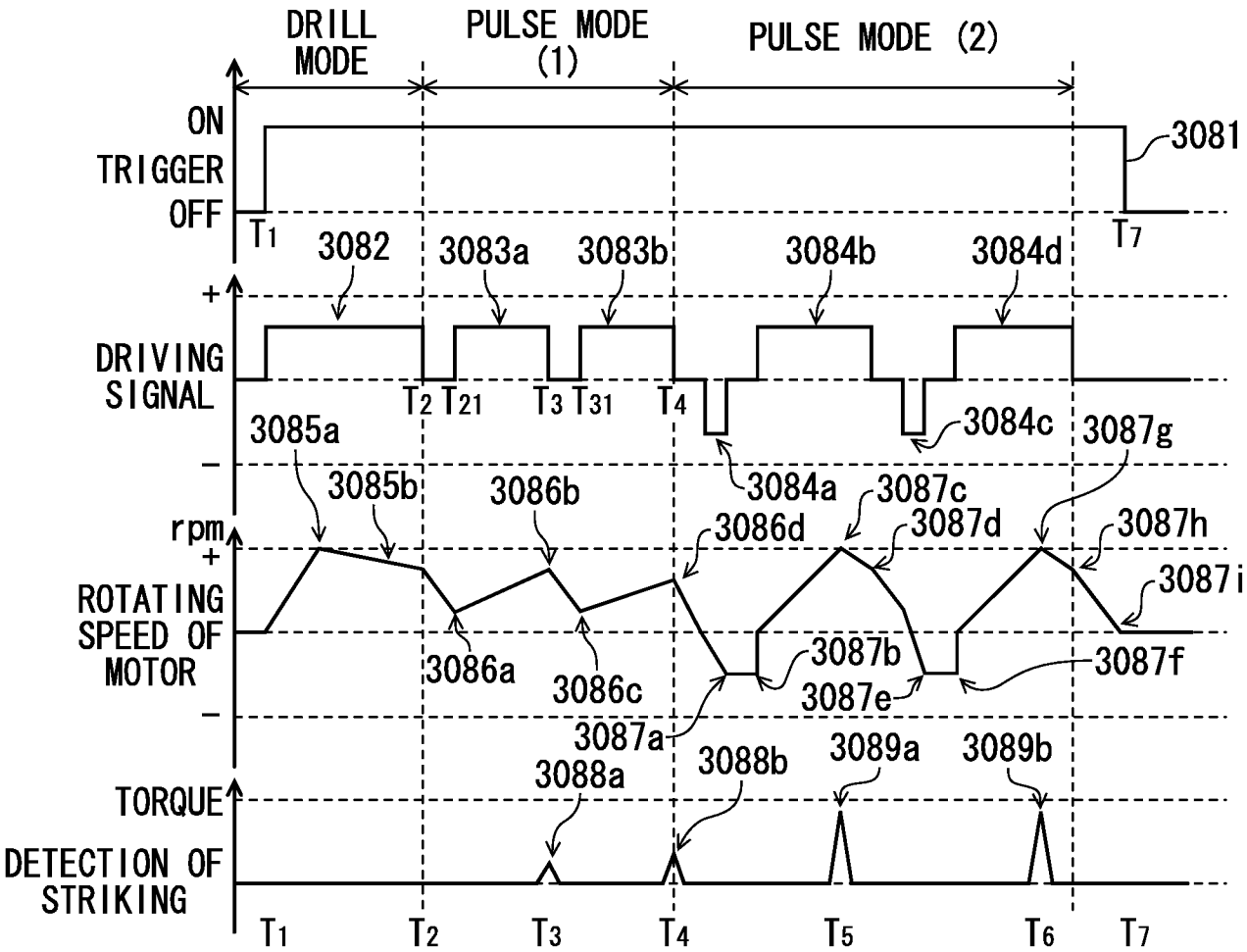
FIG. 31 illustrates a trigger signal during the operation of the impact tool 1, a driving signal of an inverter circuit, the rotating speed of the motor 3, and the striking state of the hammer 41 and the anvil 46.

Next, the control procedure of the impact tool 1 will be described with reference to FIG. 31 to FIG. 35. FIG. 31 illustrates the control procedure of the impact tool 1 according to the third embodiment. The impact tool 1 determines whether or not the impact mode has been selected using the toggle switch 32 (refer to FIG. 2) prior to start of the operation by an operator (Step 3101). If the impact mode has been selected, the process proceeds to Step 3102, and if the impact mode is not selected, that is, in the case of a normal drill mode, the process proceeds to Step 3110.

In the pulse mode, the computing unit 51 determines whether or not the trigger switch 8 has been turned on. If the trigger switch has been turned on (the trigger operating portion 8*a* has been pulled), as shown in FIG. 30, the motor 3 is started by the drill mode (Step 3103), and the PWM control of the inverter circuit 52 is started according to the amount of pulling of the trigger operating portion 8*a* (Step 3104). Then, the rotation of the motor 3 is accelerated while performing a control so that a peak current to be supplied to the motor 3 does not exceed an upper limit p. Next, the value I of a current to be supplied to the motor 3 after t milliseconds have elapsed after starting is detected using the output of the current detecting circuit 59 (refer to FIG. 5). If the detected current value I does not exceed p1 ampere, the process returns to Step 3104, and if the current value has exceeded p1 ampere, the process proceeds to Step 3108 (Step 3107). Next, it is determined whether or not the detected current value I exceeds p2 Ampere (Step 3108).

Figure 33:
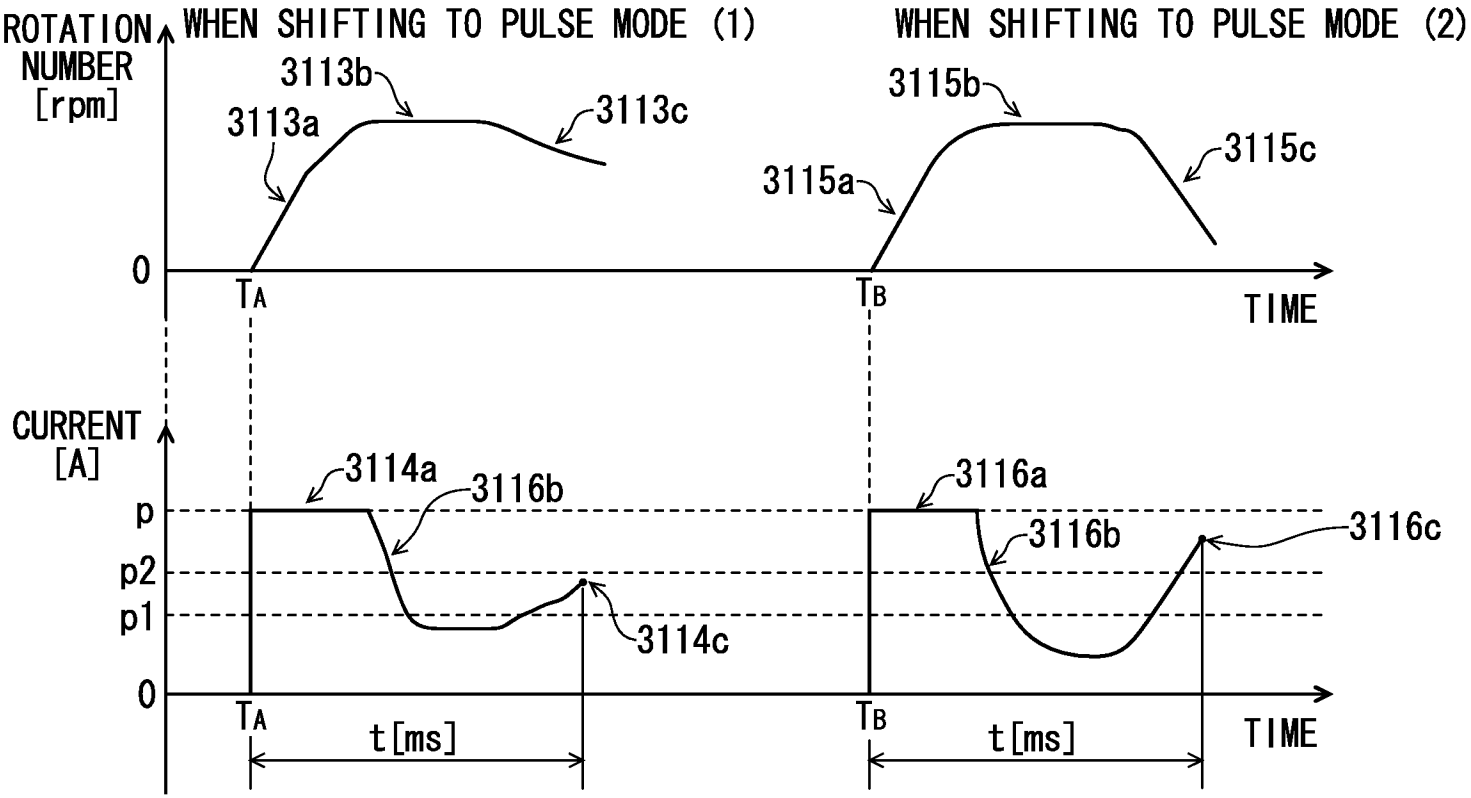
FIG. 33 illustrates a graph for explaining a driving mode of the hammer 41 in the third embodiment, in which a current to be applied to the motor and the rotation number are shown.
Figure 35:
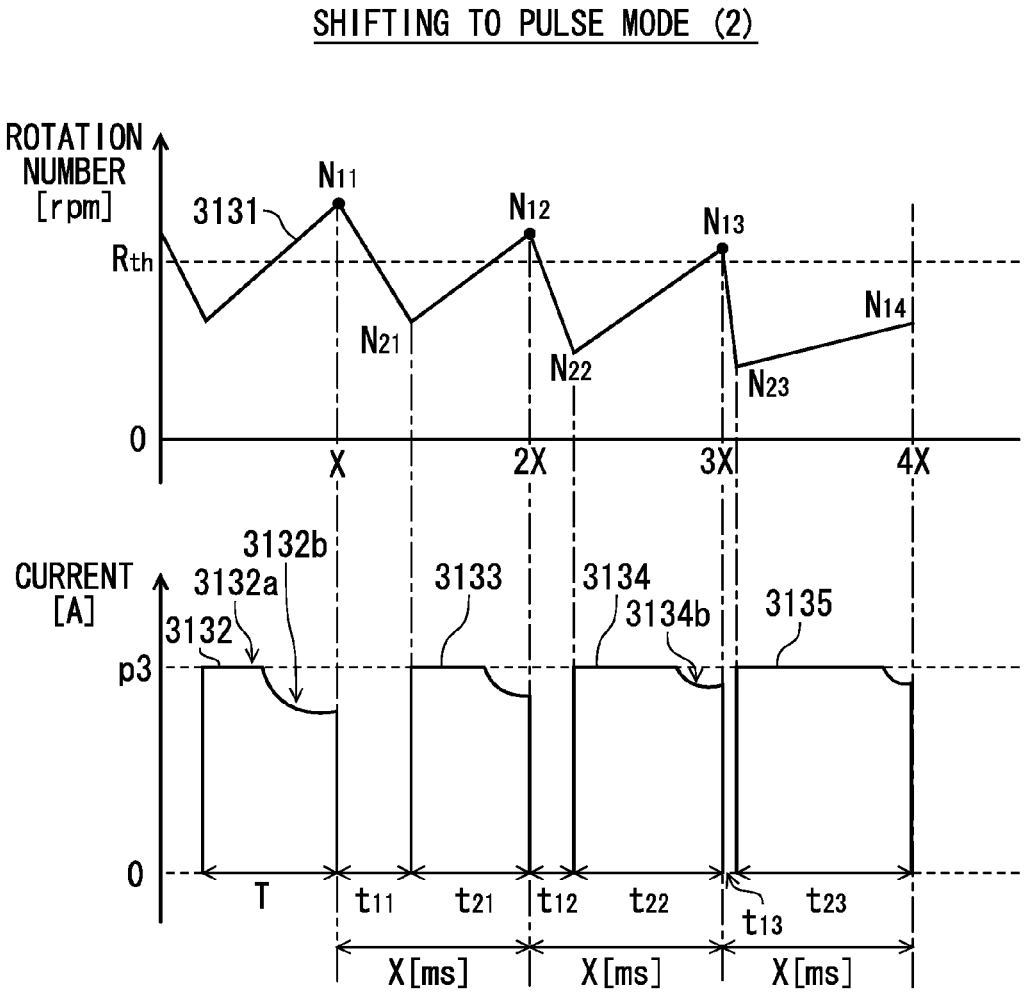
FIG. 35 illustrates the relationship between the rotation number of the motor 3 and elapsed time and the relationship between the value of a current to be supplied to the motor 3 and elapsed time.
Figure 36:
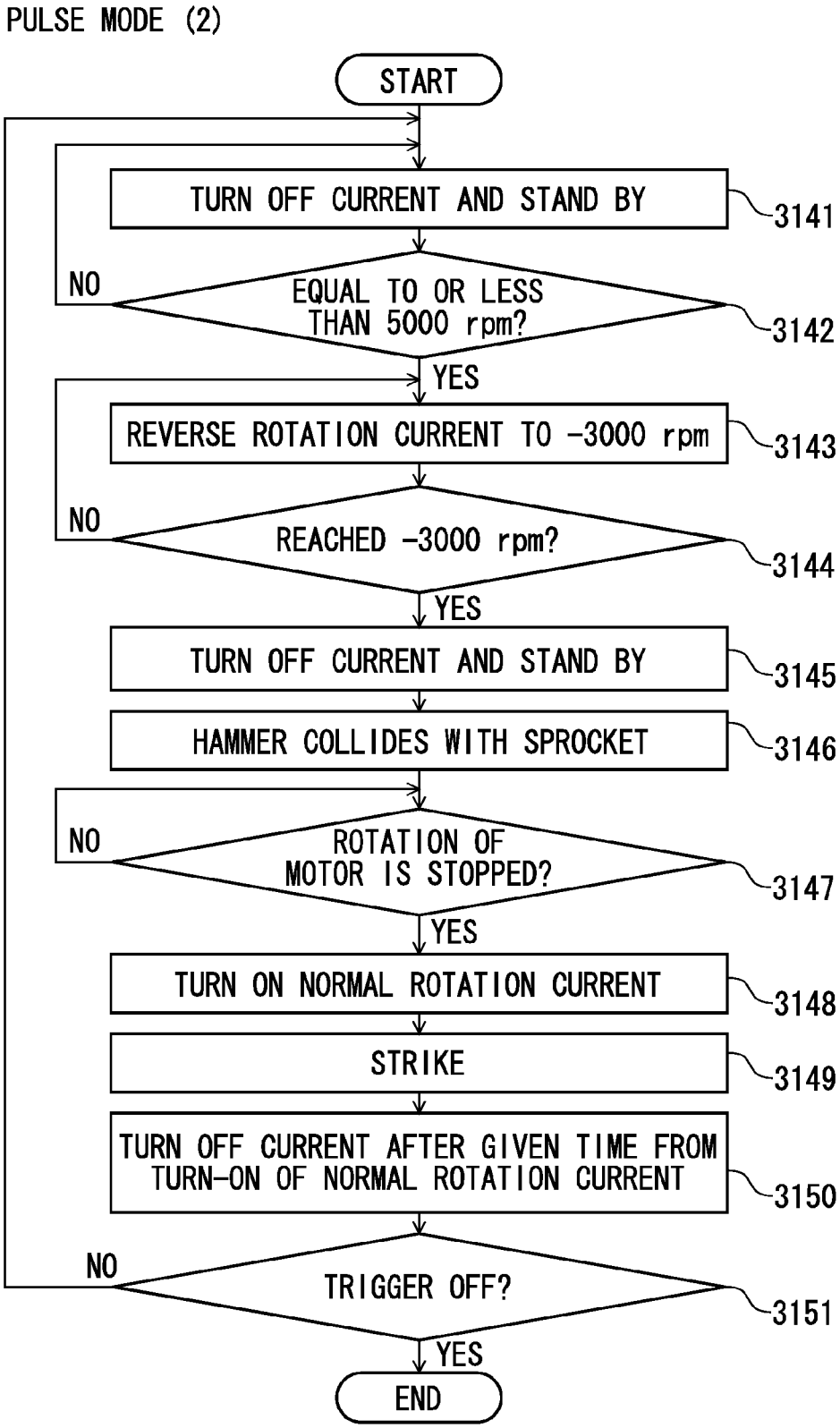
FIG. 36 illustrates the driving control procedure of the motor 3 in the pulse mode (2) according to the third embodiment.

If the detected current value I does not exceed p2 [A] in Step 3108, that is, if the relationship of p1<I<p2 is satisfied, the process proceeds to Step 3109 (Step 3120) after the procedure of the pulse mode (1) shown in FIG. 33 is executed. Then, if the detected current value I exceeds p2 [A], the process proceeds directly to Step 3109, without executing the procedure of the pulse mode (1). In Step 3109, it is determined whether or not the trigger switch 8 is set to ON. If the trigger switch is turned off, the processing returns to Step 3101. If the ON state is continued, the processing returns to Step 3101 after the procedure of the pulse mode (2) shown in FIG. 35 is executed.

If the drill mode is selected in Step 3101, the drill mode 3110 is executed, but the control of the drill mode is the same as the control of Steps 3102 to 107. Then, by detecting a control current in an electronic clutch or an overcurrent state immediately before the lock of the motor 3 as p1 of Step 3107, thereby stopping the motor 3 (Step 3111), the drill mode is ended, and the processing returns to Step 3101.

Figure 32:
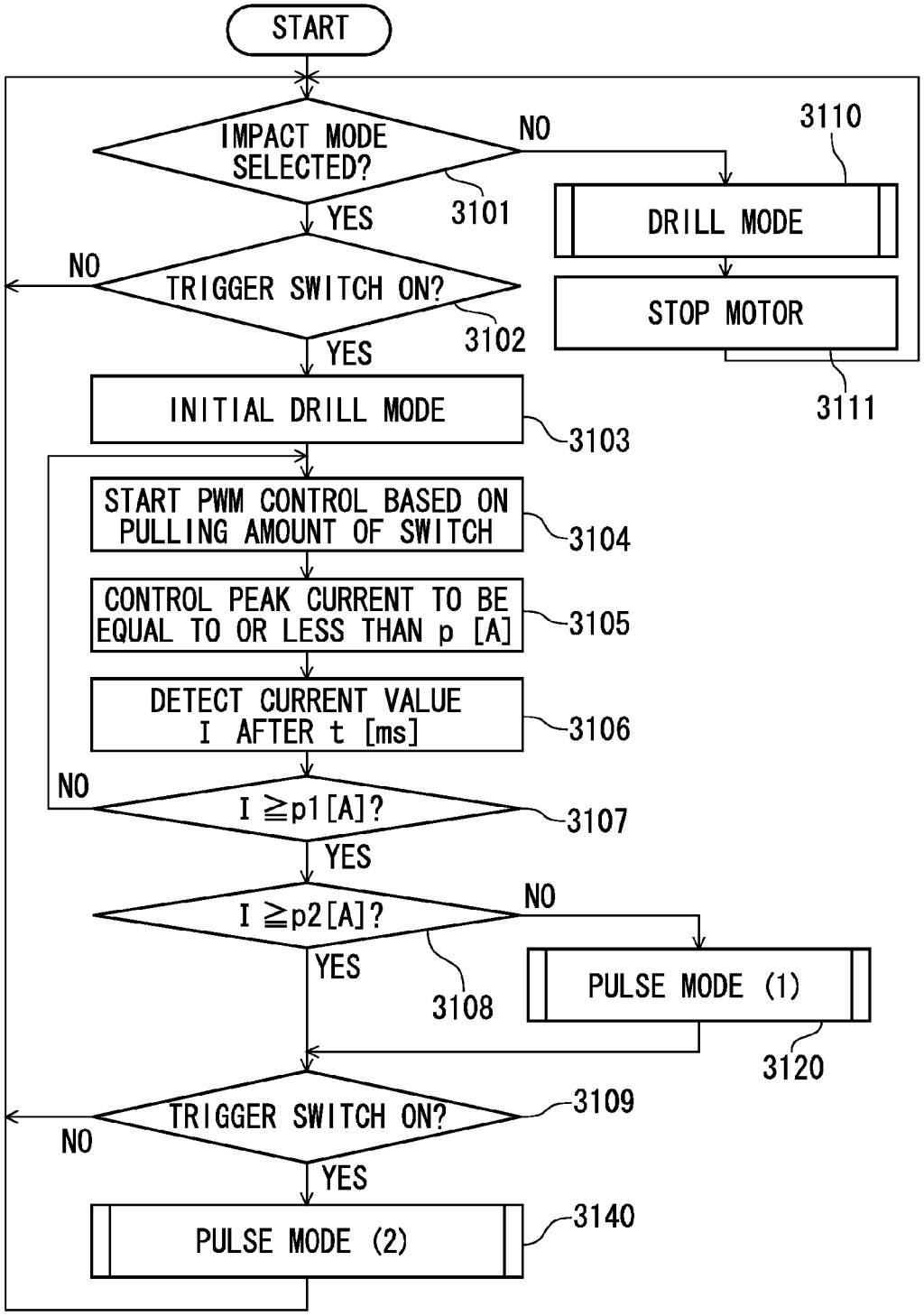
FIG. 32 illustrates a driving control procedure of the motor 3 according to the third embodiment.

Here, the determination procedure of the mode shifting in Steps 3107 and 3108 will be described with reference to FIG. 32. An upper graph shows the relationship between elapsed time and the rotation number of the motor 3, a lower graph shows the relationship between a current value to be supplied to the motor 3, and time, and the time axes of the upper and lower graphs are made the same. In the left graph, when the trigger switch is pulled at time TA (equivalent to Step 3102 of FIG. 31), the motor 3 is started and accelerated as shown by arrow 3113*a*. During this acceleration, a constant current control in a state where the maximum current value p is limited as shown by arrow 3114*a* is performed. When the rotation number of the motor 3 reaches a given rotation number (arrow 3113*b*), a current during acceleration becomes a usual current as shown by arrow 3114*b*. Therefore, the current value decreases. Thereafter, when the reaction force received from a fastening-subject member increases as fastening of a screw, a bolt, etc. proceeds, the rotation number of the motor 3 decreases gradually as shown by arrow 3113*c*, and the value of a current to be supplied to the motor 3 increases. Then, the current value is determined after t milliseconds have elapsed from the starting of the motor 3. If the relationship of p1<I<p2 is satisfied as shown by arrow 3114*c*, the process shifts to the control of the pulse mode (1) which will be described later, as shown in Step 3120.

In the right graph, when the trigger switch is pulled at time TB (equivalent to Step 3102 of FIG. 31), the motor 3 is started and accelerated as shown by arrow 3115*a*. During this acceleration, a constant current control in a state where the maximum current value p is limited as shown by arrow 3116*a* is performed. When the rotation number of the motor 3 reaches a given rotation number (arrow 3115*b*), a current during acceleration becomes a usual current as shown by arrow 3116*b*. Therefore, the current value decreases. Thereafter, when the reaction force received from a fastening-subject member increases as fastening of a screw, a bolt, etc. proceeds, the rotation number of the motor 3 decreases gradually as shown by arrow 3115*c*, and the value of a current to be supplied to the motor 3 increases. In this example, the reaction force received from a fastening-subject member increased rapidly. Therefore, as shown by arrow 3116*c*, decrease of the rotation number of the motor 3 is large, and the rising degree of the current value is large. Then, since the current value after t milliseconds have elapsed from the starting of the motor 3 satisfies the relationship of p2<I as shown by arrow 3116*c*, the process shifts to the control of the pulse mode (2) shown in FIG. 35 as shown in Step 3140.

Usually, in the fastening operation of a screw, a bolt, etc., required that fastening torque was not often constant due to variation in the machining accuracy of a screw or a bolt, the state of a fastening-subject member, variation in materials, such as knots, grain, etc. of timber. Therefore, fastening may be performed at a stroke until immediately before completion of the fastening only by the drill mode. In such a case, when fastening in the pulse mode (1) is skipped, and shifting to the fastening by the pulse mode (2) with a higher fastening torque is made, the fastening operation can be efficiently completed in a short time.

Next, the control procedure of the impact tool in the pulse mode (1) will be described with reference to FIG. 33. If the process has shifted to the pulse mode (1), the peak current is first limited to equal to or less than p3 ampere (Step 3121) after a given pause period, and the motor 3 is rotated by supplying a normal rotation current to the motor 3 during a given time, i.e., T milliseconds (Step 3122). Next, the rotation number $N_{1n}$ [rpm] of the motor 3 after time T milliseconds have elapsed is detected (here, n=1, 2, . . . ) (Step 3123). Next, a driving current to be supplied to the motor 3 is turned off (Step 3124), and the time $t_{1n}$ which is required until the rotation number of the motor 3 is lowered and reduced to $N_{2n}$ ($=N_{1n}/2$) from $N_{1n}$ is measured (Step 3125). Next, $t_{2n}$ is obtained from $t_{2n}=X-t_{1n}$, a normal rotation current is applied to the motor 3 during a period of this $t_{2n}$ (Step 3126), and the peak current is suppressed to equal to or less than p3 ampere, thereby accelerating the motor 3 (Step 3127). Next, it is determined whether or not the rotation number $N_{1(n+1)}$ of the motor 3 is equal to or less than a threshold rotation number $R_{th}$ for shifting to the pulse mode (2) after the elapse of the time $t_2$. If the rotation number of the motor is equal to or less than $R_{th}$, the processing of the pulse mode (1) is ended, the process returns to Step 3120 of FIG. 31, and if the rotation number of the motor is equal to or more than $R_{th}$, the process returns to Step 3124 (Step 3128).

Figure 34:
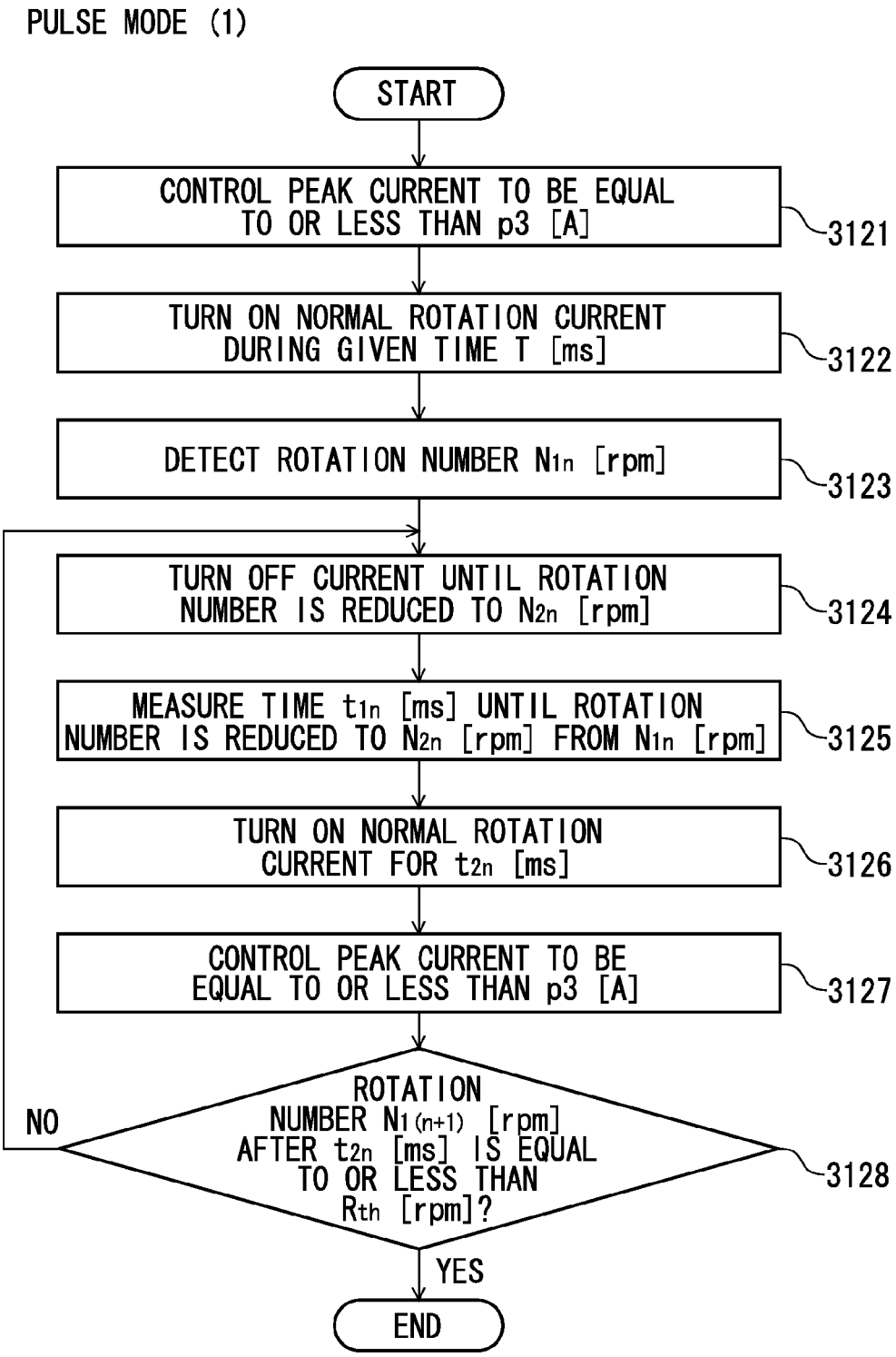
FIG. 34 illustrates a driving control procedure of the motor 3 in a pulse mode (1) according to the third embodiment.

FIG. 34 is a graph showing the relationship between the rotation number of the motor 3 and elapsed time and the relationship between a current to be supplied to the motor 3 and elapsed time while the procedure of the flow chart shown in FIG. 33 is executed. A driving current 3132 is first supplied to the motor 3 by time T. Since the driving current limits the peak current to equal to or less than p3 ampere, the current during acceleration is limited as shown by arrow 3132*a*, and thereafter, the current value decreases as shown by arrow 3132*b* as the rotation number of the motor 3 increases. At time $T_1$, when it is measured that the rotation number of the motor 3 has reached $N_{11}$, the rotation number $N_{21}$ which starts the rotation of the motor 3 from $N_{21}=N_{11}/2$ is calculated. The rotation number $N_{11}$ is, for example, 10,000 rpm. When the rotation number of the motor 3 decreases to $N_{21}$, a driving current 3133 is supplied, and the motor 3 is accelerated again. Time $t_{2n}$ during which the driving current 3133 is applied is determined by $t_{2n}=X-t_{1n}$. Similarly, although the same control is performed at times 2× and 3×, the rising degree of the rotation number of the motor 3 decreases as the fastening reaction force becomes large, and the rotation number $N_{14}$ will become equal to or less than the threshold rotation number $R_{th}$ at time 4×. At this time, the processing of the pulse mode (1) is ended, and the process shifts to the processing of the pulse mode (2).

Next, the control procedure of the impact tool in the pulse mode (2) will be described with reference to FIG. 35. First, a driving current to be supplied to the motor 3 is turned off, and standby is performed (Step 3141). If the rotation number of the motor is reduced to equal to or less than 5000 rpm during standby, a reverse rotation current is supplied to the motor 3 so that the motor is rotated at −3000 rpm (Steps 3142 and 3143). The rotation number of the motor 3 is detected using an output signal of the rotational position detecting element 58. Here, the "minus" means that the motor 3 is rotated in a direction reverse to the rotation direction under operation at 3000 rpm. Next, if the rotation number of the motor 3 has reached −3000 rpm, a current to be supplied to the motor 3 is turned off, and standby is performed (Steps 3144 and 3145). When a current is turned off, the motor 3 continues rotating through inertia, and the protruding portion 45 of the hammer 41 collides with the abutting surface (4*a* or 4*b*) of the sprocket 4 (Step 3146). Due to this collision, the cam 27 rocks in the direction of the arrow 67 of FIG. 28 and the pawl of the cam 27 meshes with the gear portion 4*c*, whereby the rotation of the hammer 41 stops immediately. Since the motor 3 which has been reversed without consuming a current can be stopped by making the hammer 41 collide with the sprocket 4 during the reverse rotation of the motor 3 in this way, current consumption can be significantly saved.

Next, if it is confirmed that the motor 3 has stopped, a normal rotation current is turned on in order to rotate the motor 3 in the normal rotation direction (Steps 3147 and 3148). The stop of rotation of the motor 3 can be detected using an output signal of the rotational position detecting element 58, and an output signal of the striking impact detecting sensor 56. When a normal rotation current is turned on, the motor 3 is accelerated to the rotation of 10,000 rpm, and the hammer 41 collides with the anvil 46 at this rotation number. In this way, fastening is performed by the output torque of the motor 3 and the inertial energy of the motor 3 and the hammer 41 (Step 3149). Then, after a normal rotation current is turned on, a current to be supplied to the motor 3 after the elapse of a given time is turned off (Step 3150). It is preferable that this given time be set so as to elapse after striking is performed.

Thereafter, it is detected whether or not the ON state of the trigger switch is maintained. If the trigger switch is in an OFF state, the rotation of a motor 3 is stopped, the processing of the pulse mode (2) is ended, and the processing returns to Step 3140 of FIG. 31 (Step 3151). If the trigger switch 8 is in an ON state, the processing returns to Step 3141 (Step 3151). In Step 3146, the impact during reverse rotation may be mitigated by applying a normal rotation current immediately before a collision during reverse rotation, thereby putting on the brake though slight to reduce the rotation number in a reverse of direction of the motor immediately before the collision.

As described above, according to the third embodiment, a fastening-subject member can be efficiently fastened by performing continuous rotation, intermittent rotation only in the normal direction, and intermittent rotation in the normal direction and in the reverse direction for the motor using the hammer and the anvil between which the relative rotation angle is less than one rotation. Since the shape of the hammer and the anvil can be made into a simple structure, miniaturization and cost reduction of the impact tool can be realized. Since there is no need of applying a large normal rotation current in stopping the motor under rotation in the reverse direction and the motor is effectively stopped in a short time by a brake mechanism by the sprocket 4, the amount of consumption of a current can be reduced. Since the reversed hammer is made to collide with the sprocket, the error of the initial position where acceleration of the normal rotation of the hammer is started decreases, and variation in striking power can be made small.

The invention is not limited to the above-described embodiment. For example, although a brushless DC motor is exemplified, other kinds of motors which can be driven in the normal direction and in the reverse direction may be used.

The shape of the anvil and the hammer is arbitrary, and may be other shapes which provide a structure in which the anvil and the hammer cannot continuously rotate relative to each other (cannot rotate while riding over each other), secure a given relative rotation angle of less than 360 degrees, and form a striking-side surface and a struck-side surface. For example, the protruding portion of the hammer and the anvil may be constructed so as not to protrude axially but to protrude in the circumferential direction. Since the protruding portions of the hammer and the anvil are not necessarily only protruding portions which become convex to the outside, and have only to be able to form a striking-side surface and a struck-side surface in a certain shape, the protruding portions may be protruding portions (that is, recesses) which protrude inside the hammer or the anvil. The striking-side surface and the struck-side surface are not necessarily limited to flat surfaces, and may be a curved shape or other shapes which form a striking-side surface or a struck-side surface well.

In the third embodiment, the sprocket 4 as a brake mechanism is provided between the striking-side surface of the hammer, and the planetary gear speed-reduction mechanism. However, the sprocket may be provided at the outer peripheral side of the hammer, not limited only to this position, or may be provided between the planetary gear speed-reduction mechanism and the motor.

The present invention is not limited to the above-mentioned embodiments, but may be embodied, for example, by modifying constituent components without departing from the spirit and scope of the invention. Further, various inventions can be formed by appropriately combining multiple constituent components disclosed in the above-mentioned embodiments. For example, some of all the constituent components disclosed in the above-mentioned embodiments may be deleted. Further, constituent components used in different embodiments may be combined appropriately.

This application claims priorities from Japanese Patent Application No. 2009-177114 filed on Jul. 29, 2009, Japanese Patent Application No. 2009-215086 filed on Sep. 16, 2009, and Japanese Patent Application No. 2009-259354 filed on Nov. 12, 2009, the entire contents of which are incorporated herein by reference.

INDUSTRIAL APPLICABILITY

According to an aspect of the invention, there is provided an impact tool in which an impact mechanism is realized by a hammer and an anvil with a simple mechanism.

According to another aspect of the invention, there is provided an impact tool which can drive a hammer and an anvil between which the relative rotation angle is less than 360 degrees, thereby performing a fastening operation, by devising a driving method of a motor.

According to still another aspect of the invention, there is provided a multi-use impact tool which can switch and be used in a drill mode and impact mode.

The invention claimed is:

1. An impact tool comprising:

a motor;

a hammer connected to an output portion of the motor; and an anvil to be struck by the hammer in a rotation direction, the hammer striking the anvil in the rotation direction by driving the motor in pulses, wherein the anvil is provided in front of the hammer, wherein the hammer is driven in pulses by the motor, and wherein a rotation angle of the hammer is substantially proportional to a rotation angle of the motor.

2. The impact tool of claim 1, wherein the motor rotates a pinion, wherein plural planetary gears which mesh with the pinion are provided, and wherein rotary shafts of the plural planetary gears are fixed to the hammer.

3. The impact tool of claim 1, wherein a tip tool holding portion is fixed to the anvil.

4. The impact tool of claim 3, further comprising a housing which accommodates the motor, wherein the hammer has a cylindrical portion smaller than the external diameter of the hammer at a rear portion of the hammer, and wherein the hammer is rotatably held in the housing by a bearing held at the cylindrical portion.

5. The impact tool of claim 4, wherein the hammer and the cylindrical portion are integrally formed.

6. The impact tool of claim 1, wherein the anvil is struck by the hammer by rotating the motor repeatedly in a normal direction and a reverse direction.

7. The impact tool of claim 1, wherein a maximum rotation angle of the hammer with respect to the anvil is less than 360 degrees.

* * * * *